US008590526B2

(12) United States Patent
Sun

(10) Patent No.: US 8,590,526 B2
(45) Date of Patent: Nov. 26, 2013

(54) GAS STOVE HAVING IMPROVED BURNERS INCORPORATED WITH REMOVABLE FLAME HEAT TRANSFER REGULATING APPARATUS CONCEALED BY TOP PLATES OF THE STOVE

(76) Inventor: Yizhong Sun, Castaic, CA (US)

( * ) Notice: Subject to any disclaimer, the term of this patent is extended or adjusted under 35 U.S.C. 154(b) by 882 days.

(21) Appl. No.: 12/660,234

(22) Filed: Feb. 22, 2010

(65) Prior Publication Data

US 2010/0154778 A1 Jun. 24, 2010

Related U.S. Application Data

(63) Continuation-in-part of application No. 12/313,940, filed on Nov. 26, 2008, now abandoned, which is a continuation-in-part of application No. 11/811,521, filed on Jun. 11, 2007, now Pat. No. 7,708,006.

(51) Int. Cl.
*F24C 3/08* (2006.01)

(52) U.S. Cl.
USPC ..... 126/39 K

(58) Field of Classification Search
USPC ..... 126/39 K, 39 E, 39 R, 1 R, 9 R, 9 B, 40, 126/211, 214 C, 214 D, 38, 43, 116 R; 431/249
See application file for complete search history.

(56) References Cited

U.S. PATENT DOCUMENTS

| | | | | |
|---|---|---|---|---|
| 1,072,115 | A * | 9/1913 | Harmon | 126/39 R |
| 1,156,087 | A | 10/1915 | Kupfer | |
| 1,485,292 | A * | 2/1924 | Popper | 422/300 |
| 2,166,442 | A | 7/1939 | Kahn | |
| 2,910,930 | A * | 11/1959 | Hankoff | 99/421 R |
| 3,187,742 | A | 6/1965 | Power | |
| D220,150 | S * | 3/1971 | Roestenburg | D7/332 |
| 4,794,906 | A * | 1/1989 | Longley, Jr. | 126/9 R |
| 4,850,335 | A | 7/1989 | Farnsworth et al. | |
| 5,201,306 | A * | 4/1993 | Kinny | 126/214 A |
| 5,323,759 | A | 6/1994 | Hammel et al. | |
| 5,797,386 | A * | 8/1998 | Orr | 126/25 R |
| 6,093,018 | A | 7/2000 | Avshalumov | |
| 6,132,205 | A | 10/2000 | Harneit | |
| 6,505,621 | B2 | 1/2003 | Gabelmann | |
| 6,851,419 | B2 | 2/2005 | Reiner | |
| 6,851,420 | B2 | 2/2005 | Jennings | |
| 2004/0045542 | A1 | 3/2004 | Zhou | |
| 2004/0250807 | A1 * | 12/2004 | Reiner | 126/9 R |
| 2005/0109330 | A1 | 5/2005 | Pestrue | |
| 2005/0115556 | A1 | 6/2005 | Carson et al. | |
| 2006/0065264 | A1 * | 3/2006 | Huggins | 126/43 |
| 2008/0302353 | A1 | 12/2008 | Sun | |
| 2009/0078247 | A1 | 3/2009 | Sun | |

* cited by examiner

*Primary Examiner* — Avinash Savani

(57) ABSTRACT

A stove of saving the combustible gases and ornamenting a kitchen. The stove includes a multiple burner configuration composed of improved removable burners. Each removable burner has a plurality of gas ports for generating angularly patterned flame directly in contact with the bottom surface of a cooking utensil, combustible gas dispersing means and gas-primary air mixing means for producing a homogeneous mixture of the combustible gases and air to achieve efficient combustion. The gas ports are located to each burner's upper section which is surrounded by a removable heat transfer regulating apparatus, wherein the apparatus focuses heat on the utensil positioned onto the apparatus and above the burner to thereby prevent loss of the heat. A flat top plate of the stove conceals the apparatus, which causes the stove to have a flat top surface, so that the visual effect of the flat top surface of the stove is in harmony with that of the horizontal surface of a counter top where the stove is installed to thereby additionally ornament the kitchen.

36 Claims, 14 Drawing Sheets

GAS STOVE HAVING IMPROVED BURNERS INCORPORATED WITH REMOVABLE FLAME HEAT TRANSFER REGULATING APPARATUS CONCEALED BY TOP PLATES OF THE STOVE

CROSS-REFERENCE TO RELATED APPLICATIONS

This application is a continuation-in-part of U.S. patent application Ser. No. 12/313,940 filed on Nov. 26, 2008, now abandoned which is a continuation-in-part of U.S. patent application Ser. No. 11/811,521 filed on Jun. 11, 2007 now U.S. Pat. No. 7,708,006.

BACKGROUND OF THE INVENTION

1. Field of the Invention

The present invention is generally related to cooking appliances, and more particularly to an improved stove of ornament and gas saving in cooking.

2. Description of the Prior Art

In general gas stoves are well known. The following 13 United States patents and published patent applications are the closest prior art references which are related to the present invention.

U.S. Pat. No. 1,156,087 issued to Kupfer on Oct. 12, 1915 for "Flame Shield For Gas Stove" discloses a cylindrical metal tube which is used as a flame shield for a burner of a gas stove. The flame shield is positioned between the stove grids on the cooktop and a platform placed under the cooktop, wherein an upper end of the shield reaches into the plane of the undersurface of the grids, a lower end of the shield rests upon the platform, and the body of the shield surrounds the burner.

U.S. Pat. No. 2,166,442 issued to Kahn on Jul. 18, 1939 for "Cooking Stove" discloses a mechanical structure which is connected to the top of a gas burner having a plurality of gas ports and the cooktop of a stove, wherein an annular curved shield surrounds the burner adjacent the gas ports and extends upwardly and outwardly to the inside edge of the recessed shoulder of the cooktop for directing the heat from the burner toward the grate opening.

U.S. Pat. No. 3,187,742 issued to Power on Jun. 8, 1965 for "Combination Gas Burner Grid And Flame Shield" discloses an improved gas burner grid comprising a substantially rigid and arcuate shield, which is a horizontal plated structure used to eliminate any undesirable overheating of a pan handle.

U.S. Pat. No. 6,851,419 issued to Reiner on Feb. 8, 2005 for "Portable Hiking Stove" discloses an improved portable hiking stove.

U.S. Patent Publication No.: 2005/0115556 issued to Carson et al. on Jun. 2, 2005 for "Turkey Fryer/Outdoor Cooker Wind and Fire Guard" discloses a windscreen device for outdoor grill. The device can be assembled from a horizontal bottom plate and a series of vertical side plates to be a cuboid enclosure or windscreen.

United States Patent Publication No.: 2004/0045542 issued to Zhou et al. on Mar. 11, 2004 is for an "Outdoor Cook Stove". The Publication discloses a portable outdoor stove including a burner and a wind guard having an opened bottom end of cylinder shape capable of tightly coupled with a cooking vessel, wherein the burner is placed at the center of the opened bottom of the wind guard.

United States Patent Publication No.: 2005/0109330 issued to Pestrue et al. on May 26, 2005 for "Cooking Stove Including Invertible Support Rack, Support Rack With Dual Cooking Surfaces And Method Of Using Same" discloses a stove for outdoor use. The stove includes a hollow shell, supporting structure, and a burner assembly, operatively attached to the side of the shell, and a vessel support rack for placement on the shell.

U.S. Pat. No. 4,850,335 issued to Farnsworth et al. on Jul. 25, 1989 for "Vented Gas Range Top Burner" discloses a top burner for a gas cooking range, which includes a burner vent having a radially upwardly sloping wall to surround the burner head. An annular ring projects upwardly from an inner radial extremity of the wall to direct combustion products from the burner head into immediate scrubbing contact with the bottom of a cooking utensil.

U.S. Pat. No. 6,851,420 issued to Jennings (the Jennings patent) on Feb. 8, 2005 for "Burner With Piloting Ports" discloses an improved burner having ports that are aligned in a defined alignment with respect to an adjacent structure of the a burner body with a piloting zone so that adjacent structure guides the formation of a flame kernel at an outlet of the port.

U.S. Pat. No. 6,093,018 issued to Avshalumov on Jul. 25, 2000 for "Gas Burner" discloses an improved gas burner. The burner comprises in combination means for controlled feeding and subsequent admixing of a secondary air directly to the base of flame in a form of a cap coaxially surrounding a burner head of the gas burner having lateral apertures for issuing combustible air-gas mixture to form a flame.

In addition, gas burners that incorporate two and three flame rings having the laterally oriented gas ports are known in the field of the art. For example, U.S. Pat. No. 6,132,205 issued to Harneit (the Harneit Patent) on Oct. 17, 2000 for "Multi-Ring Sealed Gas Burner" discloses a multi-ring burner assembly that utilizes at least two flame rings to gently and evenly warm food and a third outer flame ring in conjunction with the first two flame rings for cooking food.

The modern gas stoves for the household usage can be classified to a sealed burner mounting and an opened burner mounting (see commercial stoves elsewhere), regarding the mechanical structure for affixing gas burners to the cooktops of the stoves. The former one is also illustrated from U.S. Pat. No. 5,323,759 issued to Hammel et al. on Jun. 28, 1994 for "Sealed Burner Mounting Assembly" (the Hammel patent) and U.S. Pat. No. 6,505,621 issued to Gabelmann on Jan. 14, 2003 for "Sealed Gas Burner Assembly" (the Gabelmann patent).

From the above illustration of the existing technologies on structural components of the cooking stoves, it has been discovered that there is absence of an apparatus in use of regulating transfer of the flame heat from a burner of the gas stove to a utensil in cooking. The apparatus is removably placed on the stove cooktop to surround an upper section of the gas burner and support the utensil. Therefore, heat radiation and convection generated by flame of the gas burner can be well regulated. This means the apparatus focuses heat on the utensil to thereby prevent loss of the heat and increase efficiency of heating the utensil in cooking. For this purpose, U.S. patent application Ser. No. 11/811,521 (the '521 Application) has disclosed such removable flame heat transfer regulating apparatus. The '521 Application further experimentally demonstrates that with the aid of the invented apparatus, it can significantly increase the flame heating efficiency in cooking, when the apparatus is incorporated with an existing stove burner having the laterally oriented gas ports.

However, it would be appreciated that, application of the invented apparatus is only a passive solution in terms of increasing the heating efficiency. This means, what the apparatus can contribute is only to regulate the heat transfer from the flame that is already controlled by structures of the existing burners having the laterally orientated gas ports.

Referring to the Jennings and Harneit Patents, the existing gas burners in the western market provide the laterally oriented gas ports that are generally in the shape of a circular opening or rectangular aperture. They are radially and circumferentially spaced apart on a flame ring, which results in a phenomenon that a mixture of the primary air and combustible gases under the supplied pressure is rushed to flow transversely out of the gas ports. In this situation, the flame kernels generated at the respective outlets of the gas ports also burn in the respective transverse directions. Obviously, this phenomenon is most apparent when the gas ports are provided by the mixture of air and combustible gases at the maximum flow rate (or pressure).

Referring further to FIGS. 2 and 2a of the Jennings patent, there is illustrated that the top flame burns in an ascending direction, when the top flame is in distance to an outlet of a gas port. In this situation, the transverse flow of the mixture of the primary air and combustible gases is sharply weakened due to a quick dissipation of its supplied pressure when the combustible mixture flows out of the outlet of the gas port.

As compared with the naturally upward pattern when a flame burns, the flame pattern governed by the existing gas ports is altered if there is a cooking utensil positioned above the flame, which has been discussed in the '521 Application. In that situation, the flame elongates in the respective transverse directions under the utensil bottom surface. This is because the bottom surface of the utensil blocks the upward pathway of the top flame, which forces the flame positioned under the utensil to transversely extend more before it ends.

In the situation when the maximum flow rate (or pressure) of the combustible mixture is supplied, such flame transverse elongation also reaches the maximum extend. This will cause two major disadvantages even after applying the invented apparatus, which negatively affect the heating efficiency in cooking when applying the most popularly and probably usable cooking utensils which have sizes ranging from 15 cm to 20 cm in diameters.

First, a portion of the heat of the top flame, which is represented by the radiated heat and convected heat, will be escaped through a gap between the bottom of the utensil and top of the apparatus before the heat could reach the utensil. This results in loss of the thermal energies. Such energy loss is absolutely happened since the apparatus having fixed diametrical sizes practically cannot accommodate every specific situations in cooking, including the maximum flow rate of the combustible mixture. In fact, the sizes of the apparatus including a diameter of the top circumference of an inner shell are designed from considering overall effect in application of the apparatus, which includes convenience of usage, ability to fit the respective most popularly and probably usable cooking utensils, and save the thermal energies.

Second, majority of the top flame is moved outwardly to come into contact with areas of the bottom surface of the utensil, wherein the contacted areas are more towards the outer circumference of the utensil bottom surface. This causes a large area of a "cold spot" on the utensil bottom surface. In addition, the flame elongation will further enhance a chilling effect of the flame, if the bottom surface of the utensil is positioned higher than a position that the top flame can reach. The chilling effect is also negative to the object of achieving a high heating efficiency in cooking since the top flame that has the highest temperature cannot directly come into contact with the utensil bottom surface.

Following the above disclosed first reason of losing the thermal energies, it would be appreciated that besides the factor of the transversely oriented gas ports, an additional factor of extra large sizes of the (outer) flame rings is also a cause of losing the thermal energies in cooking even the gas ports of the respective flame rings are oriented upwardly. In the above conclusion, the extra large sizes of the flame rings are defined as that they are not proportional to the diametrical sizes of the respective heat transfer regulating apparatus and the most popularly and probably usable cooking utensils. For example, most burners of the gas stoves in the Asian market including the Chinese market have a dual flame-ring configuration including smaller central and larger outer flame rings. However, the outer rings are usually very large, which the maximum diameters could be 12.5 cm. In that situation, losing the thermal energies absolutely happens in cooking.

Therefore, regarding the above identified two problems, U.S. patent application Ser. No. 12/313,940 (the '940 Application) has disclosed flame (outer) rings having improved gas ports and optimum diametric sizes, which are incorporated with the heat transfer regulating apparatus to best fit the most popularly and probably usable utensils. The improved gas ports have structure for directing the combustible gas-air mixture to flow at an ascending angle relative to a transverse plane where the flame ring is positioned, and securing stabilities of the flame kernels generated at outlets of the respective improved gas ports for prevent lifting or backlash of the kernels.

Obviously changing structures of the gas ports including their orientations and defining the optimum diametrical sizes of the flame rings are the active solutions in terms of increasing the heating efficiency as compared with the passive solution from implementing the heat transfer regulating apparatus disclosed by the '521 Application. Therefore, the '940 Application has brought a better solution for increasing the heating efficiency of the flame in cooking.

Further, the '940 application has additionally disclosed alternative materials of ceramics to be used in manufacturing the apparatus, since the ceramic materials have large heat capacities, which is an additional positive factor to increase the heating efficiency in cooking.

However, the '940 Application does not disclose major structure of an entire stove, including structure related to two subjects. The first one is regarding a preferred embodiment of a lower part of the burner that could additionally contribute to save gases in cooking. The second one is regarding the stove having flat top plates which could conceal the upward apparatus thereby causing the stove to have a flat top surface. Therefore, the stove having the flat top surface can be fitted into a modernized kitchen that requires appliances of ornament and excellent performance. This means a stove is expected to have a few marketable values if its upwardly positioned apparatus is not concealed, since the visual effect of the upwardly positioned apparatus is out of harmony with that of the horizontal surface of the counter top where the stove is installed to thereby not ornament the kitchen.

It would be appreciated that these two subjects are equally important for a marketable stove installed in a kitchen which is the principal place of a house where happens a majority of daily activities of a family.

Gas stoves are popularly used in human society. Usage of the gas stoves consumes tremendous amount of the combustible gases, and also generates significant amount of carbon dioxide gases which are of total greenhouse gases generated by the human society. Therefore, there is a significant need of the present invention to provide a stove, which not only saves combustible gases in cooking but also is ornament, so that the present invention stove could make people enjoy more the modern style of living from reducing the combustible gas consumption to lower the living costs and protect environment, and from improving ornamentation to a modernized kitchen.

SUMMARY OF THE INVENTION

The object of the present invention is to provide a stove of saving the combustible gases and ornamenting a kitchen. The stove includes a multiple burner configuration composed of improved removable burners. Each removable burner has a plurality of gas ports for generating an angularly patterned flame directly in contact with the bottom surface of a cooking utensil, combustible gas dispersing means and gas-primary air mixing means for producing a homogeneous mixture of the combustible gases and air to achieve efficient combustion. The gas ports are located to each burner's upper section which is surrounded by a removable heat transfer regulating apparatus, wherein the apparatus focuses heat on the utensil positioned onto the apparatus and above the burner to thereby prevent loss of the heat. A flat top plate of the stove conceals the apparatus, which causes the stove to have a flat top surface, so that the visual effect of the flat top surface of the stove is in harmony with that of the horizontal surface of a counter top where the stove is installed to thereby additionally ornament the kitchen.

The apparatus has two embodiments. The first embodiment includes inner hollow shell, outer wall and at least three identical utensil supports. The inner hollow shell is a closed ascending wall having a larger top periphery or edge that surrounds a larger top opening and a smaller bottom periphery or edge which surrounds a smaller bottom opening. A plurality of air passages of openings penetrate through upper and lower parts of the shell, wherein the air passages are more densely located to the lower part of the shell, as compared with the air passages which are less densely located to the upper part of the shell. In a preferred embodiment, the shell is in the shape of a circularly concave including parabolic wall. The outer wall is a closed upward wall positioned to surround the inner hollow shell. A plurality of openings serving as air passages evenly penetrate therethrough, wherein areas of the openings of the outer wall are larger than areas of the openings of the inner hollow shell. The identical upward utensil supports are detachably and circumferentially spaced apart to attach to an exterior side of the outer wall. Each support includes a upward post at its top end connected to a transverse upward plate which at its top is connected to a descending transverse plate, thereby forming a flat top of the support. Alternatively, the three supports are integrated together when they circumferentially spaced apart to affix to upper and lower transverse rings.

The second embodiment of the apparatus includes a hollow shell identical to the inner hollow shell of the first embodiment, which is detachably attached to the three integrated identical upward utensil supports.

The stove has a housing in several embodiments. One embodiment includes upper and lower sections. Using a stove having a dual burner configuration as an example, the upper section has two flat top plates including the respective central large openings, a complementary wall, and an integrated sheet structure in the shape of a top opened cuboid. The integrated sheet structure includes a bottom burner receiving plate that is punched to have two identical sets of round structures. Each of the round structures has a central burner receiving protrusion for positioning the burner thereinto. The protrusion is surrounded by an inner circular upward recess of air space for collecting liquid drop-off in cooking. The recess is surrounded by a middle ring protrusion that is additionally surrounded by an outer circular upward recess of air space for supporting the respective outer wall and/or utensil supports.

The present invention discloses three embodiments of the removable burner in the configuration of a dual flame ring having smaller inner and larger outer flame rings. The outer and inner flame rings of the respective three embodiments include the respective different detachable top covers and bottom structural members when classifying structure of the burner regarding detachability of its structural components, or the respective different upper sections and lower sections regarding positions of its respective structural components relative to the position of the central burner receiving protrusion. However, they are different from each other only in their different gas ports, places where the gas ports are located, and their different mating structures when the respective flame rings are assembled.

The top ring cover of the outer flame ring from the first embodiment is composed of a central opening surrounded by exterior and interior circular cylindrical walls which at the respective tops are connected to a top transverse ring to thereby form a top circular sideward protrusion having an exterior ascending ring surface and a downward interior circular recess of air space. A plurality of identical downward narrow slots of air space are circumferentially and radially spaced apart to cut off a bottom ring surface of the exterior cylindrical wall. Each identical slot is an outwardly expanding section, which includes two identical downward sides having the shape of a right angled trapezoid, a transverse downward opening positioned to align with the bottom ring surface, smaller inward and larger outward openings positioned on the respective interior and exterior surfaces of the exterior wall to form an ascending interior top surface towards upward and outward. The interior top surface is aligned with and connected to the exterior ascending ring surface of the circular sideward protrusion. The interior cylindrical wall at its bottom surface is connected to a bottom downward circular protrusion.

The bottom structural member of the outer flame ring of the first embodiment includes a middle circular gas mixture receiver (middle receiver) connected to the respective left and right side bottom gas intakes. The middle receiver is comprised of a central opening surrounded by exterior and interior cylindrical walls which at their respective bottoms are connected to a bottom transverse ring to thereby form an upward interior circular recess of air space and a bottom transverse ring surface. An inner circular shelf is positioned to a top of the interior cylindrical wall, which matches the downward circular protrusion of the cover to thereby lock the cover when the cover and receiver are connected together, so that the protrusion and shelf are broadly defined as interlocking means, and the connected top ring cover and middle receiver are defined as the upper section of the outer flame ring.

In this setting, the slots of the top ring cover are turned into the respective identical improved gas ports having the respective ascending interior top surfaces, wherein the inward and outward openings are the respective smaller inlets and larger outlets, and downward transverse openings are turned into the respective interior transverse bottom surfaces. The downward and upward interior circular recesses of the respective top ring cover and middle receiver are combined together to form a circular chamber for passing a mixture of the combustible gases and primary air from the respective left and right side bottom gas intakes to the inlets of the respective improved gas ports.

Two identical left and right side bottom gas intakes and two identical bottom supports are radially, circumferentially and alternatively spaced apart to upwardly connect to the transverse bottom ring surface of the middle receiver, wherein a gas intake and an adjacent support is separated by a 90 degree. Each gas intake is a hollow cylindrical member having a generally "T" shaped longitudinal cross section, comprising an upper transverse ring having a central opening concentrically and downwardly connected to a lower longitudinal hollow cylinder, wherein the upper transverse ring has a larger diameter than a smaller diameter of the lower cylinder to thereby form a middle transverse ring surface. Penetrating through the lower longitudinal hollow cylinder, there is an upper cylindrical opening concentrically and downwardly connected to a lower frustum shaped opening, wherein the hollow cylinder is served as a combustible gas-primary air mixer that is broadly defined as gas-primary air mixing means. In this setting, the central opening of upper transverse ring is upwardly connected to the circular recess of the middle receiver and downwardly connected to the upper cylindrical opening of the lower hollow cylinder. Therefore, the combustible mixture of the primary air and gases from the bottom gas intakes can flow into the circular chamber.

Within the gas intake there is a concentrically positioned combustible gas disperser in the shape of a cone comprising a bottom tip connected to four identical ascending wings, which is broadly defined as gas dispersing means. The disperser is positioned which bottom tip is aligned with a rotational axis of the gas intake, and its top arcuate sides of the respective wings are in contact with an interior cylindrical surface of the hollow cylinder.

The top round cover of the inner flame ring of the first embodiment includes a top round plate connected to the top of a downward circular cylindrical wall, which forms a downward round recess of air space and a circular sideward protrusion having an exterior ascending ring surface. The circular wall at its bottom end is connected to a downward circular protrusion. A plurality of identical downward narrow slots of air space are circumferentially and radially spaced apart to cut off a bottom ring surface of the circular cylindrical wall, wherein each identical slot is similar to the slot of the top ring cover.

The bottom structural member of the inner flame ring of the first embodiment is comprised of a middle hollow cylinder concentrically connected to a central bottom gas intake. The middle hollow cylinder which matches the top round cover is comprised of a circular cylindrical wall and central opening. The circular wall at its top further includes a top inner circular shelf for positioning the downward circular protrusion of the top cover to thereby lock the top cover when the top cover and middle cylinder are connected together to form the inner flame ring, so that the protrusion and shelf are broadly defined as interlocking means, and the connected top round cover and middle hollow cylinder are defined as the upper section of the inner frame ring. In this setting, each slot of the top cover are turned into the improved gas port of the inner flame ring, which is similar to the improved gas port of the outer flame ring. The circular cylindrical wall at its bottom is concentrically and downwardly connected to the bottom central gas intake similar to the lower longitudinal hollow cylinder of the side bottom gas intake. Within the central gas intake there is a positioned gas disperser similar to the disperser positioned inside of the side bottom gas intake.

The middle hollow cylinder of the inner flame ring is concentrically affixed at the center of the central opening of the middle receiver of the outer flame ring through affixation of multiple or at least two identical connecting bars. This generates an air gap between the middle ring surfaces of the respective two side bottom gas intakes and bottom ring surface of the middle receiver, so that the environmental air serving as a secondary air can flow to the improved gas ports of the inner flame ring for involving in combustion.

The top ring cover of the outer flame ring from the second embodiment of the burner has the shape of an inverted frustum of a cone, composing a central opening surrounded by an interior cylindrical wall and an exterior cylindrical wall having an inverted frustum shaped exterior surface. A top transverse ring is connected to tops of the respective walls to form a downward interior circular recess of air space, and a circular sideward protrusion having an exterior ascending ring surface that is connected to and aligned with the exterior inverted frustum shaped surface of the exterior wall.

The bottom structural member of the outer flame ring of the second embodiment includes a middle circular gas mixture receiver connected to the respective left and right side bottom gas intakes. The middle receiver is comprised of exterior and interior cylindrical walls to surround a central opening. A transverse bottom ring is connected to bottoms of the respective walls, which forms an upward interior circular recess of air space and a bottom ring surface. The exterior cylindrical wall includes outer and inner circular cylindrical surfaces, and an inverted frustum shaped top surface which matches the inverted frustum shaped exterior surface of the top ring cover.

A plurality of identical upward narrow slots of air space are circumferentially and radially spaced apart to the exterior cylindrical wall, which cut off the inverted frustum shaped top surface. Each identical slot is an outwardly expanding section, including an inner transverse bottom surface, smaller inward and larger outward openings positioned on the respective interior and exterior surfaces, and an ascending opened top surface that is aligned with the top surface of the exterior wall, and two upward sides having the shape of a right angled trapezoid.

When the top ring cover is positioned to mate with the middle receiver, the inverted frustum shaped exterior and top surfaces of the respective cover and receiver are matched to thereby lock the top ring cover, so that the inverted frustum shaped exterior and top surfaces of the respective cover and receiver are broadly defined as interlocking means, and the top ring cover and middle receiver are defined as the upper section of the outer flame ring. In this setting, the plurality of the upward slots of air space are turned into the respective gas ports having the respective interior transverse bottom surfaces, wherein the inward and outward openings are the respective smaller inlets and larger outlets, and the ascending opened top surfaces are turned into the respective ascending interior top surfaces. In addition, the downward and upward circular recesses of the respective top ring cover and middle receiver are connected together to form a chamber for passing a mixture of the combustible gases and primary air from two side bottom gas intakes to the respective gas ports, wherein the two side bottom gas intakes are identical to those of the first embodiment of the outer flame ring including inside positioned gas dispersing means.

The top round cover of the inner flame ring from the second embodiment also has the shape of an inverted frustum of a cone, including a top round plate which is connected to the top of a downward circular cylindrical wall having an inverted frustum shaped exterior surface to form a downward round recess of air space and a sideward protrusion having an exterior circular ring surface that is connected to and aligned with the inverted frustum shaped exterior surface of the cylindrical wall.

The bottom structural member of the inner flame ring of the second embodiment is comprised of a middle hollow cylinder concentrically and downwardly connected to a central bottom gas intake. The middle hollow cylinder has a central opening and circular cylindrical wall including an inverted frustum shaped top surface. A plurality of identical upward narrow slots of air space are circumferentially and radially spaced apart on the cylindrical wall to cut off the top surface, wherein each identical slot is similar to the slot of the outer flame ring.

When the top round cover is positioned to mate with the middle hollow cylinder, the inverted frustum shaped exterior and top surfaces of the respective cover and cylinder are matched to thereby lock the top round cover, so that they are broadly defined as interlocking means, and the mated top round cover and middle hollow cylinder are defined as the upper section of the inner flame ring. In this setting, the plurality of the upward slots of air space are turned into the respective gas ports having the respective inlets, outlets and ascending interior top surfaces, which are similar to the respective improved gas ports of the outer flame ring. In addition, the downward round recess of the cover are connected to the round opening of the middle hollow cylinder to form a chamber for passing a mixture of the combustible gases and primary air from the central bottom gas intake to the respective gas ports, wherein the bottom gas intake is identical to that of the first embodiment of the inner flame ring including inside positioned gas dispersing means.

The third embodiment of the burner is modified according to one of the first and second embodiments, wherein a plurality of improved gas ports of the respective upwardly expanding openings are upwardly, circumferentially and radially spaced apart to penetrate through tops of the respective top ring cover of the outer flame ring and top round cover of the inner flame ring. There are two embodiments of the improved gas ports. Each identical gas port of the first embodiment is a narrow slot with its longitudinal cross section having the shape of an isosceles trapezoid. The slot has a first ascending interior side towards outside and a second ascending interior side towards inside, a longer transverse top opening serving as an outlet, and a shorter transverse bottom opening serving as an inlet connected to the downward round recess of the inner flame ring or downward circular recess of the outer flame ring. Each identical gas port of the second embodiment is an opening in the shape of an inverted frustum of a cone, including an inverted frustum shaped interior surface, a larger top opening serving as an outlet, a smaller bottom opening serving as an inlet connected to the downward round recess of the inner flame ring or downward circular recess of the outer flame ring.

Each identical improved gas port of opening from three embodiments of the burner has a second embodiment, which is a combination that the expanding section of opening having the smaller inlet and larger outlet of the first embodiment of the gas port at its inlet is combined with a cuboid section of opening having additional inward opening serving as an inlet of the gas port of the second embodiment for admitting the combustible gaseous mixture.

The top ring covers and top round covers of the respective three embodiments also include the respective circular downward recesses of air space, which are positioned at joints of the respective exterior ascending ring surfaces of the circular sideward protrusions connected to the exterior circular cylindrical wall of the top ring cover and cylindrical wall of the top round cover.

The present invention removable burner has a second embodiment of a single flame ring, which is identical to each of the above disclosed three embodiments of the inner flame ring.

The inner hollow shell which is detachably affixed to the outer wall is positioned to surround the upper section of the burner, wherein its bottom periphery is positioned above and aligned with a central circle of the inner recess of a first set of the round structures of the sheet structure for collecting the liquid drop-off in cooking. The outer wall which is attached by the utensil supports is positioned to surround the inner hollow shell, wherein their bottoms are positioned into the outer recess of the round structures. In this configuration, one top plate conceals the inner hollow shell and outer wall when their top peripheries are positioned in the central opening of the plate, which causes the stove to have a flat top surface. The upward transverse plate of each of the utensil supports is served as a flame heat shield to prevent heating a handle of the utensil in cooking.

Application of the flame heat transfer regulating apparatus increases heating efficiency of the flame. Specifically the inner hollow shell focuses heat on the utensil in cooking and outer wall serves as a thermal wall, so that the apparatus reduces loss of the heat.

The improved gas ports having the respective ascending interior top surfaces of the same ascending angle cause the flame to burn along directions of the respective top surfaces, so that top of the flame having the highest temperature comes directly into contact with the bottom surface of a cooking utensil to thereby achieve a high efficiency of heating the utensil when applying the combustible gases at a large to maximum flow rate. In this situation, the present invention stove causes the heat conduction as the major form of the heat transfer in cooking. This compares with the heat radiation and convection of the prior art stove which are less efficient for the heat transfer due to various reasons including one that utensils made of metals are poor receptors for absorbing the radiated heat.

The improved gas ports also reduce speed of the combustible gaseous mixture when flowing out of the gas ports, which equivalently causes much surrounding air serving as a secondary air to involve in combustion of the mixture. This promotes to achieve completion of combusting the mixture to thereby achieve a high temperature of the flame and thermal media including exhaust gases and air. In addition, the hot thermal media having the same reduced speed increases a time of contacting with thus heating the utensil in cooking.

The gas dispersing means and gas-air mixing means promote to achieve a homogeneous mixture of the combustible gases and primary air, which is fundamental for achieving completion of combusting the combustible gaseous mixture.

The present invention also defines an optimum 19 cm diameter of the top periphery of the (inner) hollow shell and a maximum 8 cm diameter of a circle that is aligned with outlets of the respective burner ports of a flame (outer) ring, wherein the diameters are correlated to an optimum distance ranging from 2.5 cm to 3 cm between a top position of an outlet and bottom surface of a cooking utensil with an optimum diametrical size ranging from 15 cm to 20 cm.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Disclosure of the present invention includes three sections. The first section is consistent with the '521 Application, which is related to an invented removable apparatus for regulating transfer of the flame heat generated by a gas burner having the laterally oriented gas ports. The second section is consistent with the '940 Application, which is related to a burner having improved gas ports and an (outer) flame ring in an appropriate diametrical size incorporated with the invented apparatus. The third section is related to the present invention stove having burners in a dural frame ring configuration. The burner that includes the improved gas ports, combustible gas dispersing means and gas-air mixing means is incorporated with the invented apparatus. The stove additionally has flat top plates, which conceal the respective upwardly positioned components of an apparatus thereby causing the stove to have a flat top surface. Therefore, the present invention stove not only can save the combustible gases in cooking but also have the flat top surface whose visual effect is in harmony with that of the horizontal surface of a counter top to thereby ornament a kitchen.

(I) The Removable Flame Heat Transfer Regulating Apparatus

Figure 1:
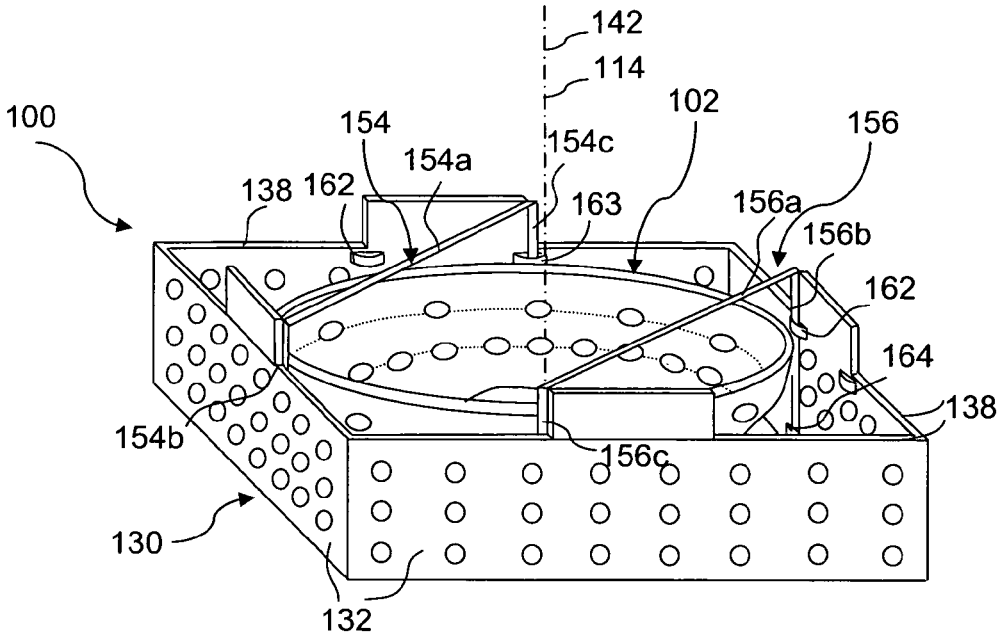
FIG. 1 is a perspective view of a first embodiment of a removable flame heat transfer regulating apparatus from the present invention.
Figure 2:
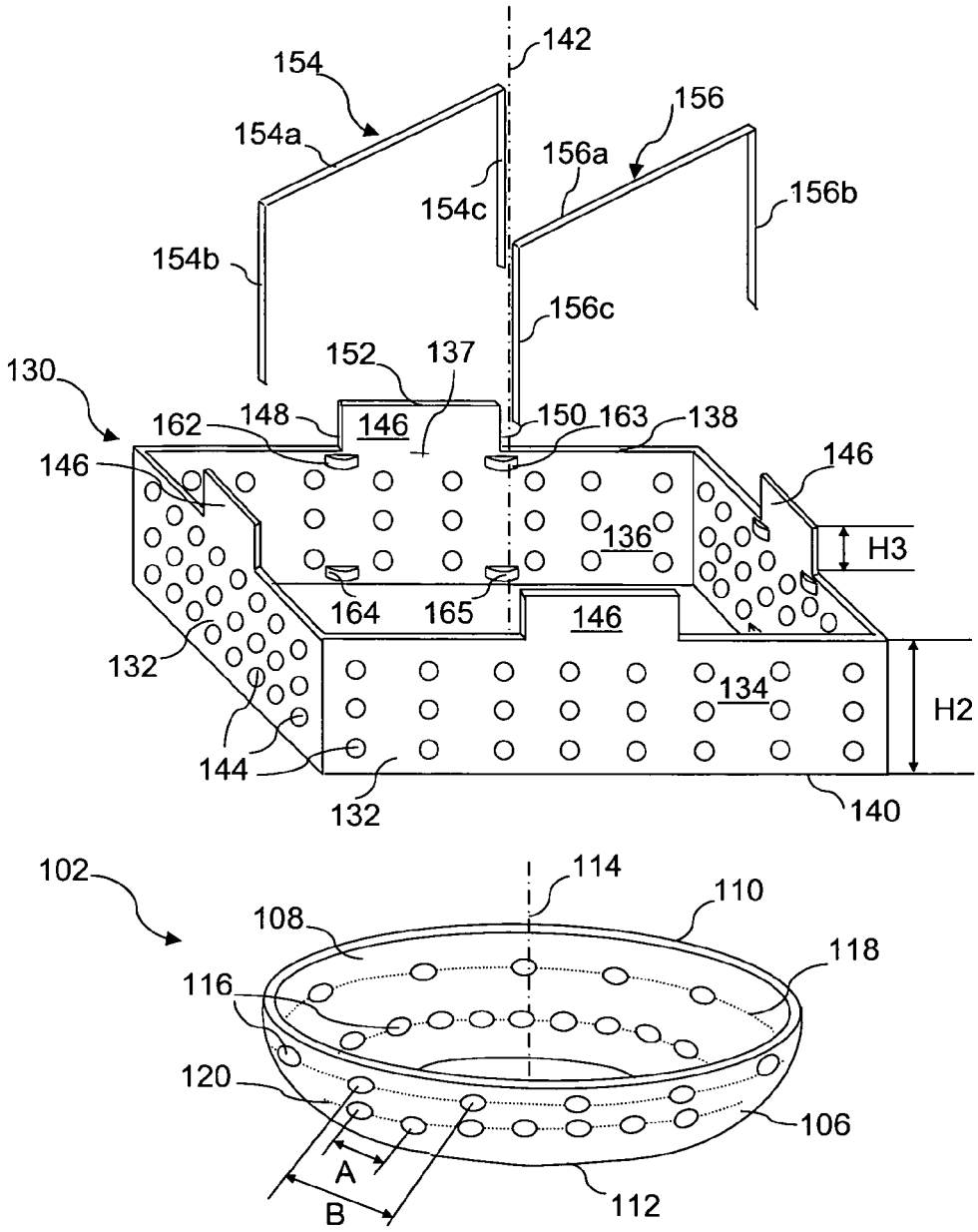
FIG. 2 is a perspective exploded view according to the apparatus shown in FIG. 1.

Referring to FIG. 1 of U.S. Pat. No. 5,323,759 to Hammel et al. for "Sealed Burner Mounting Assembly", there is illustrated main cooktop of a gas stove having a sealed burner mounting assembly and two individual grates which are positioned to cove the respective two of four burners on the cooktop. Referring to FIG. 2 of U.S. Pat. No. 6,505,621 to Gabelmann for "Sealed Gas Burner Assembly", there is illustrated a top plain view of a cooktop having an extended grate, wherein an extended removable grate is provided on the cooktop to extend from the front to the back for supporting cook pans or the like utensils above a front gas burner and a back gas burner.

From illustration in FIGS. 1 and 2 of the prior art cooktops of the gas stoves, it has been discovered that there is absence of a flame heat transfer regulating apparatus. The apparatus can be removably positioned onto the stove cooktop to surround an upper section of a gas burner for increasing heating efficiency of the flame, supporting a cooking utensil, and preventing undesirable heating a handle of the utensil in cooking. It would be appreciated that heat transfer from the flame of the burner to the utensil relies on radiation and convection of the flame heat. Therefore with the aid of the flame heat transfer regulating apparatus of the present invention, the radiation and convection of the flame heat can be well regulated to efficiently heat the utensil. Therefore, the present invention can reach the object to significantly increase heating efficiency of the flame in cooking.

Figure 3:
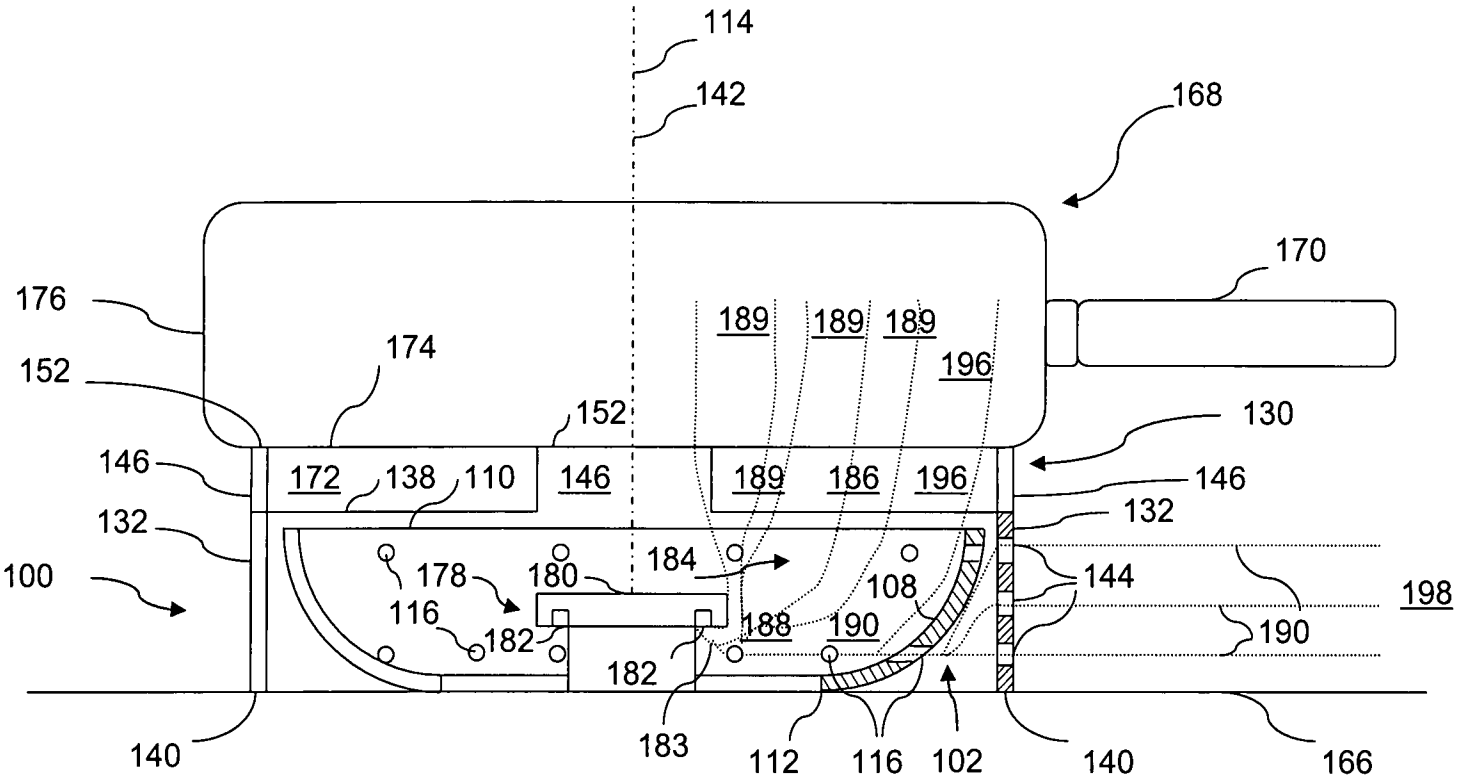
FIG. 3 is a schematic cross sectional view of a burner region of a stove cooktop including a cross section of a right half of the first embodiment of the apparatus that surrounds an upper section of a burner. For a better presentation, FIG. 5 only shows a right side of the flame, air flow and exhaust gas flow, which are represented by evenly spaced dotted lines.

Referring to FIGS. 1, 2 and 3, there is illustrated removable flame heat transfer regulating apparatus from a first embodiment 100 of the present invention. The apparatus 100 is comprised of an inner circularly arcuate hollow shell 102 and an outer square wall 130, which are both placed onto a stove cooktop 166. The inner hollow shell 102 is positioned to surround an upper section 178 of a gas burner. The outer square wall 130 is positioned to surround the inner hollow shell 102 and support a cooking utensil 168 having a bottom surface 174, wherein the utensil 168 is placed above the burner.

As illustrated in FIG. 2, the inner hollow shell 102 is a circularly ascending arcuate wall, comprising an outer surface 106, an inner surface 108, a top circumference or edge 110 which surrounds a top opening and a bottom circumference or edge 112 which surrounds a bottom opening. The inner hollow shell 102 from its bottom circumference 112 extends upwardly and outwardly to end the top circumference 110. Therefore, the top circumference 110 is larger than the bottom circumference 112, wherein both circumferences are relative to a rotational axis 114 of the inner hollow shell 102. As additionally illustrated, the inner hollow shell 102 is configured to be concave when viewed it along a direction from the rotational axis 114 to the inner surface 108. In a preferred embodiment the inner hollow shell 102 is circularly parabolic in shape.

The concave including the parabolic shape of the inner hollow shell 102 is designed from the spirit and scope of the present invention for regulating the flame heat radiation, and the flame heat convection including the air convection.

The concave including the parabolic shaped inner hollow shell 102 can reflect the outward and downward radiated heat, which is initially radiated by the flame away from the flame thus the utensil, back to heat the utensil bottom surface 174. In above illustration, the outward and downward directions of the heat radiation from the flame are defined relative to the horizontal orientation of the bottom surface 174 of the utensil 168 which is positioned above the burner. It would be appreciated that the heat radiation from the flame is towards every angular directions in the three-dimensional space. Therefore, the flame which is positioned under the bottom of the utensil has a portion of the radiated heat, which is outward and downward away from the flame thus the utensil. This means that the portion of the radiated heat is not used to heat the utensil. In the presence of the present invention inner circularly arcuate hollow shell 102, the heat radiated outwardly and downwardly from the flame can be regulated to be reflected back for heating the bottom surface of the utensil 168. This is one of reasons for the present invention to achieve a higher heating efficiency in cooking, as compared with a lower heating efficiency of the prior art gas stoves without having the inner hollow shells.

The inner hollow shell 102 is further illustrated in FIG. 2 to comprise a plurality of air passages 116 of openings therethrough, wherein the air passages 116 are divided into first and second groups. The air passages 116 in the first group are circumferentially spaced apart; to align with an upper circumference 118 adjacent to the top circumference 110. The air passages 116 in the second group are also circumferentially spaced apart to align with a lower circumference 120 adjacent to the bottom circumference 112. However, the air passages 116 are not evenly located to the two groups.

Such uneven location of the air passages is illustrated in FIG. 2 from a distance "A" between two adjacent air passages 116 aligning with the lower circumference 120 and a distance "B" between two adjacent air passages 116 aligning with the upper circumference 118, wherein the distance "A" is shorter than the distance "B". Therefore, the air passages 116 are greater in quantity and are more densely located to a lower part of the inner hollow shell 102 having the bottom circumference 112, as compared with the air passages 116 which are fewer in quantity and are less densely located to an upper part of the inner hollow shell 102 having the top circumference 108.

It would be appreciated that from the above illustrated embodiment serving as an example, the present invention discloses a general structure of the unevenly located air passages of the inner hollow shell 102. Such structure is particularly for regulating the heat convection of the flame in cooking, wherein the heat convection is based on the air convection which is taken place in space including the surrounding areas of the flame and areas occupied by the flame.

The air with a lower temperature has a heavier density to thereby occupy a lower part of the space adjacent the flame. In contrast, the air with a higher temperature which has a lighter density occupies an upper part of the space including the areas where the flame is located. Such density difference causes a natural air convection pattern of the flame. A colder air having the lower temperature, which is initially positioned in the surrounding areas of the flame, flows to the flame for involving in combustion through a path which occupies a lower part of the space. A hotter air having the higher temperature which is positioned in the upper part of the space flows upwardly away from the flame. Therefore, the densely located air passages 116 on the lower part of the inner hollow shell 102 will provide a less flow resistance for the air with the lower temperature to flow towards the upper section 178 of the burner, wherein the air having oxygen which is served as a secondary air is necessary for combustion of the mixture of the combustible gases and primary air to form the flame.

Referring again to FIG. 2, there is illustrated outer square wall 130 comprising four identical upward plates 132. Each plate has a height "H2" of a top edge 138, an exterior side 134 and an interior side 136. The upward plates 132 are connected to one another to form the outer square wall 130 having a top square transverse edge 138, a bottom square transverse edge 140, and a central symmetric axis 142. As further illustrated, a plurality of air passages 144 of openings are evenly to penetrate through each plate 132. It would be appreciated that from the spirit and scope of the present invention that include to regulate the air convection, a number of the air passages 144 of the outer square wall are more than a number of the air passages 116 of the inner hollow shell. The result is that a combined area of the openings on the outer square wall 130 is larger than a combined area of the openings on the inner hollow shell 102.

As illustrated, each upward plate 132 at the middle position of the top transverse edge 138 is comprised of an extension 146 projecting upwardly. The upward extension 146 is comprised of a transverse top end 152, first and second upward sides 148 and 150 having the identical heights "H3". As illustrated, the height "H3" of each of the upward sides 148 and 150 is shorter than the height "H2" of each of the upward plates 132. In addition, the length of the top end 152 is generally longer than that of each of the upward sides 148 and 150, so that the extension 146 can be served as a heat shield. In another embodiment, instead of all the upward extensions having the respective long top ends, only one extension 146 has the long top end to serve as the heat shield.

It would be appreciated that the upward extension 146 serving as the heat shield can block an outward heat flow of the flame which is towards the extension 146. The outward heat flow could turn into an upward heat flow if there is absence of the extension 146, so that the upward heat flow can heat an object, which is positioned above the flame and is further vertically aligned with the upward heat flow. Therefore as illustrated in FIG. 3, the upward extension 146 can prevent undesirable heating a handle 170 of the utensil 168 in cooking, where the utensil is positioned on the top ends 152 of the extensions of the outer square wall, and the handle 170 is positioned to upwardly align with the center of the extension top end. In addition, it would be appreciated that, the extensions 146 from the present invention are designed to support the utensil 168 having the flat bottom surface 174 such as a pan, or having a convex shaped bottom side such as a wok.

Referring further to FIG. 2, there is illustration that a first group of upper and lower hooks 162 and 164 or attachment means are positioned onto the interior side 136 of each identical plate 132 of the outer square wall, wherein two hooks 162 and 164 are aligned with the first upward side 148 of the identical extension. In addition, the upper hook 162 is positioned adjacent to the top transverse edge 138 and the lower hook 164 is positioned adjacent to the bottom transverse edge 140 of the outer square wall 130. Similarly, a second group of upper and lower hooks 163 and 165 or attachment means are positioned on the interior side 136 of each identical plate, which are aligned with the second upward side 150 of the extension. Further, the upper and lower hooks 163 and 165 are positioned adjacent to the respective top and bottom edges 138 and 140 of the outer square wall.

The hooks are designed to affix first and second identical optional utensil supports 154 and 156 onto the outer square wall 130, so that a small utensil can be placed on the optional supports. As illustrated, the first optional utensil support 154 is in the shape of a generally inverted "U", comprising a top transverse section 154*a*, and identical first and second downward sections 154*b* and 154*c*. The optional utensil supports can be made with flat metal strips or round metal rods.

Referring to FIGS. 1 and 2 regarding usage of the support 154, the first downward section 154*b* is inserted into the first group of the upper and lower hooks 162 and 164 of the first identical plate, and the second downward section 154*c* is inserted into the second group of the upper and lower hooks 163 and 165 of the second identical plate, wherein the top transverse section 154*a* is positioned to align with the top ends 152 of the respective extensions. As illustrated, the second identical plate 132 is adjacent the first identical plate 132 in the clockwise direction relative to the symmetric axis 142, and the first and second identical plates 132 are connected at a 90-degree angle. In this setting, the top transverse section 154*a* of the first optional utensil support 154 and projections of the respective top edges 138 of the first and second identical plates 132 adjacent each other form an isosceles right angled triangle, wherein the top transverse section 154*a* is the hypotenuse side.

Similarly, the second optional utensil support 156 can be affixed. The result is that the top transverse section 154*a* of the first optional support and the top transverse section 156*a* of the second optional utensil support are in parallel and have a short distance in between. As illustrated in FIG. 3, the distance is shorter, as compared with a longer distance between two oppositely positioned upward plates 132 of the outer square wall. Therefore, a small pan can be conveniently placed onto the two transverse top sections 154*a* and 156*a* of the respective first and second optional utensil supports It would be appreciated that in the presence of the first and second groups of the respective upper and lower hooks or attachment means on each upward plate, various embodiments of the optional supports are available, which are disclosed in FIGS. 4A and 4B of the '521 Application. However, for reducing the length of the specification of this patent application, they will not repeated.

It would be further appreciated that, although the above illustration discloses various embodiments of the optional utensil supports including the attachment means, the optional utensil supports including the attachment means are not limited in accordance with the spirit and scope of the present invention. In fact, any types of the optional utensil supports are appropriate if they are detachable, and are able to be affixed onto the outer square wall by the attachment means for supporting utensils. Therefore, they can be broadly defined as the optional utensil supporting means. In addition, the attachment means are able to be placed on both the interior and exterior sides of the wall. Furthermore, at least one attachment means is also appropriate for each identical upward plat according to the spirit and scope of the present invention.

Reference to FIG. 3 illustrates application of the first embodiment 100 of the removable flame heat transfer regulating apparatus. The inner circularly arcuate hollow shell 102 is first positioned onto the cooktop 166 of the stove to surround the upper section 178 of the gas burner. The outer square wall 130 is second positioned onto the cooktop 166 to surround the inner hollow shell, wherein the rotational axis 114 of the inner hollow shell 102 is aligned with the symmetric axis 142 of the outer square wall 130. They are further aligned with a center of a top cap 180 of the burner upper section 178, wherein a plurality of the laterally oriented gas ports 182 are circumferentially spaced apart on a side wall of the cap 180. The bottom surface 174 of the cooking utensil 168, which has a cylindrical outer side 176, is positioned onto the top end 152 of each extension of the outer square wall. In this setting, the top circumference 110 of the inner hollow shell is positioned higher than the top cap 180. The top square edge 138 of the outer square wall is positioned at least with the same height as the top circumference 110 of the inner circularly arcuate hollow shell.

In addition, a gap 172 is sufficiently wide between the top square edge 138 of the outer square wall and the bottom surface 174 of the utensil, which is provided by the extensions 146. The gap 172 permits that the hot exhaust gases from the flame and hot air flow freely, outwardly and upwardly along the utensil cylindrical outer side 176, which results in further heating the utensil. It would be appreciated that in the presence of the wide gap 172 it will not generate a back pressure for the hot gases. The back pressure could force the flame to burn out of the gap 172, so that the flame positioned outside of the outer square wall 130 cannot effectively heat the utensil 168. Therefore, the outer square wall 130 having sufficient heights of the respective upward extensions 146 is significant for increase of the heating efficiency in cooking.

It would be appreciated that from a theory of the flame, the top part of the flame has the highest temperature. The bottom part of the flame has the lowest temperature, where a kernel of the flame is positioned. Within the kernel of the flame, combustion of the combustible mixture starts to take place in the presence of oxygen from the air. It would be further appreciated that according to the mechanical structure of the existing burner which is illustrated elsewhere, the flame kernel is connected to the outlet of a gas port of the burner, where the pressured combustible mixture flows out. It would be additionally appreciated that from the air convection theory which is illustrated previously, the surrounding air having the lower temperature with the heavier density, which is served as the secondary air, flows through the path which occupies the lower part of the space to the bottom of the flame for involving in the combustion.

The first embodiment 100 of the removable flame heat transfer regulating apparatus is designed to exactly follow such well known flame theory to achieve a high heating efficiency in cooking through regulating transfer of the flame convected and radiated heat.

Referring to FIG. 3, there is illustrated air convection pattern which is regulated by the inner hollow shell 102. The air 190 having the lowest temperature serving as the secondary air flows from the surrounding areas 198 of the gas burner to a bottom part 188 of the flame 184 for involving in the gas combustion. The air 190 first passes through the air passages 144 of the outer square wall 130, and second mainly flows through the densely located air passages 116 adjacent to the bottom circumference 112 of the inner hollow shell 102.

A portion of the air 190, which is involved in combustion of the combustible mixture 183 from the gas ports 182, becomes part of the flame 184, wherein the combustion which generates exhaust gases 189 continuously takes place to a top 186 of the flame. As illustrated, the top 186 of the flame is under the bottom surface 174 of the utensil. The rest of the air 190 which is not involved in the combustion is then heated, and continuously flows up to be an air 196 having the same highest temperature as that of the top 186 of the flame. In this situation, the hottest air 196 and top 186 of the flame heat the bottom surface 174 of the utensil. In addition, the hottest air 196 and the exhaust gases 189 flow outwardly throughout the gap 172 and continuously flow upwardly along the cylindrical outer side 176 of the utensil away from the flame 184, which further heats the utensil 168 through heating its outer side. Therefore, a high heating efficiency in cooking can be achieved with such regulated heat convection, wherein the hottest air and exhaust gases flow mostly around the outer side 176 and bottom surface 174 of the utensil 168.

It would be appreciated that in above illustrated flame heat convection, the inner circularly arcuate hollow shell 102 contributes significantly to regulate patterns of the heat convection including the air convection. First, the densely located air passages on the lower part of the inner hollow shell 102 will provide a less flow resistance for the secondary air to the burner upper section 178, wherein the secondary air is necessary for combustion of the combustible gas-primary air mixture to form the flame. Second, the hot air and exhaust gases are surrounded by the inner hollow shell 102, so that they are forced to flow upwardly to heat the bottom surface 174 of the utensil 168. Then they continuously flow outwardly through the gap 172 to heat the outer side 176 of the utensil.

Such regulation of the heat convection is extremely important for achieving the high heating efficiency in cooking from using the gas stove where there is a very limited height in space between the top cap 180 and the bottom surface 174 of the utensil. In such setting, the pressured combustible gas-primary air mixture 183, which flows out of the gas ports 182, has a high speed and burns immediately with the oxygen in the secondary air, which generates the flame exhaust gases 189 having a high upward speed. However, the bottom surface 174 of the utensil 168 blocks the upward pathway for the hot gases including the exhaust gases 189 and air 196. In that situation, the natural heat convection pattern of the flame, which is illustrated previously, is disturbed so that a majority of the hot gases flow transversely and outwardly, in addition to a portion of the hot gases possibly downwardly flowing towards the cooktop 166 of the stove if there is absence of the inner hollow shell 102. This will result in a lower efficiency of heating the utensil 168, as contrasted with a higher heating efficiency of the present invention.

It would be further appreciated that besides the above illustrated heat convection which is regulated by the inner hollow shell 102, the sufficiently wide gap 172, which is provided by the outer square wall 130, also contributes significantly since the sufficiently wide gap 172 provides the pathway, which promotes to achieve the regulated flame heat and air convection.

In addition to regulate patterns of the heat conviction, the first embodiment 100 of the present invention is further able to regulate patterns of the heat radiation from the flame 184, which is illustrated previously, for contributing a high heating efficiency in cooking.

The heat radiation happens from an object having a higher temperature to surrounding areas having a lower temperature. Therefore, the outer surface 106 of the heated inner hollow shell 102 also radiates the heat outwardly. However, with the presence of the outer square wall 130, which is positioned to surround the inner hollow shell 102, the radiated heat from the outer surface 106 of the inner hollow shell 102 is blocked by the outer square wall 130. Therefore the outer square wall 130 is served as a thermal wall to preserve a high temperature in the region around the upper section 178 of the burner, wherein the region is under the utensil 168. Therefore, the outer square wall 103 additionally contributes to the high heating efficiency in cooking.

The above mechanistic illustration for the high heating efficiency in cooking can be proved by test results, which are illustrated in a section of EXAMPLE I of this Application.

As compared with the structural features of the first embodiment 100 disclosed above, various variations of the structural features are readily available. For example, a rolled bead or a rim can be added to the respective top and bottom circumferences 110 and 112 of the inner hollow shell to enhance its mechanical strength. In addition, the inner hollow shell 102 is not limited to be in round shape. In fact, any symmetrical shapes are appropriate for variations of the inner hollow shell 102, which include a shape having multiple sides, such as a tetragonal, pentagonal and hexagonal shape. For the same reason, variations of the outer square wall 130 can be in any symmetrical shapes. Accordingly the varied inner hollow shell and out wall have the respective top and bottom peripheries or edges.

Figure 5:
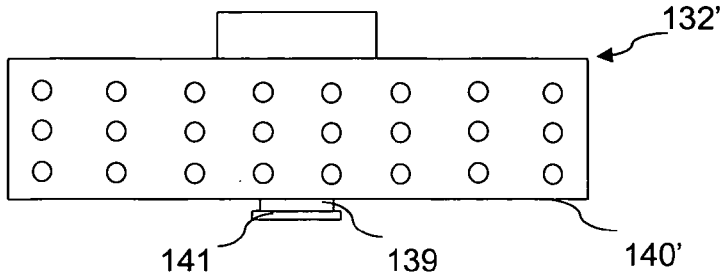
FIG. 5 is a front plain view to illustrate variations of an upward plate of an outer square wall of the apparatus shown in FIG. 1, wherein at least one downward post is positioned on a bottom side of the upward plate.

Referring to FIG. 5, there is illustrated upward plate 132' having structural variations, as compared with the structure of the upward plate 132 from the first preferred embodiment 100. At least one post 139 projecting downwardly is placed on the bottom edge 140' of each upward plate 132'. The post 139 is used to support the upward plate 132'. Therefore, an outer square wall is also supported, which is assembled with four identical upward plates 132'. In addition, a high-temperature rubber member 141 can be placed on the bottom of each post 139 so that the smooth top surface of the cooktop 166 can be protected.

The heat transfer regulating apparatus 100 including the inner hollow shell 102 and outer square wall 130 is preferably made of durable metals and metal alloys including iron and steel. In addition, appropriate surface treatments including coatings can be applied to the inner and outer surfaces 108 and 106 of the inner hollow shell, which enhance regulation of the heat transfer of the heat convection and heat radiation, and the durability of the inner hollow shell 102. The coatings are included those from chemical and electrochemical treatments and the ceramic coating as well, which have a preferred white or black color. Similarly, the surface treatments also can be applied to the exterior and interior sides 134 and 136 of the outer square wall.

Figure 4:
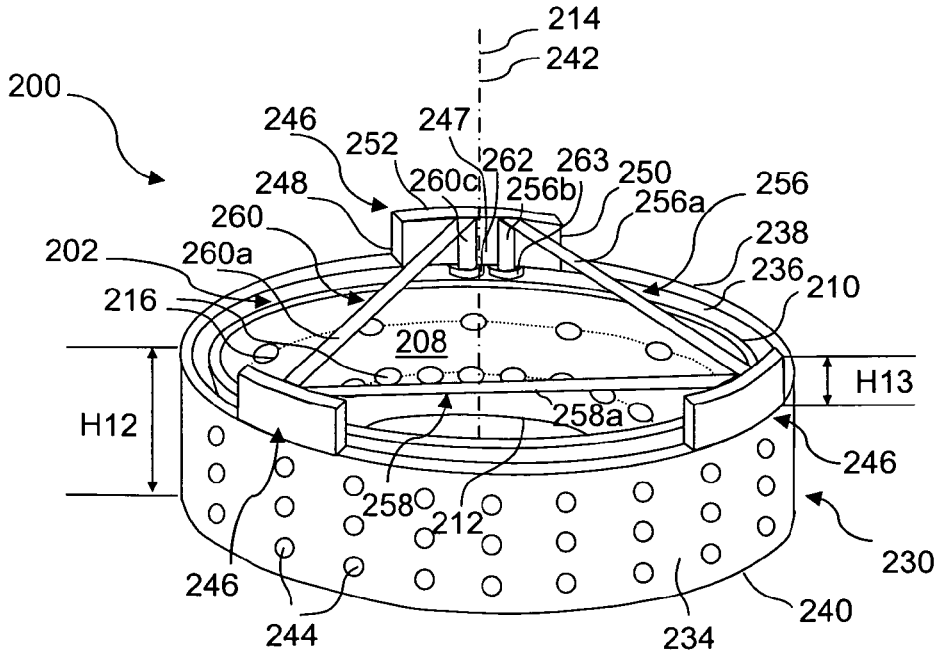
FIG. 4 is a perspective view of a second embodiment of the invented apparatus.

Referring to FIG. 4, there is illustrated second embodiment 200 of the heat transfer regulating apparatus for a burner of the gas stove, comprising an inner circularly arcuate hollow shell 202 and an outer circular wall 230. It would be appreciated that the inner hollow shell 202 is identical to the inner hollow shell 102 of the first embodiment 100. Therefore, a disclosure of the structural features of the inner hollow shell 202 will not repeated. These structural features are designated with three-digit numerals, wherein the part numbers are the same with the addition of a "200" to the part numbers to differentiate those same features in the embodiment 100.

The outer circular wall 230 includes a height "H12", exterior and interior sides 234 and 236, top and bottom circumferences or edges 238 and 240, and rotational axis 242 which is aligned with a rotational axis 214 of the inner hollow shell 202. A plurality of air passages 244 of openings are evenly to penetrate through the outer circular wall 230. It would be appreciated that from the spirit and scope of the present invention, a combined area of the air passages 244 of the outer circular wall 230 are more than that of the air passages 216 of the inner hollow shell 202.

The outer circular wall 230 is further comprised of at least three identical upward extensions 246 projecting upwardly from the top edge 238, wherein they are circumferentially spaced apart. The extension 246 is comprised of a transverse top end 252, first and second upward sides 248 and 250 having an identical height "H13". However, the height "H13" of each of the upward sides 248 and 250 is designed to be shorter than the height "H12" of the top edge of the outer circular wall 230, and the length of the top end 252 is generally longer than the length of each of the upward sides 248 and 250.

The identical extensions 246 of the present invention are designed to have a triple-function. The first one is to support an utensil having a flat bottom such as the pan, or having a convex shaped bottom such as the wok. The second one is to provide a gap which is the pathway for the outward and upward heat flow of the flame exhaust gases and air. The third one is to shield an undesirable heat flow for preventing it from heating a handle of the utensil.

Referring further to FIG. 4, there is illustration that a first group of an upper hook 262 and a lower hook (not shown) or attachment means are positioned on the interior side 236 of the outer circular wall. The hooks are positioned in parallel and rightward adjacent to a vertical linear position 247, wherein the vertical linear position is aligned with the middle of the extension 246. In addition, the upper hook 262 is adjacent to the top edge 238 and the lower hook is adjacent to the bottom edge 240 of the outer wall. Similarly, a second group of an upper hook 263 and a lower hook (not shown) or attachment means are placed on the interior side 236 of the outer circular wall in parallel and leftward adjacent to the position 247. The upper hook 263 is adjacent to the top edge 238 and the lower hook is adjacent to the bottom edge 240 of the wall.

The attachment means including hooks are designed on the outer circular wall 230 to affix three identical optional utensil supports 256, 258 and 260, so that a small cooking utensil can be placed on the optional utensil supports for cooking. As illustrated in FIG. 4, the first identical optional utensil support 256 is in the shape of a generally inverted "U", comprising a top transverse section 256*a*, a first downward section 256*b* which is identical to a second downward section (not shown).

Referring to FIG. 4 when in use of the first optional supports 256, the first downward section 256*b* is inserted into the second group of the upper and lower hooks which are leftward adjacent to the vertical linear position 247 of the first identical extension 246. The second downward section of the support 256 is inserted into the first group of the upper and lower hooks which are rightward adjacent to the line 247 of the second identical extension 246. The second identical extension is clockwise adjacent to the first identical extension. Similarly, the second and third optional supports 258 and 260 can be affixed. Therefore, the top transverse sections 256*a*, 258*a* and 260*a* of the respective first, second and third identical supports 256, 258 and 260 form an equilateral triangle, which is positioned to align with the top ends 252 of the respective extensions, so that a small pan can be conveniently placed onto the top of the triangle for cooking.

It would be appreciated that, from placing the attachment means adjacent to the vertical linear position 247 of the outer circular wall 230, the smallest equilateral triangle can be achieved, so that an even smaller utensil can be supported thereon. In addition from the spirit and scope of the present invention, the attachment means can be placed to any positions on the outer circular wall 230, so long as the optional utensil supports can be supported by the attachment means. It would be further appreciated that with the presence of the first and second groups of the upper and lower attachment means, various embodiments of the optional supports can be formed. One of them is similar to the configuration of the optional utensil supports illustrated in FIG. 4B of the '521 Application, which will not be repeated again. In addition, each group of the attachments is comprised of at least one attachment.

EXAMPLE I

The following are examples of the present invention flame heat transfer regulating apparatus for the burner upper structure of the gas stove, which are offered by way of illustration only and not by way of limitation and restriction.

In order to reduce length of disclosure of the present invention, a detailed illustration of EXAMPLE I is eliminated. However, the illustration can be reviewed from the published '521 application that has been published on the website of USPTO. Hereafter only lists the experimental results.

TABLE 1

Testing results for the Tested Samples (Sample) and References (Ref.)

| Test | Test Subject | Utensil | Times (min.) | Difference to Ref. (min.) | % to Ref. | Efficiency % (+) |
|---|---|---|---|---|---|---|
| 1 | Sample | Kettle | 19.75 | −4.50 | 81.44% | 18.56% |
| 2 | Ref. | Kettle | 24.25 | | | |
| 3 | Ref. | Big Pot | 24.67 | | | |
| 4 | Sample | Big Pot | 21.08 | −3.59 | 85.44% | 14.56% |

Testing results of the above Table 1 demonstrate that at least more than 14.6% of the increased heating efficiency in cooking are achieved with using both the smaller and larger utensils in application of the apparatus from the present invention, as compared with the times needed for the commercial cooktop to boil the same amount of the water. The results of the increased heating efficiency demonstrate importance of regulating transfer of the flame heat radiation and conviction including the air convection for saving the thermal energies in cooking. Therefore, the teaching from the test results is consistent with the spirit and scope of the present invention. In addition, the testing results also demonstrate that application of the removal flame heat transfer regulating apparatus significantly reduces consumption of the combustible gases and production of the greenhouse gases in cooking.

In the above disclosures of the present invention, the first and second embodiments 100 and 200 of the apparatus are illustrated for the gas stove cooktop having the sealed burner mounting assembly. However, it would be appreciated that the present invention is also appropriate for the gas stove cooktop having the opened burner mounting assembly. In addition, the outer wall 130 or 230 can be an extended one, which extends to surround two side-by-side gas burners of the stove cooktop.

It would be further appreciated that, from the spirit of scope of the present invention, the inner hollow shell 102 or 202 and the respective outer wall 130 or 230 can be an integrated one.

In the configuration for the integrated inner hollow shell 102 and outer square wall 130, the top circumference 110 of the inner hollow shell is simultaneously affixed to each of four upward plate 132 of the outer square wall. One embodiment of the affixation takes place at a position 137 on the interior side 136 of each upward plate 132, as illustrated in FIG. 2. The position 137 is aligned with the middle position of the upward plate and a position which is slightly lower than the top edge 138 of the upward plate. Therefore, the rotational axis 114 of the inner hollow shell 102 and the symmetric axis 142 of the outer square wall 130 are in alignment. It would be appreciated that after affixation, in one embodiment, both the inner hollow shell 102 and the outer square wall 130 of the integrated apparatus can be stood on the cooktop. However, in another embodiment, only the outer square wall of the integrated apparatus is designed to stand on the cooktop.

Other embodiments of integration are also available. For example, the top circumference 110 of the inner hollow shell can be affixed to four positions of the top square edge 138 of the outer square wall. In addition, the top circumference 110 of the inner hollow shell can be affixed on the top of the top square edge 138 of the outer square wall if there is a rim on the top circumference 110 of the inner hollow shell.

For integrating the inner hollow shell 202 and outer circular wall 230 together according to one of various ways of affixation, the top circumference 210 of the inner hollow shell is affixed to an upper circumference of the outer circular wall 230. The upper circumference is positioned on the interior side 236 of the outer circular wall in parallel, but slightly lower than the top circumference 238. Therefore, the rotational axis 214 of the inner hollow shell 202 and the symmetric axis 242 of the outer circular wall 230 are aligned together.

It would be appreciated that other embodiments are also appropriate for integrating and positioning the inner hollow shell 202 and outer circular wall 230, which are the same as the disclosed embodiments of integrating the inner hollow shell 102 and outer square wall 130.

Based on the integrated models which are illustrated above, a further structural variation can be conducted. One embodiment will be that the outer wall 130 or 230 is reduced to be a plurality of identical members, which each member has functions to support the a utensil, prevent the undesirable heating the utensil handle, and provide a pathway for hot gases to flow outwardly and upwardly. Under this principle, for example, the outer square wall 130 or the outer circular wall 230 can be reduced to comprise at least three identical upward strips, which are evenly spaced apart to affix to the inner hollow shell. Each strip has a width which is the same as the length of the top end 152 of the extension 146. In addition, each strip has a height which is the same height as the maximum height of the upward plate 132. Therefore, a bottom end of each of at least three strips stands on the cooktop of the gas stove, and a top end supports the utensil and blocks the undesirable heat that could heat a utensil handle.

Furthermore, it would be appreciated that, the present invention flame heat transfer regulating apparatus is only comprised of the circularly arcuate hollow shell. Under this structural configuration, the hollow shell is positioned on the cooktop to surround the upper section of a gas burner, and the commercial grate is used to support the utensil.

In terms of alternative materials used for manufacturing the apparatus, ceramics is also an appropriate choice, such as alumina, silicon carbide, silicon nitride, titanium carbide, magnesium oxide and silicon dioxide, or any their combinations. This is because ceramics has the excellent thermal properties including high melting point, large heat capacity, low thermal conductivity and low thermal expansion, mechanical properties including hardness and compressive strength, and durability including resistance to corrosion. In addition, the fracture toughness can be largely improved by implementing the fiber enhanced manufacturing process, which forms the fiber enhanced ceramics. Under this principle, it includes various structurally enhanced ceramics. These properties of the ceramics fit the material requirements for manufacturing the apparatus.

Therefore, it would be positive for maintaining high temperature in the space under a cooking utensil if the apparatus including the inner hollow shell and outer wall is made of the ceramics particularly due to its large heat capacity and low thermal conductivity. It is also advantageous to reach the object of achieving high heating efficiency in cooking from the present invention.

(II) The Gas Burner Having Improved Gas Ports and (Outer) Flame Ring in an Appropriate Diametrical Size It would be appreciated that, the apparatus disclosed above is incorporated with the existing gas burner having the laterally oriented prior art gas ports. The structural characteristics of the gas ports is disclosed in the above section of "Description of the Prior Art". In addition, two major disadvantages, which are negative to achieve high heating efficiency in cooking, are also disclosed for the prior art gas ports because of their association with the flame transverse elongation particularly under the maximum flow rate of the combustible gaseous mixture.

Therefore, for the objective of achieving high efficiency in heating the most popularly and probably usable cooking utensils with the flame generated by the maximally pressured mixture of the combustible gases and primary air, an appropriate strategy from the present invention is to make the flame burn, which is aligned with an angle relative to the transverse orientation. In this configuration, the flame is angularly positioned from the respective gas ports to the bottom surface of a utensil, wherein top of the flame can directly come into contact with the bottom surface of the utensil. This will eliminate both problems of large area of the cold spot and flame transverse elongation including the chilling effect. Following this strategy, the present invention changes structure of the prior art gas ports including their orientations.

Figure 6:
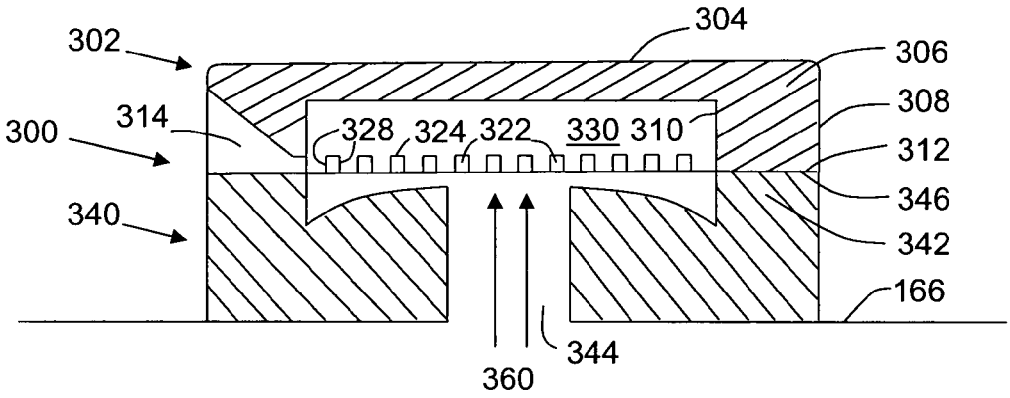
FIG. 6 is a diametrical and longitudinal cross sectional view of an upper section of a burner having identical improved gas ports. The gas ports are formed from the respective identical slots circumferentially and radially spaced apart to cut off a bottom ring of a top cap after it is positioned to mate with a hollow neck. For simplification, the figure only illustrates the burner upper section having the top cap and hallow neck that is affixed onto the stove cooktop.

Referring to FIG. 6, there is an illustrated upper section 300 of a gas burner including a plurality of the identical improved gas ports 314 that are the respective openings from the present invention. The upper section 300, which is positioned onto the cooktop 166 of a stove, is comprised of a removable round top cap 302 and an upward hollow neck 340 that is affixed to the cooktop 166, wherein the top cap 302 is positioned downwardly to mate with the hollow neck 340.

The cap 302 is comprised of a transverse top 304, which is connected to the top of a downward circular wall 306 to thereby form an inner round recess 330 of air space. The wall has outer and inner sides 308 and 310, and a bottom ring surface 312. A plurality of the identical narrow downward slots 314 of air space are circumferentially and radially spaced apart to cut off a part of the circular wall including the bottom ring surface 312. The upward hollow neck 340 is comprised of an upward circular wall 342 having a top ring 346 that matches the downward circular wall 306 of the cap, and a central upward opening 344 for passing a mixture 360 of the combustible gases and primary air.

Figure 6A:
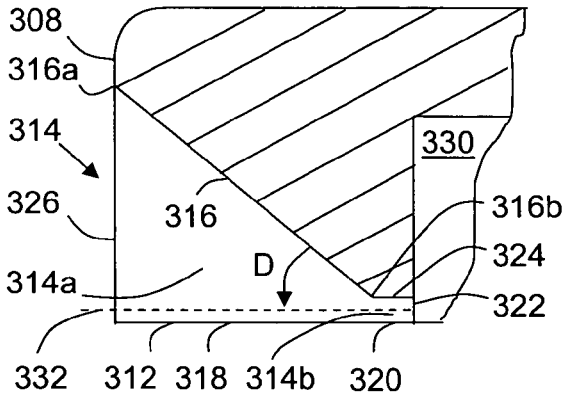
FIG. 6A is an enlarged partial cross sectional view of the top cap shown in FIG. 6, which illustrates structure of each identical improved gas port from the present invention.

Referring to FIGS. 6 and 6A, the improved gas port is originally from a downward slot 314 having a narrow width. The narrow slot is comprised of a larger expanding section 314*a* having a larger outward opening 326, which is connected to a smaller section 314*b* having a smaller rectangular inward opening 322 and a transverse symmetric axis 332. The outward opening 326 and inward opening 322 are positioned on the respective outer and inner sides 308 and 310 of the circular wall. The expanding section 314*a* is comprised of a rectangular ascending interior top surface 316, a transverse downward bottom opening 318, and two identical downward sides. Therefore, the interior top surface 316 has an angle "D" relative to the symmetrical axis 332 of the small section 314*b*. In a preferred embodiment, the angle "D" has 45-degrees. In addition, two downward sides have the shape of a right angled trapezoid, which are identical to the cross sectional view of the section 314*a* in FIG. 8A. The smaller section 314*b* is a cuboid slot including an interior rectangular top surface 324, and two downward sides 328, which forms a downward opening 320.

As illustrated, a first end 316*a* of the interior top surface 316 is connected to the outer side 308 of the circular wall. An opposite second end 316*b* of the interior top surface 316 is connected to the top rectangular surface 324 of the small section 314*b*. In this setting, the length of the surface 324 represents the width of the narrow slot 314. In addition, the transverse downward bottom opening 318 of the larger expanding section 314*a* is connected to a transverse downward bottom opening 320 of the smaller section 314*b*. The connection forms the downward bottom opening of the slot 314, which is aligned with the bottom ring surface 312 of the cap 302.

It would be appreciated that, when the top cap 302 is positioned to mate with the hollow neck 340, the identical narrow slots are turned into the respective identical improved gas ports 314, wherein the outward openings are outlets 326, and the inward openings are inlets 322 of the respective gas ports.

Referring to FIGS. 6 and 6A, after the pressured combustible gaseous mixture 360 entering into an inner chamber constructed mainly by the inner recess 330 of the cap 302, the pressured mixture 360 first passes through the smaller section 314*b* of the opening that is served as a nozzle of the gas port and then enters the larger expanding section 314*a* of the opening, wherein the orientation of the nozzle 314*b* is aligned with the sideward symmetrical axis 332.

It would be appreciated that the combustible gaseous mixture flows at a higher speed in the nozzle 314*b*, as compared with a lower speed in the expanding section 314*a*, when the mixture 360 that enters the upward opening 344 of the burner neck has a pressure (or flow rate) selected by a user. This is because of the larger gradually expanding cross sectional areas of the larger expanding section 314*a* as compared with the smaller constant cross sectional area of the smaller section 314*b*, wherein both areas are perpendicular to the symmetric axis 322. In this configuration, it results in a stable flow having a gradually reduced low speed of the combustible gaseous mixture when it flows inside of the larger expanding section 314*a*, which further leads to a stable flame kernel at the outlet 326 of the gas port, when the mixture is ignited by an electric ignitor (not shown). In addition, the stable flame kernel is further supported by the secondary air that flows through the apparatus from the surrounding areas of the flame. Therefore, the present invention enables to form stable flame kernels, particularly when the combustible mixture 360 has the highest pressure.

In addition, it would be appreciated that the flame kernel will be aligned with the preferred angle of 45 degrees of the interior top surface 316 of the gas port 314, which further results in a flame to burn that is aligned with the same angle. The led angular flame can come directly into contact with the bottom surface of the utensil to thereby efficiently heat the utensil in cooking. This rationalization can be proved by the experiment results listed in the following Table 2.

EXAMPLE II

The following are examples of the present invention flame heat transfer regulating apparatus incorporated with a burner having the improved gas ports from the present invention, which are offered by way of illustration only and not by way of limitation and restriction.

For the same reason of reducing length of this disclosure, a detailed illustration of EXAMPLE II is eliminated. But the illustration can be reviewed from the published '940 application which has been published on the USPTO website. Hereafter only lists the experimental results.

TABLE 2

Testing results for the Tested Samples (I-Cap) and References (C-Cap)

| Test | Test Subject | Utensil | Times (min.) | Difference to C-Cap (min.) | % to ave. C-Cap | Efficiency % (+) |
|---|---|---|---|---|---|---|
| 1 | C-Cap | Kettle | 10.38 | | | |
| 2 | C-Cap | Kettle | 10.50 | | | |
| 3 | I-Cap | Kettle | 9.30 | −1.14 | 89.08% | 10.92% |

The experimental results in Table 2 prove that an increase of heating efficiency 10.92% is achieved in application of the cap having the improved gas ports from the present invention. The increase of the heating efficiency is positively assured, particularly from very small percentage (0.6%) of differences when the reference C-Cap was twice tested.

It would be appreciated that, the expanding section 314*a* of the opening having the interior top surface 316 actually changes orientation of the flow of the combustible gaseous mixture 360, from a zero-degree to a 45-degree relative to the transverse direction, when the mixture passes through the nozzle 314*b* into the expanding section 314*a*. Similarly, change of the orientation of the nozzle 314*b* is also available regarding configuration of the gas port. Therefore, various variations on the structures of the improved gas port are rationalized, as compared with the illustrated embodiment 314, for achieving the angular flow of the combustible mixture.

Figure 6B:
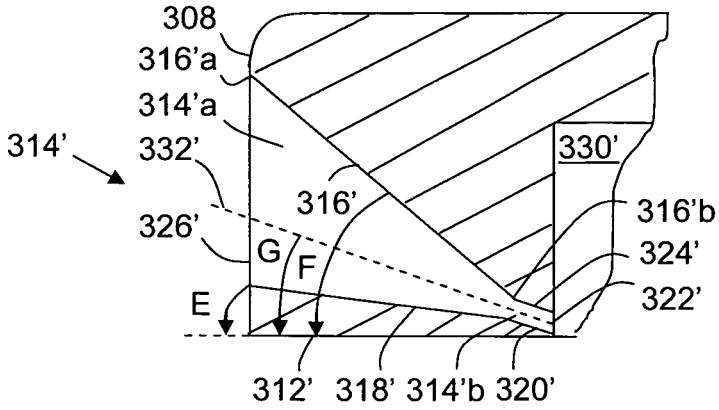
FIG. 6B is an enlarged partial cross sectional view of the top cap shown in FIG. 6, which illustrates variations of each identical improved gas port shown in FIG. 6A.

Referring to FIG. 6B, there is illustrated another embodiment 314' of the identical improved gas ports of the openings as the structural variations of the gas ports 314 in FIG. 6A. In this configuration, an orientation of the nozzle 314'*b*, which is aligned with the symmetric axis 332', has an angle "G" relative to the transverse bottom ring 312' of the cap. Accordingly, each of the identical gas ports 314' is an opening that penetrates through the circular wall 306 of the cap. Therefore, a bottom surface 318' of a large expanding section 314'*a* of the opening can be positioned to align with an angle "E" relative to the transverse bottom ring 312'. An ascending interior top surface 316' is oriented at the angle "F", wherein the angle "F" is larger than the angle "E". In this setting, it would be appreciated that, according to the spirit and scope of the present invention, no matter how to alter the angle of the orientation of the nozzle 314'*b*, an outlet 326' of the larger expanding section must be larger than the inlet 322' of the smaller section 314'*b*, wherein the angle "F" is always larger than the angle "E", so that the stable flame kernels can be obtained.

Figure 6C:
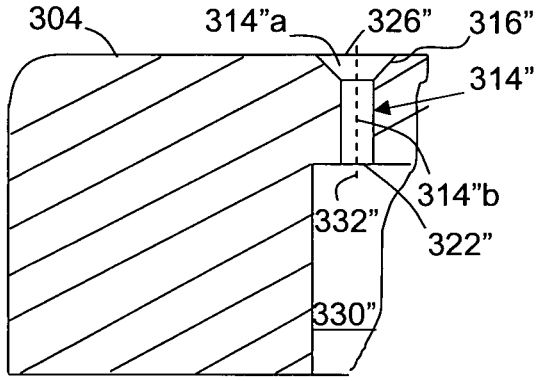
FIG. 6C is an enlarged partial cross sectional view of the top cap of FIG. 6A, which illustrates further variations of each of the respective identical improved gas ports, wherein the gas ports are upwardly, circumferentially and radially spaced apart to penetrate through a top of the cap.

Furthermore, referring to FIG. 6C, there is illustrated additional embodiment 314" of the identical improved gas ports of the openings that are upwardly, circumferentially and radially spaced apart to penetrate through the top of the cap 302. Each of the identical gas ports 314" includes an upward symmetric axis 332", and a smaller section 314"*b* of the opening connected to a larger expanding section 314"*a* of the opening. The smaller section served as a nozzle is aligned with the upward axis 332" having a 90-degree relative to the transverse direction, wherein an inlet 322" of the nozzle is connected to an inner recess 330" of air space. The larger expanding section 314"*a* is also upward positioned, comprising two ascending interior top surfaces 316" and an outlet 326" that is aligned with the top surface of the top 304.

In the structural configuration illustrated in FIGS. 6A-6C, it would be appreciated that, the gas ports can be in the round shape. Specifically, the gas port 314" is comprised the expanding section 314"*a* of the opening that is in the shape of a symmetric inverted frustum of a cone, which is concentrically connected to the nozzle 314"*b* that is in the shape of a cylindrical opening. Following this embodiment, the gas sport 314 can be a half of the port 314" to comprise a downward opening. Regarding the burner port 314', the larger expanding section 314'*a* can be an asymmetric inverted frustum of an opening, which is connected to the smaller section 314'*b* that is also a cylindrical opening.

Referring to FIGS. 6A-6C, the present invention discloses a structural characteristics of the improved gas ports, which is change of the orientation of the nozzles of the respective identical improved gas ports from a zero degree to a 90-degree relative to the transverse direction, which correlates to change of the gas port locations from the circular wall to the top of the cap.

In a preferred embodiment for positioning these gas ports, it can be classified as: (1) the improved gas ports can be positioned onto the circular wall 306 if the angle "G" of the nozzle is ranging from equal to a zero degree to less than a 45-degree; (2) the improved gas ports can be positioned at the joint where the cap top 304 is connected to the circular wall 306 of the cap 302 if the angle "G" is equal to a 45-degree; and (3) the ports can be positioned onto the top 304 if the angle "G" is ranging from larger than a 45-degree to equal to a 90-degree. However, as illustrated above, no matter how to alter the angle of the orientation of the smaller section nozzle, the outlet of the larger expanding section must be larger than the inlet of the smaller section of each identical improved gas port according to the spirit and scope of the present invention.

In addition, other structural variations of the improved gas ports are available. Referring to FIG. 6A, instead of having the larger expanding section 314*a* connected to the smaller section 314*b*, the improved gas port can only have the expanding section of an opening, wherein the second end 316*b* of the interior top surface 316 is connected to the inner circular side 310 of the circular wall 306. Therefore, an improved gas port includes a larger outlet of an opening, a smaller inlet of the opening and an ascending interior top surface.

Furthermore, instead of positioning the identical improved gas ports 314 to the cap 302, the identical gas ports can be positioned to the circular wall 342 of the hollow neck 340 for achieving the same effect. The gas ports 314 can be additionally positioned to cut off both the cap bottom ring surface 312 and the neck top ring 346, when the cap 302 and neck 340 are mated together. It would be appreciated that the structural details of the gas ports in these embodiments are obvious to one of ordinary skill in the art. Therefore, such details will not be repeated again.

Figure 6D:
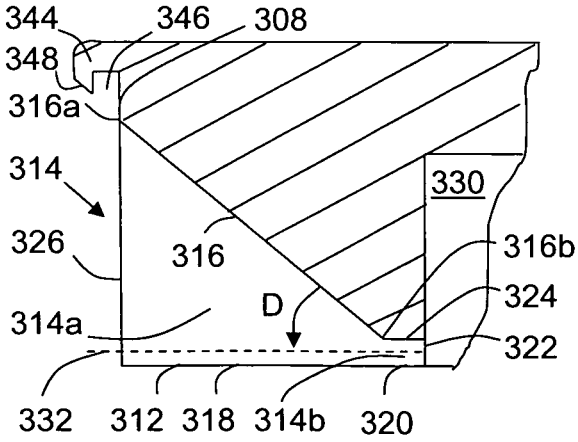
FIG. 6D is an enlarged partial sectional view of the top cap shown in FIG. 6A, which illustrates structural variations of the cap including addition of a circular sideward protrusion positioned onto the cap top and a circular downward slot positioned where the protrusion is connected to a circular wall of the top cap.

FIG. 6D illustrates a structural variation of the cap. A circumferential sideward protrusion 344 is positioned on the outer side 308 of the circular wall 306, which is aligned with the top transverse surface of the top 304 of the cap, wherein a bottom side 348 of the circular sideward protrusion 344 is a circular ring and aligned with the ascending interior top surfaces 316 having the angle "D" of the respective gas ports 314. Therefore, the flame along the ascending angle "D" when it burns will not be affected by the presence of the circular sideward protrusion 344. Besides, a downward circular slot 346 is positioned at a joint when the protrusion 344 is connected to the circular wall 306 of the cap. The protrusion 344 is designed to prevent extinction of the flame kernels if there is liquid drop off to the cap in cooking. The downward slot 346 is for stabilizing the flame kernels, when they are formed from igniting the combustible gaseous mixture at the minimum flow rate (or pressure) that is selected by a user of the stove.

It would be appreciated that, the cap structural variation shown in FIG. 6D and gas port variation shown in FIG. 6B can be simultaneously applied to manufacture a cap according to the spirit and scope of the present invention.

Still following the rationalization of the first reason that causes loss of the thermal energies in the section of "Description of the Prior Art", it would be appreciated that a burner (outer) flame ring having an extra large diametrical size also can cause loss of the thermal energies even the gas ports of the flame ring are arranged upwardly. This rationalization is driven by a practical fact that the most popularly and probably usable cooking utensils have diameters in a narrow range, for example, from 15 cm to 20 cm. Such fact also determines an optimum diametrical size of the top circumference of the inner hollow shell 102 or 202 for the apparatus. Thus, the apparatus having the fixed size cannot resist heat loss if an extra large flame ring is used.

Therefore, it is critical that sizes of the respective (outer) flame ring, top circumference of the inner hollow shell, and utensil must be appropriately matched for achieving the best heating efficiency in cooking. Hereafter are experimental results, which demonstrate the above rationalization regarding incorporation with the sizes of the respective flame ring, utensil and inner hollow shell.

EXAMPLE III

The following are examples of the heat transfer regulating apparatus incorporated with a burner having the improved gas ports from the present invention, which are offered by way of illustration only and not by way of limitation and restriction.

Still for the same reason of reducing length of this disclosure, a detailed illustration of EXAMPLE III is eliminated. However, the illustration can be reviewed from the published '940 application which has been published on the USPTO website. Hereafter only lists the experimental results.

TABLE 3

Testing results for the Tested Samples (S) and References (Ref.)

| Test Order | Test Subject | Type of the Utensil | Times (min.) | Difference to Ref. (min.) | % to Ref. | Efficiency % (+) to Ref. |
|---|---|---|---|---|---|---|
| 1 | Ref. | Pot | 6.17 | | | |
| 2 | S1 | Pot | 5.93 | −0.24 | 96.1 | 3.9 |
| 3 | S2 | Pot | 4.77 | −1.40 | 77.3 | 22.7 |
| 4 | S3 | Pot | 5.02 | −1.15 | 81.4 | 18.6 |

The experimental results listed in Table 3 indicate that the burner in the commercial setting (Ref.) generates a significant energy loss (−18.6%), as compared with the burner which the outer flame ring has an experimental cap (S3). Comparing with the structural characteristics of the commercial cap, the energy loss from the commercial setting is rationalized as follows: (1) The larger outer flame ring, which the outermost circumference of the respective outlets has the diameter of 10.5 cm, and (2) the linear slot shaped gas ports.

Alternatively speaking, the comparison tests of Ref. and S3 indicate that appropriate diametrical size of the outer flame ring and improved gas ports are significant to increase the heating efficiency of the flame in cooking, wherein the improved gas port is comprised of a smaller nozzle having a smaller inlet connected to a larger expanding section having a larger outlet. Therefore, the flame generated at the outlets by the combustible gaseous mixture having the lower speed is possibly burned more completely in the presence of the secondary air, as compared with the flame from the commercial cap where the combustible gaseous mixture has a higher speed when it is out of the prior art gas ports. This results in a higher temperature of the flame in the settings of S2 and S3 using the experimental cap, which further results in significantly saving the combustible gases.

The result of testing the setting of S2 indicates additional saving of +4.1% of the energies, which is obtained as compared with the result in settling of S3. This is due to the contribution of the apparatus, which regulates transfer of the radiated and convected heat. Interestingly, the energy saving of +3.9%, which is almost the same as the energy saving of +4.1%, is achieved in testing of S1 comparing with testing of Reference, wherein both settings of S1 and Ref. are involved in the upward flame pattern. The energy saving of +3.9% is also contributed by application of the apparatus.

Further comparing a larger energy saving of more than +14.55% in EXAMPLE I with a smaller energy saving of +4% in EXAMPLE III in application of the present invention apparatus, it is clear that, the laterally oriented gas ports generally contribute to a significant energy loss, as compared with the upward oriented gas ports.

Therefore, the experimental results are consistent with the rationalization according to the spirit and scope of the present invention, which the improved gas ports significantly increase the heating efficiency of the flame in cooking since they control the flame pattern to prevent a large amount of the energy loss. In addition, the apparatus still contributes to a portion of saving the energies. Therefore, the experimental results prove that, the flame heat transfer regulating apparatus incorporated with the burner having the improved gas ports is a good solution for achieving an optimum heating efficiency of the flame in cooking.

Furthermore, it would be appreciated that from the experimental results disclosed above, the present invention can define a set of parameters, which are critical for an optimum structure of the apparatus incorporated with a burner having the identical improved gas ports to practically achieve the optimum heating efficiency in cooking when applying a cooking utensil having the most popularly and probably usable size. The critical parameters include an optimum 19 cm diameter of the top circumference of the inner hollow shell and a maximum 8 cm diameter of a circle that is aligned with outlets of the respective gas ports of an (outer) flame ring, wherein the optimum and maximum diameters are correlated to an optimum distance ranging from 2.5 cm to 3 cm between a top position of an outlet and the bottom surface of a cooking utensil having an optimum diametrical size ranging from 15 cm to 20 cm.

The maximum 8 cm diameter of the circle is defined according to the results of EXAMPLE III. The circle is aligned with the centers 332" of the outlets 326" of the respective upward gas ports on the outer flame ring, wherein each gas port is an inverted frustum shaped opening connected to a cylindrical opening serving as the nozzle (FIG. 6C). It would be appreciated that the 8 cm diameter is also appropriate for a burner (outer) flame ring having the sideward outlets 326 positioned on the outer side 308 of the burner upper section as illustrated in FIG. 6A, wherein the expanding sections control the flame kernels having the optimum angle of 45 degree relative to the respective transverse directions. This is because a 14 cm diameter is projected for the circular top of the flame from the improved gas ports according to the above defined optimum distance ranging from 2.5 cm and 3 cm and a combustible mixture under a high pressure (or flow rate). The diameter of 14 cm is smaller than that between 15 cm and 20 cm for the most popularly and probably usable utensils, so that the utensils can still be efficiently heated.

Furthermore, when in use of the combustible gaseous mixture at a medium or a slightly high pressure that is the most popularly and probably usable conditions in cooking, the diameter of the circular top of the flame will be smaller than the above projected 14 cm. In those situation, satisfaction of saving the combustible gases is expected from rationalization that the inner hollow shell additionally prevents the energy loss according to the experimental results of the EXAMPLE I. In addition, saving the combustible gases is also expected when the gases are at small to medium pressures, since the apparatus significantly prevents loss of the flame heat.

In addition, a satisfactorily saving the heat is also expected for utilizing a wok in the setting having the above defined parameters. This is because the wok has a larger area of the outer surface having a smooth convex curve as compared with the pot having a smaller area in addition to a change of 90-degree when the bottom surface is connected to the cylindrical outer side. Therefore, in application of the present invention apparatus incorporated with the burner having the improved gas ports, the hot exhaust gases and air in addition to the top of the flame will be more likely to follow the convex curve of the wok according to the theory of fluid dynamics after the flame directly in contact with the wok. The result is an efficiently heating the wok.

It would be appreciated that, under the above defined basic parameters, there is still a room for tuning other structural parameters including a size of the identical outlet as compared with a size of the inlet, and an orientation of the expanding section of the gas port if the section is not aligned with the orientation of the nozzle of the smaller section, so that a best result of saving the energies can be achieved.

It would be another appreciated that, the above disclosed stove having improved burners and apparatus could still have a few marketable values although it has a remarkable performance to save the combustible gases. This is because the stove is lacking in ornamentation regarding its upwardly positioned apparatus. Specifically, the visual effect of the upwardly positioned apparatus of the stove which is installed to a kitchen counter top is out of harmony with the visual effect of the horizontal surface of the counter top. Such deficiency of lacking in the aesthetic appearance is eliminated in an improved stove, which is disclosed as follows.

III. Gas Stove Incorporated with Improved Gas Ports, Gas-Air Mixing Means, Gas Dispensing Means and a Removable Heat Transfer Regulating Apparatus Concealed by Top Plates of the Stove Referring to FIG. 7A, there is illustrated installation of the present invention first embodiment 400 of a stove to a kitchen counter top, where a partial counter top 402 is shown including a front side 404, rear side 406, proximal side 408, and distal side 410. The stove of a dual burner configuration is positioned to be slightly higher than the partial counter top 402 that is positioned, comprising two symmetrical removable top plates 412 and 420. The two top plates include the respective larger central openings 414 and 421, and plurality of smaller optional side openings 416 and 417. As illustrated, two identical removable heat transfer regulating apparatus 492 and 492a are positioned inside of the respective central openings 414 and 421, so that the two top plates 412 and 420 conceal including the respective vertically positioned outer walls 506 and 506*a*. This causes the stove 400 to have a flat top surface, which is almost aligned with a flat top surface of the partial kitchen counter top 402. In this setting, the stove installed to the counter top provides the visual effect of the flat top surface, which is in harmony with the visual effect of the horizontal surface of the kitchen counter top to thereby ornament the kitchen. Therefore, the present invention stove possesses both values of the ornament and excellent performance including saving the combustible gases.

The stove 400 has a cuboid housing as disclosed in FIGS. 7A, 7B, 8A, 9A and 12. The housing includes an optional lower section 430 connected to an upper section 434 where a flexible gas connecting pipe 726 penetrates therethrough. The lower section has the shape of a top opened cuboid container, including a top rim 431, bottom side 432, and several openings 433 positioned to penetrate through a side wall of the section.

The upper section 434 of the housing includes an optional complementary upward wall 450, the two top plates 412 and 420, and an integrated sheet structure 418. Within the sheet structure, there is a top closed rectangular rim 401 having an appropriate width, which is the major structure in contact with the counter top for supporting the stove. The rim includes a front end 426, rear end 428, distal end 424, and a transverse plate section having an exterior side that is a proximal end 422 of the rim. The transverse plate is served as a switch panel 436, where two identical knobs 470 and 470*a* of the respective gas switches are positioned thereon. In addition, the switch panel 436 is aligned with the top plates 414 and 420.

Figure 12:
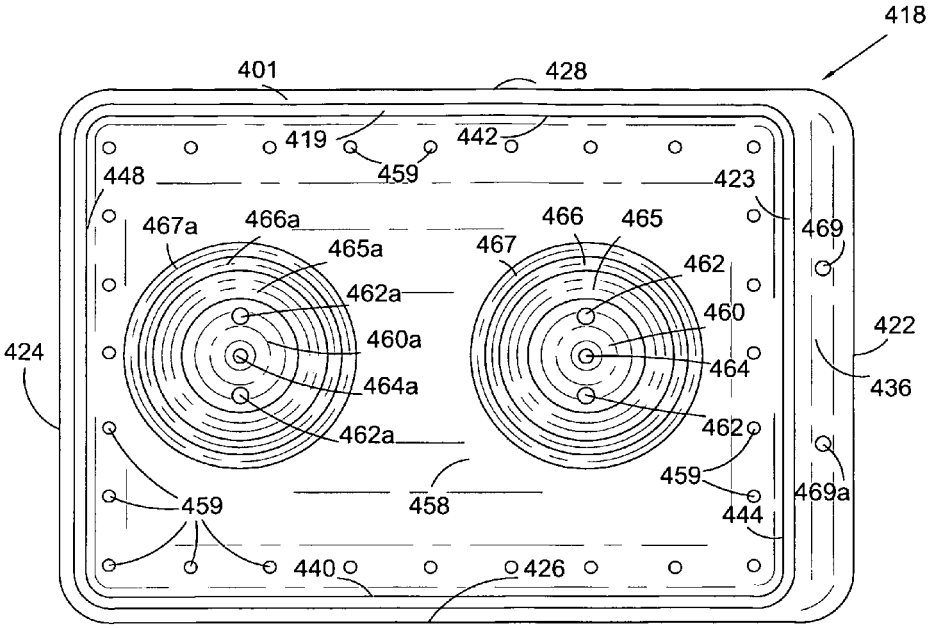
FIG. 12 is a top plain view of an integrated sheet structure, which is a part of an upper section according to a first embodiment of a housing of the present invention stove.

The rim is connected to an interior closed rectangular shelf 419, which supports the top plates 414 and 420 positioned thereon. As illustrated in FIG. 12, the shelf including an inner proximal section 423 further at its inner side is connected to a closed rectangular upward side wall having upward front, rear, distal and inner proximal section walls 440, 442, 448, and 444, wherein the inner proximal section wall 444 is connected to the inner proximal section 423 of the shelf. The closed upward wall at its bottom side integrates a transverse burner receiving plate 458. The sheet structure 418 further includes the top switch panel 436 that is connected to an opposite inner side of the inner proximal section 423 of the shelf. In addition, there are two openings 469 and 469*a* on the top switch panel for positioning the respective switch knobs 470 and 470*a* which are connected to the respective switch bodies positioned underneath the panel.

The upward complementary side wall 450 is detachable. As additionally illustrated in FIG. 7A when viewed it vertically, the wall 450 has the shape of a symbol "z,900 " of its transverse cross section, which includes an upward proximal section along the rim proximal end 422. The proximal section at its both front and rear longitudinal sides extends at the respective 90-degree to form the respective front section 450*a* and rear section (not shown), which are aligned with the respective front and rear section walls 440 and 442. The front section 450*a* has outward rims 452 along its longitudinal side for connecting to the front section wall 440. Similarly, the rear section of the wall 450 is also connected to the rear section wall 442. Since the inner proximal section wall 444 is affixed to the respective front and rear section walls 440 and 442, the complementary side wall 450 is simultaneously connected to the front, rear and inner proximal section walls 440, 442 and 444. In addition, the wall 450 also includes a bottom rim 451 for connecting to the top rim 431 of the lower section 430.

Figure 9A:
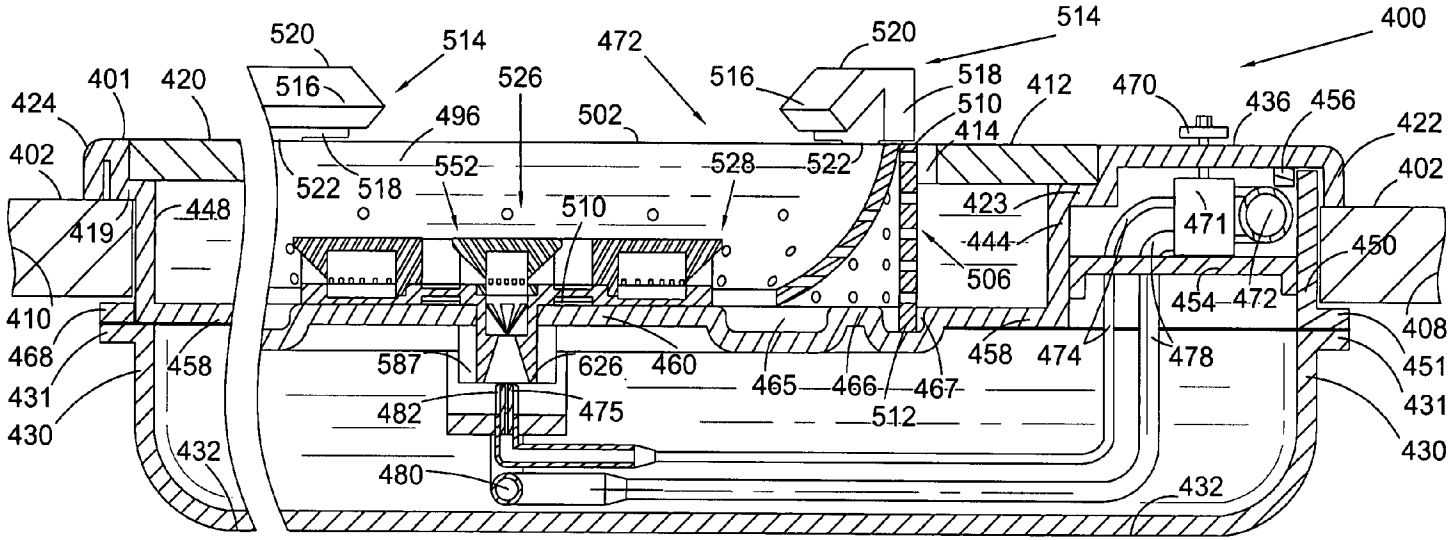
FIG. 9A is a longitudinal partial cross sectional view as compared with that of FIG. 8A, where the partial cross sections are taken along the respective B-B and C-C lines of FIG. 7A.

Referring specifically to FIG. 9A, a top end of the upward detachable complementary side wall 450 is positioned between the interior side of the proximal end 422 and a position limiting member 456 which is affixed to the interior surface of the switch panel 436 adjacent to the proximal end 422. Besides, additional mechanical fastening means, such as screws and nuts can be applied to affix the position limiting member 456 and top end of the wall 450 together.

It would be appreciated that, the detachable lower section 430 and upper section 434 of the housing are affixed together in various ways. One is application of affixing means 468, such as outward hooks that are additionally affixed to bottoms of the respective front, rear, and distal upward section walls of the upper section 434. Therefore, it is able to affix the top rim 431 of the lower section 430 to the respective bottom affixing means 468 of the upper section and bottom rim 451 of the wall 450 from application of fasteners, such as nuts and screws.

Alternatively, the housing can be manufactured to include a top opened cuboid container having a top outward rim, two top plates 410 and 420, and a piece of the transverse burner receiving plate 458 which is detachably affixed to the interior side of a closed side wall of the container. As another variation, the housing includes the top plates 412 and 420, integrated sheet structure 418, and a top opened cuboid container have a top outward rim. A top opening of the container has a size, which is larger than a size of the upward side wall of the sheet structure 418. Therefore, in assembling of the housing, the container upwardly surrounds the side wall, wherein the top outward rim of the container comes into contact with the interior side of the rim 401 of the sheet structure 418. It would be appreciated that, these two embodiments of the housing are obvious to one of ordinary skill in the art, therefore, their details will not be illustrated.

Figure 8A:
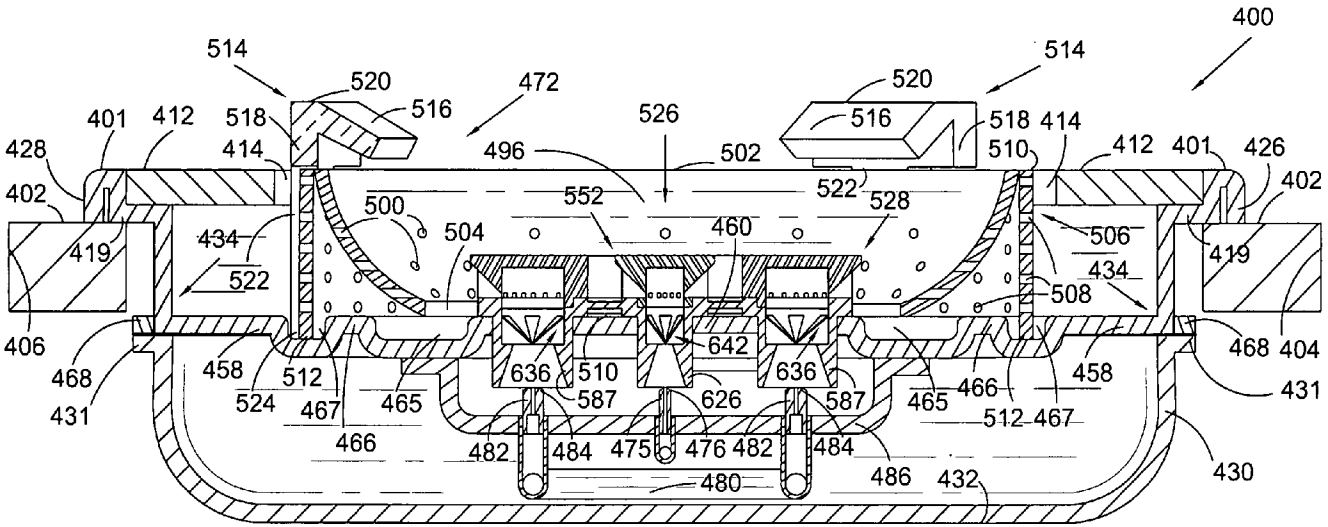
FIG. 8A is a transverse cross sectional view of the first embodiment of the stove, where the cross section is taken along A-A line of FIG. 7A. In addition, for simplification in the drawings, FIG. 8A does not show connection between switch bodies and gas jets of the burner.

Referring to FIGS. 8A, 9A and 12, there is illustrated that the transverse burner receiving plate 458 is punched to comprise a first set of structures including a round central burner receiving protrusion 460 for supporting a burner that is positioned thereinto. The protrusion includes two bigger side openings 462 and a smaller central opening 464. The round central protrusion 460 is positioned at a center of a first half of the plate 458 adjacent to the inner proximal section wall 444, which is surrounded by an inner circular recess 465 of air space that is for collecting liquid drop off in cooking. The recess is further surrounded by an outer circular recess 467 of air space. The recess 467 is for supporting the respective outer wall 506 and "T" shaped utensil supports 514 when their respective bottom ends 512 and 524 are positioned therein to thereby restrict their movement. In addition, there is a middle ring protrusion 466 which is positioned between the respective circular recesses 465 and 467, so that each recess of air space can function appropriately.

A second set of round structures is positioned at a central place of a second half of the plate 458 adjacent to the rim distal end 424. The second set has the identical structural components as compared with those of the first set, including a round central burner receiving protrusion 460*a* having openings 462*a* and 464*a*, inner circular recess 465*a* of air space, middle ring protrusion 466*a* and outer circular recess 467*a* of air space.

Referring to FIGS. 8A, 9A, 10A-10C, and 11A-11B, there is illustrated first embodiment 526 of a removable improved gas burner, which is detachably positioned to the round central burner receiving protrusion 460. The gas burner 526 has a dual flame ring including a larger outer flame ring 528 and a smaller inner flame ring 552.

The outer flame ring includes a top ring cover 530 and a bottom structural member regarding detachability of its structural components. The bottom structural member is comprised of a middle circular upward wide slot serving as a middle circular gas mixture receiver (middle receiver) 574, which is connected to the respective two identical downward supports 608 and two identical downward hollow cylindrical structure serving as the respective left and right side bottom gas intakes 587. As illustrated, the top ring cover 530 and middle receiver 574 are mated together. The top ring cover 530 is comprised of a central opening 538 surrounded by exterior and interior circular cylindrical walls 532 and 536. A top transverse ring 539 is connected to tops of the respective walls 532 and 536, which forms a top transverse surface 540 and a downward interior transverse circular recess 541 of air space. The top transverse ring 539 further extends sidewards to form a circular sideward protrusion 531 with an exterior ascending ring surface 546.

The exterior cylindrical wall 532 of the cover includes exterior and interior circular cylindrical surfaces 534 and 535, and a bottom ring surface 533. As illustrated in FIG. 10B, a plurality of identical downward narrow slots 542 of air space are circumferentially and radially spaced apart to cut off the bottom ring surface 533. Each identical slot 542 is an outwardly expanding section, including a transverse downward opening 549 positioned to align with the bottom ring surface 533, smaller inward and larger outward rectangular openings 543 and 544 positioned on the respective interior and exterior surfaces 535 and 534, and two identical downward sides 550. As further illustrated, a height of the opening 544 is longer than that of the opening 543, so that the slot 542 further includes an ascending interior top surface 545 that is aligned with the ascending ring surface 546, which is towards upward and outward. Therefore the two downward sides 550 of the slot have the shape of a right angled trapezoid identical to the view of a longitudinal cross section of the slot 542 in FIG. 10B.

The interior cylindrical wall 536 of the cover includes a lower ring surface 537, which is aligned with the bottom ring surface 533 of the exterior cylindrical wall. In addition, a bottom downward circular protrusion 547 having a bottom surface 548 is connected to the lower ring surface 537 of the interior cylindrical wall.

The middle receiver 574 is comprised of a central opening 573 surrounded by exterior and interior cylindrical walls 575 and 579, wherein a bottom transverse ring 583 is connected to bottoms of the respective walls to form an upward transverse interior circular recess 586 of air space and a bottom transverse ring surface 584. The exterior cylindrical wall 575 includes a top ring surface 576, and outer and inner circular cylindrical surfaces 577 and 578. The interior cylindrical wall 579 includes exterior and interior circular cylindrical surfaces 580 and 581, and a top ring surface 582. In addition, an inner circular shelf 585 is positioned on the interior cylindrical wall 579, which is aligned with the top ring surface 582 and interior surface 581. It would be appreciated that the inner circular shelf 585 matches the downward circular protrusion 547 for locking the top ring cover 530 and middle receiver 574 of the bottom structural member together to form the outer flame ring 528, so that the circular shelf and protrusion are broadly defined as the interlocking means of the outer flame ring.

Referring to FIGS. 10A-10C and 11A-11B, there are illustrated two identical left and right side bottom gas intakes 587 which are positioned to upwardly connect to the respective 3 and 9 o'clock positions of the transverse bottom ring surface 584 of the middle receiver 574, and two identical supports 608 having the respective bottom surfaces 610 which are positioned to upwardly connect to the respective 6 and 12 o'clock positions.

As illustrated, each identical side bottom gas intake 587 is a hollow cylindrical member having a generally "T" shaped longitudinal cross section. It is comprised of an upper transverse ring 593 having an exterior circular cylindrical surface 588 concentrically and downwardly connected to a lower longitudinal hollow cylinder 590. This forms a middle transverse ring surface 589 as an interface between the upper ring and lower cylinder, since the upper transverse ring 593 has a larger diameter as compared with a smaller diameter of the lower cylinder 590. The upper transverse ring 593 includes an interior circular cylindrical surface which surrounds a central opening. The central opening is further upwardly connected to an opening at the 3 or 9 o'clock position of the bottom transverse ring 583 of the middle receiver, when the side gas intake is upwardly connected to the middle receiver.

The lower longitudinal hollow cylinder 590 is comprised of a bottom ring surface 596 and an exterior circular cylindrical surface 591. Penetrating through the hollow cylinder, there is an upper cylindrical opening 592 concentrically and downwardly connected to a lower frustum shaped opening 600. This forms an interior circular cylindrical surface 594 downwardly and concentrically connected to an interior transverse ring surface 604 having an interior transverse circumference 602, and a bottom interior transverse circumference 603, wherein the interior surface 604 is an interface between the upper cylindrical opening 592 and lower frustum shaped opening 600. The circumference 602 surrounds an opening that is the top of the frustum shaped opening 600. The bottom circumference 603 surrounds a bottom opening that is the bottom of the frustum shaped opening 600. As illustrated, the circumference 602 has a smaller diameter than a larger diameter of the bottom circumference 603.

It would be appreciated that the same diameter is for the upper cylindrical opening 592 of the hollow cylinder 590, central opening of the upper transverse ring 593, and opening at the 3 or 9 o'clock position of the bottom ring 583 of the middle receiver 574, so that the three openings are connected in series to form an extending opening 592. Accordingly there is an extending interior cylindrical surface 594. Referring specifically to FIGS. 10B and 11B, the extending interior cylindrical surface 594 upwardly extends, wherein its two opposite positions are upwardly aligned with and tangentially connected to the respective interior circular cylindrical surfaces 578 and 581 of the respective exterior and interior walls 575 and 579 of the middle receiver. Therefore, the transverse circular recess 586 of air space is downwardly connected to the longitudinal extending cylindrical opening 592, which provides a pathway for combustible gases to flow into the recess 586 of air space through the bottom gas intakes 587.

It would be appreciated that, the above disclosed extending cylindrical opening 592 has the allowed maximum diameter. However in manufacturing of the burner, a diameter of the extending opening 592 could be varied according to the spirit and scope of the present invention.

In addition, a combustible gas disperser 636 is concentrically positioned inside of the extending cylindrical opening 592. As additionally illustrated in FIG. 13A, the disperser 636 has the shape of a cone, which is comprised of a bottom tip 640 connected to four identical ascending wings 638 having the respective arcuate top edges 639, wherein two adjacent wings are angularly spaced apart at a 90-degree. The top edges 639 of the respective wings forms a circle that matches a circumference of the extending circular cylindrical surface 594. The disperser 636 is positioned, which the bottom tip 640 is aligned with a center of the inner transverse circumference 602 that is also aligned with a rotational axis of the gas intake 587, and its arcuate top edges 639 of the respective wings are in contact with the interior extending surface 594 according to a press fit design. If applying a loose fit design, there will be additional positioning members affixed to the interior surface 594, which support the disperser 636 for preventing it to have a further downward sliding movement.

Figure 13A:
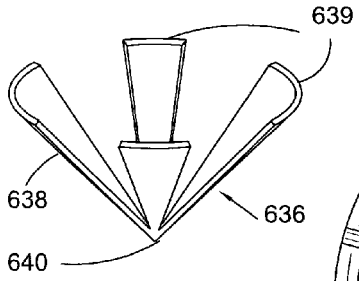
FIG. 13A is a perspective view of a first embodiment of gas dispersing means.
Figure 13B:
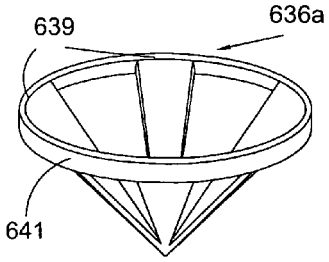
FIG. 13B is a perspective view of a second embodiment of the gas dispersing means as compared with that shown in FIG. 13A.
Figure 14:
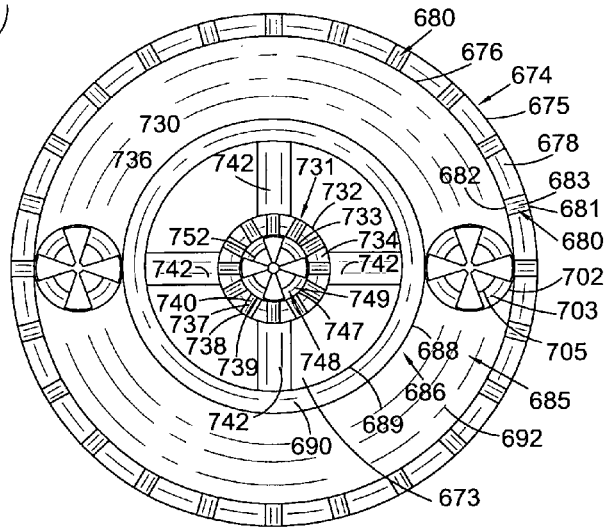
FIG. 14 is a top plain view of a middle circular gas mixture receiver of the outer flame ring and a middle hollow cylinder of the inner flame ring from a second embodiment of the invented burner.

FIG. 13B illustrates a modified gas disperser **636*a* as compared with that of FIG. 13A, which includes an additional exterior cylindrical ring 641 connected to the top edges 639 of the respective wings. The ring 641 matches a diameter of the interior opening 592. It would be appreciated that an advantage of the modified disperser 636*a*** is easy for its installation, which is also easy for its maintenance and repair.

Figure 10A:
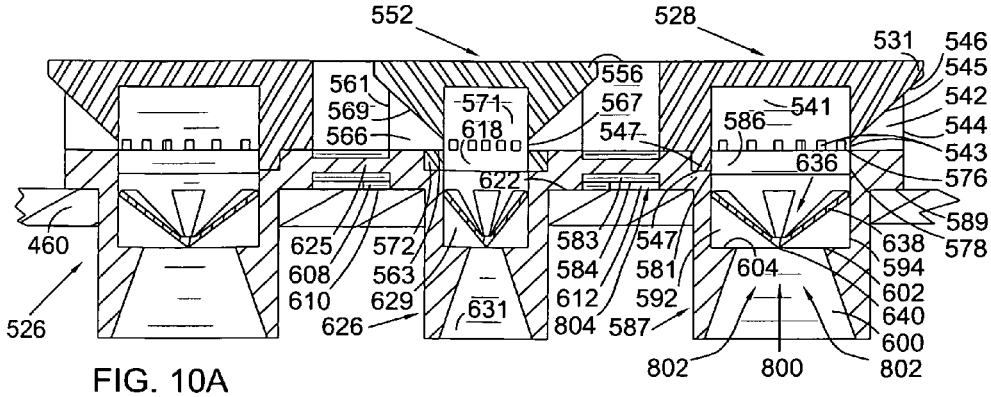
FIG. 10A is a cross sectional view of a first embodiment of an invented burner from the present invention including inner and outer flame rings positioned to a burner receiving protrusion of the stove, where the cross section is taken along A-A line of FIG. 7A.
Figure 10B:
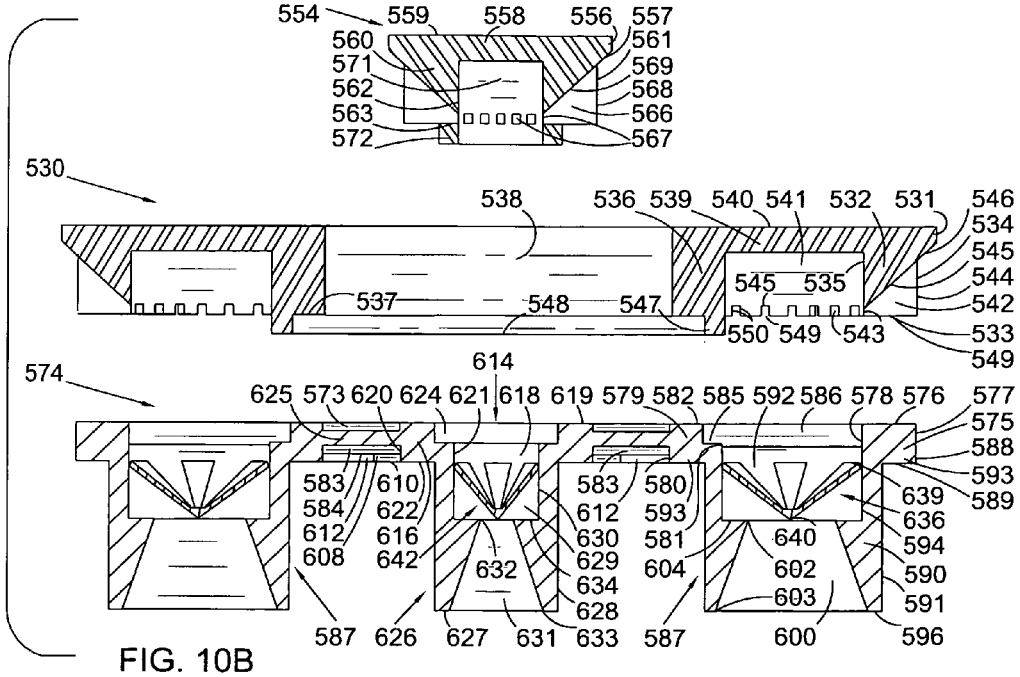
FIG. 10B is an exploded cross sectional view of the first embodiment of the invented burner according to the cross sectional view of FIG. 10A.
Figure 10C:
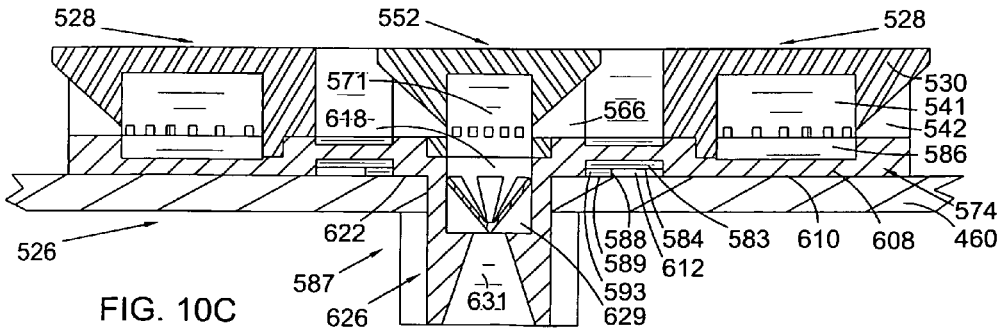
FIG. 10C is a cross sectional view of the first embodiment of the invented burner positioned to the burner receiving protrusion of the stove where the cross section is taken along the B-B line of FIG. 7A, which compares with the view shown in FIG. 10A.

Additionally referring to FIGS. 10A and 10C, the top ring cover 530 is positioned to mate with the middle circular gas mixture receiver 574, wherein the bottom ring surface 533 of the cover matches the top ring surface 576 of the receiver, and the downward circular protrusion 547 is connected to the inner circular shelf 585. Therefore, the connected top ring cover and middle receiver are defined as the upper section of the outer flame ring.

In this setting, the plurality of the downward slots 542 of air space are turned into the respective gas ports having the respective ascending interior top surfaces 545, wherein the inward and outward openings are the respective smaller inlets 543 and larger outlets 544. In addition, the interior downward transverse circular recess 541 of the top ring cover is connected to the interior upward transverse circular recess 586 of the middle receiver, which forms a chamber for circularly passing a mixture of the combustible gases and primary air to each of the inlets 543.

The inner flame ring 552 includes a top round cover 554, and a bottom structural member. The member is comprised of a middle hollow cylinder 614 concentrically and downwardly connected to a bottom central gas intake 626, wherein the top cover 554 and middle hollow cylinder 614 are matched to each other.

The top round cover 554 is comprised of a top round plate 558 having a top surface 559, which is connected to the top of a downward circular cylindrical wall 560 to form a downward recess 571 of air space. In addition, the top round plate 558 extends sidewards to form a circular sideward protrusion 556 having an exterior ascending ring surface 557. The wall 560 includes exterior and interior surfaces 561 and 562, and a lower transverse ring surface 563. Aligning with the interior surface 562, a bottom downward circular protrusion 572 is connected to the lower transverse ring surface 563 of the cylindrical wall.

In addition, a plurality of downward narrow slots 566 of air space are circumferentially and radially spaced apart to cut off the lower ring surface 563. Each identical slot 566 has the similar structure to that of the slot 542, including two downward sides, a transverse downward opening positioned to align with the lower ring surface 563, and rectangular smaller inward and larger outward openings 567 and 568 positioned on the respective interior and exterior surfaces 562 and 561. As illustrated, the height of the opening 568 is longer than that of the opening 567 so that the slot 566 includes an ascending interior top surface 569 that is aligned with the ascending circular ring surface 557, which is towards upwardly and outwardly.

The middle hollow cylinder 614 is comprised of a circular cylindrical wall 616 which surrounds a central opening 618, wherein the wall includes top and bottom ring surfaces 619 and 622, and exterior and interior circular cylindrical surfaces 620 and 621. A top inner circular shelf 624 is positioned to align with the top surface 619 and interior surface 621. It would be appreciated that the circular shelf 624 is for positioning the downward circular protrusion 572 of the top cover when assembling the inner flame ring, so that the circular shelf and protrusion are broadly defined as the interlocking means of the inner flame ring.

Figure 11A:
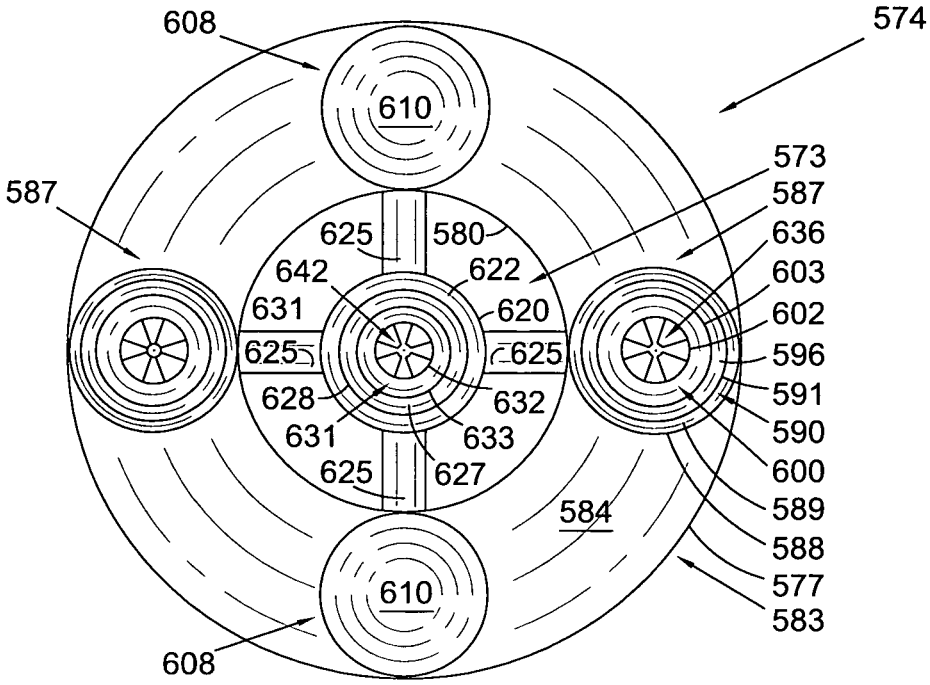
FIG. 11A is a bottom plain view of the outer flame ring and inner flame ring of the first embodiment of the invented burner.
Figure 11B:
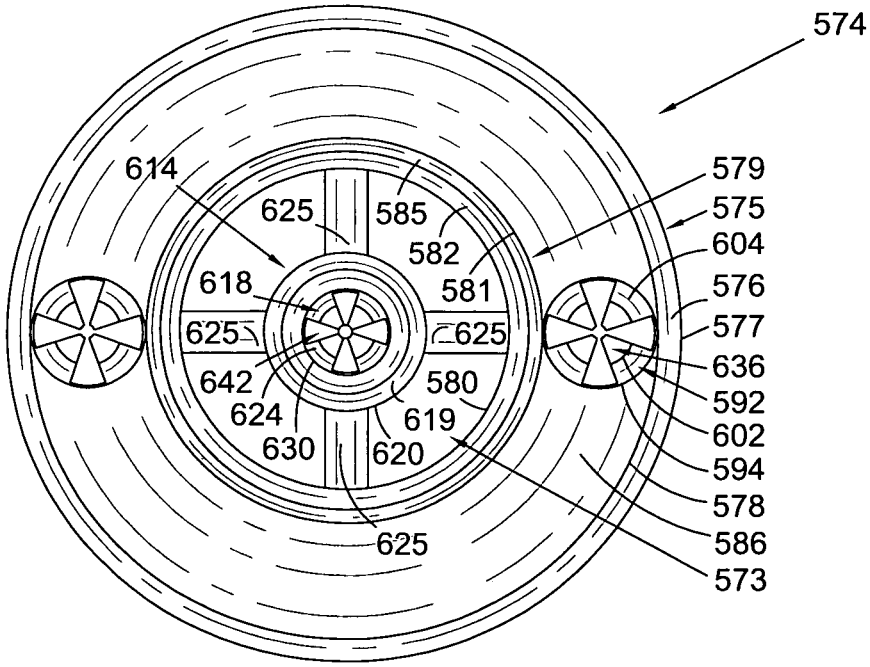
FIG. 11B is a top plain view of a middle circular gas mixture receiver of the outer flame ring and a middle hollow cylinder of the inner flame ring of the first embodiment of the invented burner.

As illustrated in FIGS. 10B, 11A and 11B, the middle hollow cylinder 614 is concentrically affixed at the center of the inner opening 573 of the middle receiver 574 through affixation of four identical bars 625 which are radially positioned, wherein two adjacent bars are apart at a 90-degree. The four identical bars 625 are connected to the exterior circular cylindrical surfaces 620 and 580 of the respective middle hollow cylinder 614 and interior wall of the middle receiver 574 along the respective four orientations, which are defined by positions of the respective 3 and 3, 6 and 6, 9 and 9, and 12 and 12 o'clock on the respective surfaces 580 and 620. In addition, the bottom ring surface 622 of the middle hollow cylinder 614 is aligned with the bottom surfaces 610 of the respective two supports 608 and middle ring surfaces 589 of the respective two side bottom gas intakes 587. The top ring surface 619 of the cylinder 614 is aligned with the top ring surfaces 582 and 576 of the middle receiver 574. As a variation of the above disclosed affixation applying four bars, at least two identical bars 625 are also appropriate, which are apart at a 180-degree, for affixing the middle receiver and hollow cylinder together.

Referring to FIGS. 10A-10C and 11A-11B, a central bottom gas intake 626 is illustrated to concentrically and upwardly connect to the bottom surface 622 of the middle hollow cylinder 614. The gas intake 626 is also a hollow cylinder including a bottom ring surface 627 and an exterior cylindrical surface 628. However, a diameter of the exterior surface 628 is smaller than that of the exterior surface 620 of the hollow cylinder 614. Penetrating through the intake, there is an upper inner cylindrical opening 629, which forms an interior circular cylindrical surface 630. The surface is aligned with and upwardly connected to the interior surface 621 of the middle hollow cylinder 614 due to a same diameter for the respective openings 629 and 618. This forms an extending opening 629 (or 618).

The extending opening 629 is further downwardly and concentrically connected to a lower inner frustum shaped opening 631. This forms the interior surface 630 downwardly and concentrically connected to an inner transverse ring surface 634 having an interior transverse smaller circumference 632, and a bottom interior larger circumference 633, wherein the ring surface 634 is an interface between the upper and lower openings 629 and 631. The smaller and larger circumferences 632 and 633 surround the respective top and bottom openings that are the respective top and bottom of the frustum shaped opening 631.

Therefore, when the top round cover 554 is positioned to mate with the middle hollow cylinder 614 of the inner flame ring, the bottom downward circular protrusion 572 is connected to the inner circular shelf 624, so that the mated top ring cover and middle hollow cylinder are defined as the upper section of the inner flame ring. In this setting, the plurality of the downward slots 566 are turned into the respective gas ports having the respective ascending interior top surfaces 569, wherein the inward and outward openings are the respective smaller inlets 567 and larger outlets 568. The interior downward round recess 571 of the cover is connected to the interior central opening 618 of the hollow cylinder to form a chamber for passing a mixture of combustible gases and primary air from the central bottom gas intake 626 to the respective gas ports 566.

As illustrated, within the cylindrical opening 629 there is a concentrically positioned combustible gas disperser 642, which has the similar structural characteristics as compared with that of the gas disperser 636, except for having a smaller conic angle and shorter wings. In addition, the gas disperser 642 will have the same structural modifications as compared with those of the modified gas disperser 636*a*. However, they will not be repeated again.

Therefore, when the round top cover 554 is positioned to mate the middle hollow cylinder 614 of the inner flame ring, the bottom downward circular protrusion 572 are connected to the inner circular shelf 624, so that the mated top cover and middle cylinder are defined as the upper section of the inner flame ring. In this setting, the plurality of the downward slots 566 are turned into to the respective gas ports having the respective interior ascending top sides 569, wherein the inward and outward openings are the respective smaller inlets 567 and larger outlets 568. The interior downward round recess 571 of the cover is connected to the interior central opening 618 of the hollow cylinder to form a chamber for passing a mixture of combustible gases and primary air from the central bottom gas intake 626 to the respective gas ports 566.

Further referring to FIGS. 8A, 9A, 10A, 10C and 12, the first embodiment 526 of the burner having the respective outer and inner flame rings 528 and 552 is illustrated to detachably position to the central burner receiving protrusion 460 of the burner receiving plate 458, after the two identical side bottom gas intakes 587 positioned to penetrate through the respective side openings 462, and the central bottom gas intake 626 positioned to penetrate through the central opening 464. In this setting, the upper sections of the respective outer and inner flame rings are positioned above the protrusion 460.

In addition, the bottom surfaces 610 of the respective two identical supports 608, middle transverse ring surfaces 589 of the respective two side gas intakes 587, and bottom surface 622 of the hollow cylinder 614 of the inner flame ring are in contact with the top surface of the central protrusion 460. This forms an air gap 612 between the bottom surface 584 of the middle receiver 574 and top surface of the central protrusion 460. The gap, which is more apparently illustrated in FIGS. 10A and 10C, allows a secondary air 804 that flows towards the inner flame ring 552 for involving in combustion of the combustible mixture.

As further illustrated, a gas jet supporting apparatus 486 is affixed underneath the central protrusion 460 of the plate 458. The apparatus affixes two identical side gas jets 482 for the respective two side gas intakes 587, and a middle gas jet 475 for the central gas intake 626. In addition, top surfaces 484 of the respective two side gas jets 482 are aligned with the respective bottom surfaces 596 of the respective two side gas intakes, wherein central openings of the respective two side gas jets 482 are aligned with the respective bottom tips 640 of the gas disperser 636 positioned inside of the respective two side gas intakes. Similarly, a top surface 476 of the central gas jet is aligned with the bottom surface 627 of the central gas intake, wherein an opening of the jet is aligned with the tip of the gas disperser 642.

It would be appreciated that although the positions of the respective top surfaces of the gas jets are above illustrated, it is within the spirit and scope of the present invention that the positions of the respective top surfaces 484 and 476 of the jets could be varied, according to requirements in manufacturing. It would be further appreciated that alternatively, each jet can have its own individual jet supporting member having at least two posts that are affixed to the plate 458.

Figure 7A:
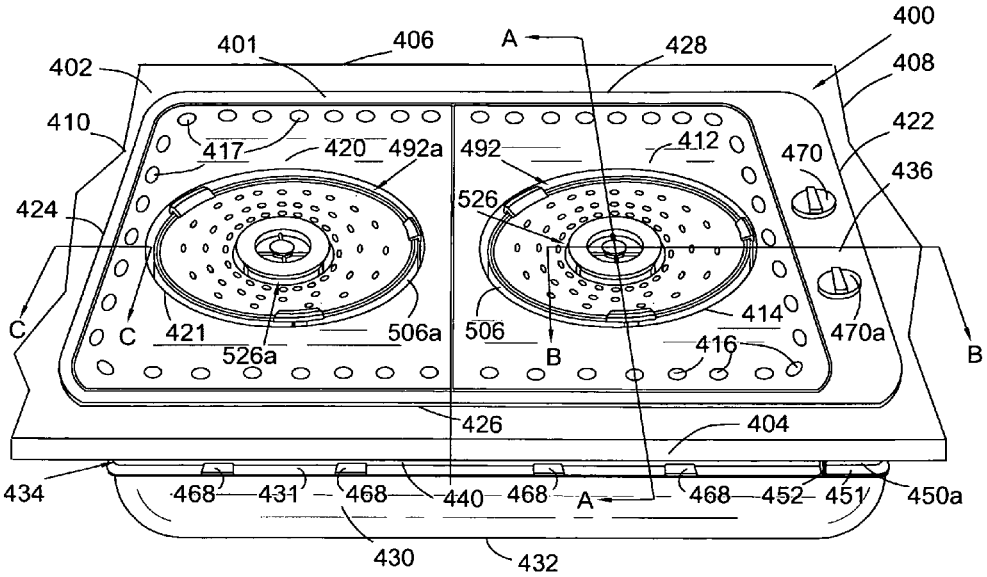
FIG. 7A is a perspective view of a first embodiment of the present invention gas stove.
Figure 7B:
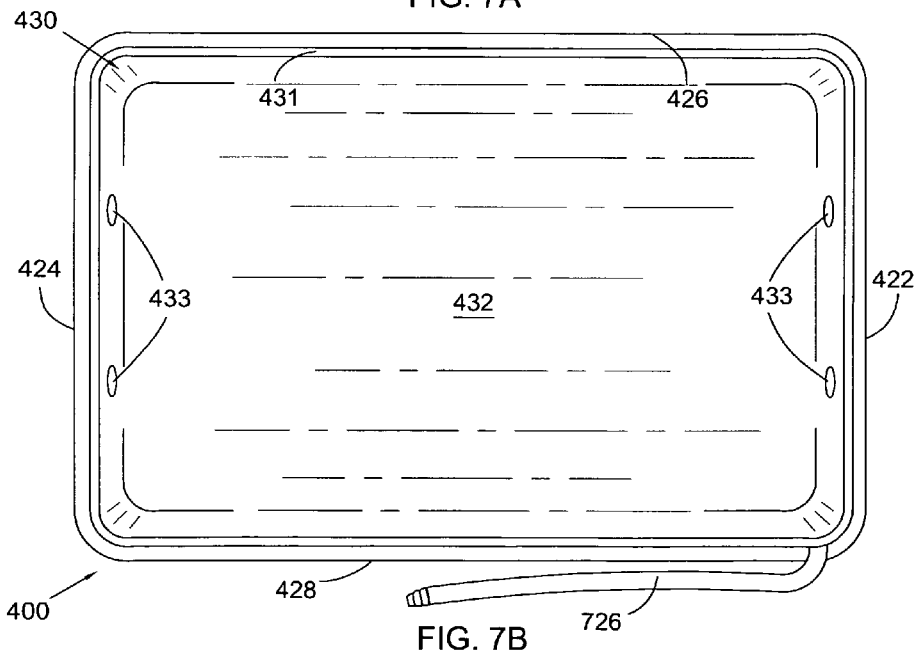
FIG. 7B is a bottom plain view of the first embodiment of the stove.

Referring further to FIGS. 7B, 8A and 9A, there is illustrated gas connection of the present invention stove. A city gas supply is connected to the flexible gas pipe 726. The pipe in turns is connected to an interior main transverse gas supply pipe 472 that is positioned adjacent to and in parallel with the interior side of the proximal end 422 of the stove. The pipe 472 is further connected to two identical bodies of the respective switches having the respective two top knobs 470 and 470*a*, wherein only one body 471 is shown in FIG. 9A. The two switch bodies are positioned onto a transverse gas switch body support 454 which is affixed to the respective supplementary upward wall 450 and inner proximal section wall 444. As illustrated, the identical gas supply switch body 471 is connected to the respective side and central jets of the burner 526 through connecting of the respective interior gas pipes 478 and 474 to thereby control gases supplied to the respective jets. In addition, the interior gas pipe 478 is additionally connected to a transverse gas distribution pipe 480, which in turns is connected to the respective two side gas jets 482.

It would be appreciated that except for the knob 470 is turned to an"off" position, the switch body 471 controls an "on" status of supplying the gases to the central jet 475 at a small fixed flow rate, so that the central flame ring 552 is served to warm food. However, the switch body 471 controls gases to the respective two side jets 482 not only on an "on" or "off" status but also at a variable rate of supplying the combustible gases. The varied rate ranges from a minimum to a maximum according to a corresponding angular position when the knob 470 is turned. Therefore, the outer flame ring 528 is served to cook food.

Referring to FIGS. 7A, 8A and 9A, there is illustrated incorporation of the first and second identical removable flame heat transfer regulating apparatus 492 and 492*a* with the respective identical burners 526 and 526*a* to form the first preferred embodiment 400 of the present invention stove. The identical apparatus 492 includes an inner hollow shell 496, outer wall 506, and cooking utensil supports 514, which are detachably integrated together. The structure of the inner hollow shell 496 is consistent with that of the inner hollow shell 202 in FIG. 4 that is discussed in Section (I) of the disclosure of the present invention. Therefore, it will not be repeated.

As illustrated, the inner hollow shell 496 includes a larger top periphery or edge 502 that surrounds a larger top opening, a smaller bottom periphery or edge 504 that surrounds a smaller bottom opening, a plurality of openings 500 serving as air passages to penetrate through upper and lower parts of the inner hollow shell. The outer wall 506 is similar to the outer circular wall 230 except for absence of at least three upward extensions 246. The wall 506 includes top and bottom peripheries or edges 510 and 512 which surround the respective top and bottom openings, and a plurality of openings 508 serving as air passages to penetrate therethrough. However, areas of the opening 508 of the outer wall 506 are larger than areas of the openings 500 of the inner hollow shell 496.

It would be appreciated that as a variation of the at least three upward extensions 246 of the outer wall 230 illustrated in FIG. 4, the present invention uses at least three identical detachable "T" shaped utensil supports 514, which are circumferentially and radially spaced apart and detachably attached to the exterior side of the outer wall 506 including by the respective fastener means such as nuts and screws. Each identical utensil support 514 includes a longitudinal post 522 having a bottom end 524. The post at its top end is connected to a transverse upward plated member 518, wherein the top end of the post 522 is positioned slight higher than a position of the top periphery 510 of the outer wall when the supports and wall are supported by the outer circular recess 467 of the burn receiving plate 458. The plated member 518 in turns at its top is connected to a transverse descending plated member 516 to thereby form a flat top 520 of the utensil support. As illustrated in FIGS. 8A and 9A, the transverse upward plated member 518 has a width which is substantially wider than a width of the longitudinal post 522. Therefore, the transverse plated member 518 can be served as a heat shield to prevent heating a handle of a utensil in cooking.

As a structural variation, the at least three supports 514 are integrated together, which are circumferentially and radially spaced apart to affix to upper and lower transverse rings, wherein the upper ring is positioned adjacent to the top ends of the respective longitudinal posts of the supports, and the lower ring is adjacent to the bottom ends. An advantage of the integrated supports is to enhance the mechanical properties of the outer wall 506 when it is made of ceramics, since the integrated supports additionally are served as a structural enhancing means after they are detachably attached to the outer wall.

The transverse upward and descending plated members 518 and 516 could be built in a fashion that matches a shape of the outer wall 506 including the arcuate shape. In addition, application of the "T" shaped utensil supports 514 as the variation of the upward extensions 246 is particularly for using ceramics to manufacture the outer wall 506 so that it is served as an excellent thermal wall, which was initially disclosed in the '940 Application. The "T" shaped utensil supports 514 made of metals or metal alloys are best for supporting utensils in cooking, wherein the flat tops 520 are for supporting utensils having the respective flat bottoms, and the transverse descending plated members 516 are for supporting utensils having the respective convex bottoms such as woks. In addition, relatively small utensils having the flat bottoms also can be supported by the descending plated members 516 in cooking. Furthermore, additional removable utensil supports, such as the supports 256, 258 and 260 disclosed in Section (I) are also appropriate according to the spirit and scope of the present invention.

As further illustrated, the inner hollow shell 496, outer wall 506 and utensil supports 514 are installed, wherein the bottom ends 524 of the respective "T" shaped supports and bottom periphery 512 of the outer wall are positioned into the outer circular recess 467, so that their movement is restricted. The inner hollow shell 496 surrounds the upper section of the burner, which includes the respective top ring cover 554 connected to the middle receiver 574, and round top cover 530 connected to the middle hollow cylinder 614. In addition, the top peripheries 502 and 510 of the respective inner hollow shell and outer wall are detachably integrated together, which are positioned in the opening 414 of the top plate 412, and further aligned with a top surface of the top removable plate 412. Therefore, the top removable plate 412 conceals the outer wall 506 and inner hollow shell 496 to thereby cause a flat top surface of the present invention stove 400, whose visual effect is in harmony with that of the horizontal surface of the partial counter top 402 where the stove is installed.

In this setting, only the transverse upward and descending plated members 518 and 516 are positioned above the top removable plate. However, it would be appreciated that in manufacturing of the stove according to the preferred embodiment discussed in the experimental section of the '940 Application, the tops 520 of the respective two members will be only at approximately 1 cm higher than the top periphery 510 of the outer wall, thus the top surface of the top removable plate 412. Therefore they will not affect the visual effect of the flat top surface of the present invention stove. It would be further appreciated that an advantage of this embodiment 400 is that any extremely large cooking utensil with the flat bottoms can be positioned onto the tops 520 of the respective utensil supports in cooking, which will not block pathways of the hot exhaust gases and air.

Figure 8B:
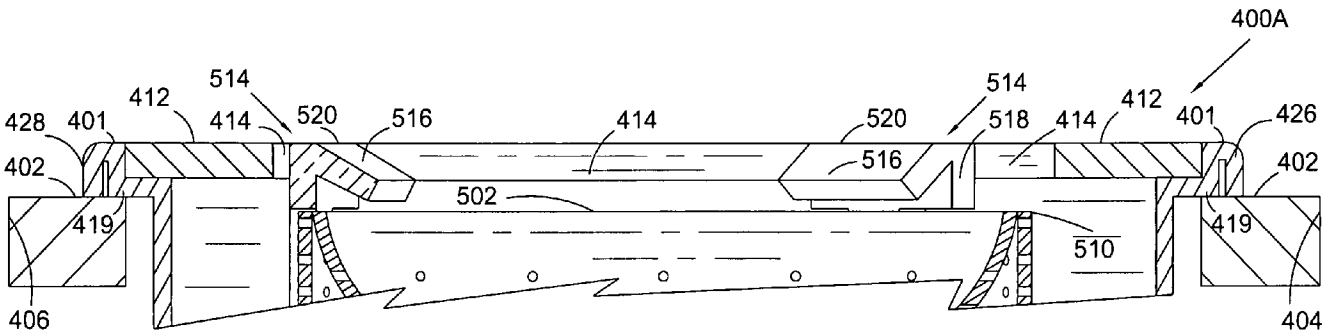
FIG. 8B is a transverse cross sectional view of a top part of a second embodiment of the stove, where tops of the respective utensil supports of the apparatus are positioned to align with a top surface of a top plate, as compared with those of the first embodiment shown in FIG. 8A.
Figure 9B:
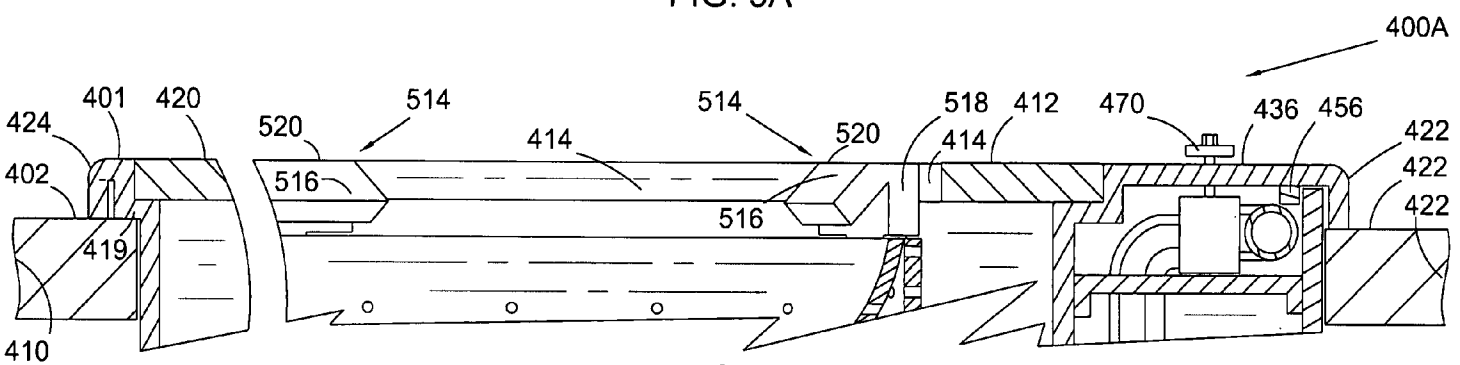
FIG. 9B is a longitudinal partial cross sectional view of a top part of the second embodiment of the stove as compared with that of the first embodiment show in FIG. 9A.

Alternatively, as a second embodiment 400A of the present invention stove illustrated in FIGS. 8B and 9B, the tops 520 of the respective "T" shaped supports are positioned to align with the top surface of the top removable plate 412. In this embodiment, a variation of the upper section 434 of the stove housing is to increase heights of the respective upward section walls 440, 442, 444 and 448 and optional complementary side wall 450. The advantage of this embodiment is to achieve the visual effect where the apparatus including "T" shaped supports are both concealed. The disadvantage is that the top removable plate 412 must be removed when using an extra large cooking utensil with a flat bottom whose diameter is equal to or larger than that of the opening 414. However, it would be appreciated that a chance of using such large utensil is relatively low in the present modern style of living, and operation of removing the top plate 412 is also convenient, so that these two embodiments 400 and 400*a* are both preferred.

As further illustrated, the bottom periphery or edge 504 of the inner hollow shell 496 is positioned above and further aligned with a middle circle of the inner circular recess 465. Therefore, in case that there is liquid drop off in cooking, the dropped liquid will be first contained by the inner hollow shell while its flowing down, and then will be collected inside of the circular recess 465. Therefore, the present invention has advantages of easily cleaning the liquid drop off through easily cleaning the circular recess 465 and removable inner hollow shell 496. Accordingly, the inner hollow shell 496 has additional structure for being detachably integrated to the outer wall 506. For example, the inner shell has a top rim at the top periphery 502, so that it can be detachably integrated to the outer wall by positioning the rim on the top periphery 510 of the outer wall. In addition, it also can apply several detachable fasteners, which penetrate through top positions adjacent to the respective top peripheries 502 and 510 of the inner hollow shell and outer wall.

It would be appreciated that following the second embodiment of the apparatus disclosed in the '521 Application, the present invention also has a second embodiment of the apparatus including a hollow shell identical to the above disclosed inner hollow shell 496, which is detachably attached to the at least three integrated utensil supports, for example, from positioning the top rim of the hollow shell onto the upper ring of the integrated utensil supports.

Similarly, the second apparatus 492*a* incorporated with the second burner 526*a* can be positioned onto the second protrusion 460*a*, which is identical to the above illustration for the first apparatus 492 in two embodiments and burner 526. Therefore, it will not be repeated.

As disclosed, the objects of the present invention are two folds. The first one is to achieve the ornament of the stove from concealing components of the apparatus so that the visual effect of the flat top surface of the stove installed into a counter top is consistent with that of the horizontal surface of the counter top in a kitchen. This object is achieved by the present invention stove having structure which includes the top plates 412 and 420.

The second one is increase of the heating efficiency of the flame to thereby save combustible gases and reduce production of carbon dioxides, the greenhouse gases in cooking. In order to achieve a high heating efficiency, there are several aspects which must be realized. The first aspect is to reduce loss of heat during the heat transfer. This aspect has been mainly accomplished by application of the removable heat transfer regulating apparatus that focuses heat on a utensil in cooking, and by application of the improved gas ports that control appropriate angular patterns of the flame.

The second aspect is to cause heat conduction as a major pattern of transferring heat to the utensil. This aspect has been accomplished by application of the improved gas ports having the respective identical ascending interior top surfaces. Therefore, tops of the flame having the same ascending angle from the improved gas ports are directly in contact with the bottom surface of a cooking utensil thereby causing the heat conduction as the major pattern of the heat transfer to heat the utensil in the present invention when applying the combustible gaseous mixture at a large to maximum flow rate to the gas ports. This is advantageous for an efficient heat transfer to utensils made of metal that are good heat conductors, when the flame top having the highest temperature directly comes into contact with utensil. In contrast, the heat radiation and convection serve as the major patterns of the heat transfer in the prior art stoves, which are less efficient due to various physical factors including the flame transverse elongation, chilling effect, and utensils made of metal to thereby be poor receptors of the radiated thermal energies.

The third aspect is to increase a degree of completely combusting the combustible gaseous mixture by increase of supplying the secondary air in the combustion. This aspects can be resolved according to a concept of reducing speed of the combustible gaseous mixture when it departs from outlets of the gas ports and is ignited. Such speed reduction has been practically accomplished by application of the improved gas ports, which have the ascending interior top surfaces to thereby have the gradually enlarged longitudinal cross sectional areas perpendicular to a flow direction of the gaseous mixture. Such structure of the gas ports gradually reduces speeds of the combustible gaseous mixture when flowing inside of the gas ports, so that the mixture has reduced speeds at outlets of the respective gas ports.

There are two folds of advantages regarding the combustible gaseous mixture having the reduced speeds. First, it increases a chance for much surrounding air serving as the secondary air to involve in combustion of the mixture. This is critical for achieving completion of the combustion since a rate of supplying the secondary air is a limiting fact as compared with a rate of combusting the mixture in the presence of the secondary air. In addition, a more completed combustion generates a flame having a higher temperature to thereby achieve a higher efficiency of heating the utensil as compared with a flame from a less completed combustion. Second, it generates a hot thermal medium of exhaust gases and air that also has the reduced speed. This increases a time when the hot thermal medium is in contact with thus heats the utensil in cooking to thereby additionally increase the heating efficiency.

The above illustrated three aspects have been reached in the '940 Application, which additionally includes the experiment results of increase of 23% heating efficiency. Therefore, referring to FIG. 7A, the present invention includes a plurality of the optional side openings 416 and 417 on the respective top plates 412 and 420, which are served as air passages for supplying the surrounding air as the secondary air to the upper section of the burners 526 and 526*a* to thereby achieve completion of combusting the combustible gaseous mixture.

Figure 17A:
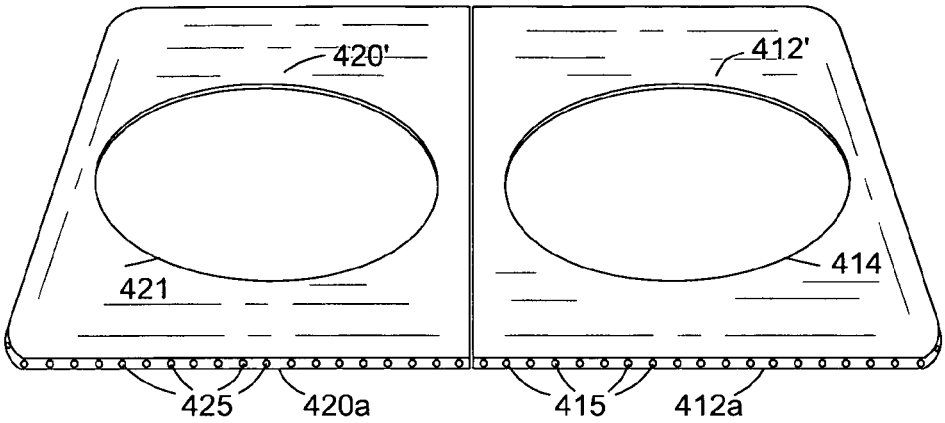
FIG. 17A is a perspective view of two top flat plates, which illustrates an alternative embodiment of the plates including the air passages for the environmental air serving as the secondary air to flow towards upper section of the respective invented burners.

Alternatively, FIG. 17A illustrates additional embodiments of the air passages positioned on the respective top plates 412' and 420' according to the spirit and scope of the present invention including the ornament of the stove. As illustrated, a plurality of openings 415 are positioned to penetrate through a front downward rim 412*a* of a first plate 412', wherein the rim 412*a* is connected to a front side of the first plate. Therefore, the openings 415 are served as the air passages for the surrounding air to flow towards the upper section of the burner 526, when a bottom edge of the rim 412*a* is positioned onto the shelf 419 of the integrated sheet structure 418 of the stove after installation of the first flat plate 412'. Similarly, openings are also positioned to penetrate through downward rims (not shown), which are connected to the respective rear side and right flank of the plate 412', wherein the right flank is adjacent to the switch panel 436. It would be appreciated that the second flat plate 420' is a mirror image of the first plate 412', therefore openings are positioned to penetrate through side downward rims including a plurality of openings 425 that penetrate through the front downward rim 420*a*.

Figure 17B:
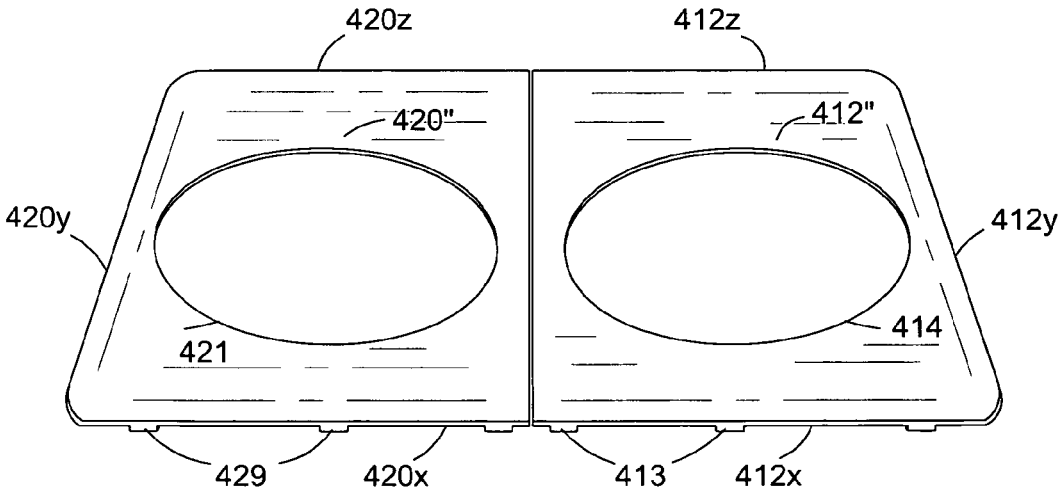
FIG. 17B is a perspective view of the two top flat plates for an additional embodiment of the plates including the air passages as compared with the embodiment shown in FIG. 17A.

As compared with the openings shown in FIG. 17A, a plurality of downward short extensions 413, such as downward short posts are connected to a front side 412*x* of the first flat plate 412" in FIG. 17B. This creates air gaps serving as the air passages for the surrounding air to flow towards the upper section of the burner, when bottom ends of the respective extensions 413 are positioned onto the shelf 419 of the integrated sheet structure 418 after installation of the first flat plate 412". Similarly, extensions (not shown) are also positioned to connect to the respective rear side 412*z* and right flank 412*y* of the plate. It would be appreciated that such extensions are also positioned to downwardly connect to the corresponding sides of the second flat plate 420". In addition, high temperature rubber members, similar to the members 141 illustrated in FIG. 5 can be positioned to bottoms of the respective extensions to thereby protect the smooth surface of the shelf 419. In this setting, the present invention can design additional structure onto the shelf 419, so that movement of the respective plates 412', 412", 420' and 420" is restricted when they are positioned onto the shelf while maintaining a sufficient air flow. In addition, top surfaces of the respective above illustrated flat plats can be positioned slightly higher than top surface of the outer rim 401 if it is necessary.

The fourth aspect is to increase a homogeneity of mixing the combustible gases and primary air, which is fundamental to achieve completion of combusting the combustible gaseous mixture. This aspect is accomplished by the present invention which applies the combustible gas dispersers 636 and 642 that are broadly defined as the combustible gas dispersing means, and which applies the hollow cylinders 590 and 626 having the respective cylindrical openings connected to the respective frustum shaped openings to thereby be defined as the respective combustible gas-primary air mixers wherein the cylindrical opening connected to the frustum shaped opening is defined as the combustible gas-primary air mixing structure.

Referring to FIGS. 8A, 10A and 10B, there is illustrated application of the side bottom gas intake 587 regarding its function of mixing the combustible gases and primary air. According to the fluid dynamics, the combustible gases 800 increase upward speeds when they flow inside of the frustum shaped opening 600 towards the cylindrical opening 592 after their departing from the side gas jet 482. This is due to the frustum shaped opening 600 which gradually reduces areas of the respective transverse cross sections perpendicular to a direction of the flowing gases 800. Therefore further according to the fluid dynamics, the flowing gases 800 having increased speed drag more exterior surrounding air 802 positioned adjacent the gas intake 587 into the frustum shaped opening 600, wherein the air is served as the primary air 802. This initiates mixing of the gases 800 and primary air 802, which produces a substance including a mixture of the gases and primary air, unmixed gases 800 and primary air 802.

However, after its passing the interface of the ring surface 604 to enter the cylindrical opening 592, the substance sharply reduces its upward flowing speed as compared with a speed of the substance before passing the interface 604. This is because of a sudden transition between a smaller cross sectional area defined by the circumference 602 and a larger cross sectional area of the opening 592, as the substance flows therethrough. Therefore, it forms a turbulent flow of the substance, which happens in the cylindrical opening 592 adjacent the transverse ring surface 604. The formed turbulent flow will enhance mixing the combustible gases 800 with primary air 802 to thereby be advantageous for producing a homogeneous combustible gaseous mixture.

In terms of an alternative way to manufacture the burner 529, a hollow cylinder having the frustum shaped opening 600 can be separately produced, which is when press-fit into the opening 592 to form the side gas intake 587.

It would be appreciated that, besides the hollow cylinder having the frustum shaped opening connected to the cylindrical opening disclosed above, various other components also can cause turbulent flow of the gaseous mixture, such as a rough interior surface of an opening, or transverse protrusions positioned on the longitudinal interior surface of an opening. Therefore, any component is appropriate if it can generate the turbulent flow to enhance mixing the combustible gases 800 with primary air 802 according to the spirit and scope of the present invention. In the mean time, the component would not significantly resist the gases 800 to flow. In this sense, the component can be broadly defined as the combustible gas-primary air mixing means.

Following the above disclosed concept, the present invention designs a plurality of openings 433 illustrated in FIG. 7B that are positioned on the side wall of the lower section 430 of the housing. They are the respective air passages for passing the surrounding air serving as the primary air 802 to reach including the intakes 587 and 626 of the burner.

It can be realized that the flowing combustible gases 800 is more concentrated to distribute along a rotational axis of the gas intake when their first entering the frustum shaped opening 600, which will then gradually and naturally disperse away from the rotational axis. Since in the presence of the gas disperser 636, the combustible gases 800 that flow upwardly and densely along the rotational axis will be mechanically and forcibly dispersed first by the tip 640 of the disperser and second by the respective wings 638. The result is that it enhances mixing the combustible gases 800 with primary air 802 when the combustible gases is dispersed.

Application of the gas disperser in the present invention stove is advantageous particularly to use liquid petroleum gases for achieving a homogeneous combustible mixture. This is because the petroleum gases having a relatively larger average molecular weight are difficult to be naturally dispersed when it flows out of a pressured container and into the burner, as compared with the city supplied combustible gases having a smaller average molecular weight. Therefore, it frequently causes a problem of incomplete combustion of the liquid petroleum gases using the prior art gas stoves due to a cause of incompletely mixing the gases with primary air. With the aid of the gas disperser, the present invention stove can resolve the problem to thereby be appropriate for using both liquid petroleum gases and city supplied combustible gases.

Various variations are available for the above disclosed gas disperser 636. First, it is appropriate if the disperser has at least two wings. Second, each of the at least two wings has structure similar to a blade of the propeller. Third, any mechanical structure is appropriate, which disperses but not apparently resists the combustible gases to flow according to the spirit and scope of the present invention. In this sense, the varied structure relative to the gas disperser 636 is more broadly disclosed as the combustible gas dispersing means.

Figure 15A:
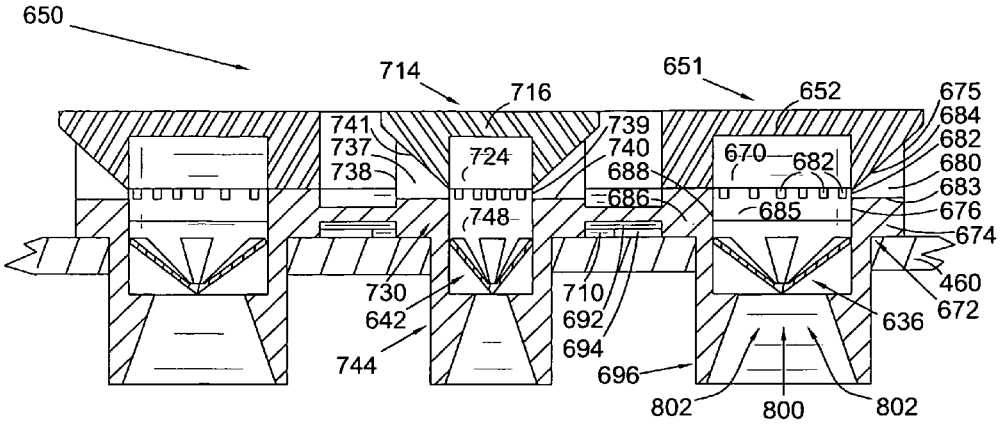
FIG. 15A is a cross sectional view of a second embodiment of the invented burner, where the cross section is taken along A-A line of FIG. 7A.
Figure 15B:
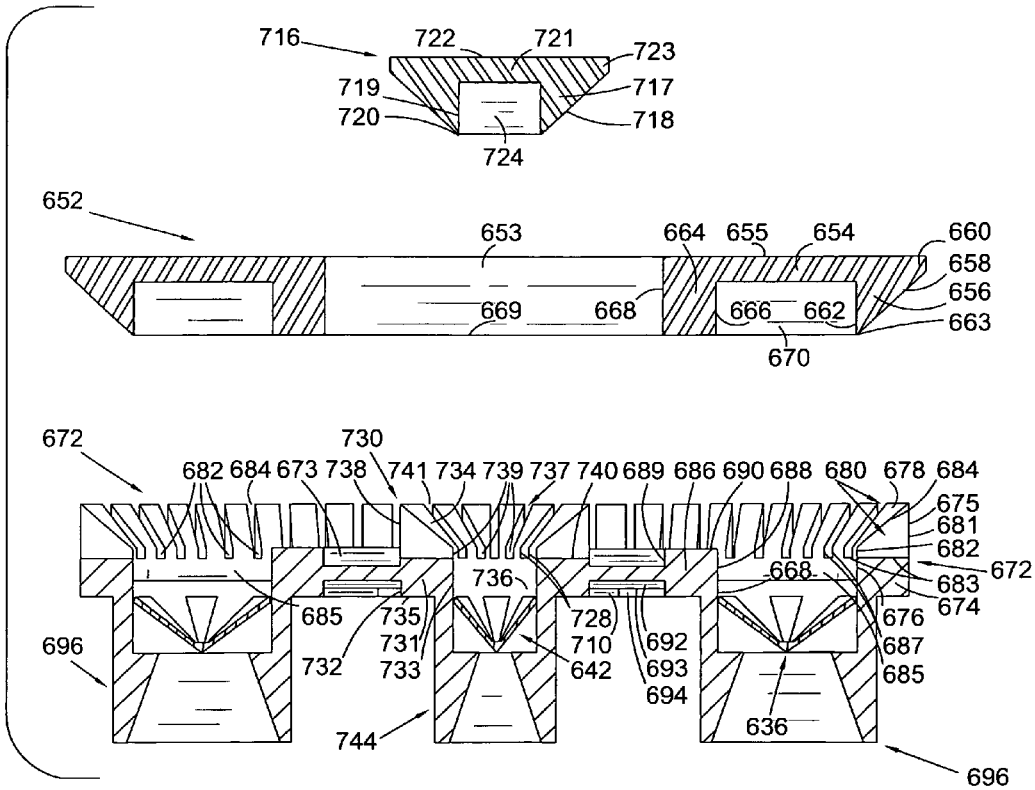
FIG. 15B is an exploded cross sectional view of the second embodiment of the invented burner shown in FIG. 15A.

It would be appreciated that, the present invention improved gas ports are not limited to position to a top ring cover of the flame ring. In stead, they can be positioned to including "the circular wall 342 of the hollow neck 340 of the burner " for achieving the same effect, which is disclosed in Section (II) of this disclosure. Referring to FIGS. 15A and 15B, there is illustrated second preferred embodiment 650 of the burner of the present invention including outer larger and inner smaller flame rings 651 and 714, which possesses the above illustrated structural characteristics regarding locations of the improved gas ports.

The outer flame ring 651 includes a top ring cover 652 and a bottom structural member having a middle circular gas mixture receiver (middle receiver) 672 connected to the respective two identical left and right side bottom gas intakes 696 and two identical bottom supports 710, wherein the top cover 652 and middle receiver 672 are matched to each other. As compared with the outer flame ring 528 of the first embodiment 526, the outer flame ring 651 of the second embodiment 650 is different only in its top ring cover 652 and middle receiver 672, which differ from the respective top ring cover 530 and middle receiver 574 of the first embodiment 526. This means that the bottom gas intakes 696 and bottom supports 710 of the second embodiment are identical to the respective bottom gas intakes 587 and bottom supports 608 of the first embodiment, including the inside positioned identical gas dispersers 636. Therefore for reducing the length of this application, disclosure of the side bottom gas intakes 696 and supports 710 will not be repeated.

The top ring cover 652 has the shape of an inverted frustum of a cone, composing a central opening 653 surrounded by interior and exterior cylindrical walls 664 and 656. A top transverse ring 654 is connected to tops of the respective walls 656 and 664 to form a top transverse surface 655, a downward interior circular recess 670 of air space, and a circular sideward protrusion 660 having an exterior circular ring surface. The interior cylindrical wall 664 includes an exterior circular cylindrical surface 668 and bottom ring surface 669. The exterior cylindrical wall 656 includes an inverted frustum shaped exterior surface 658 that is a circular ascending ring surface, which is connected to and aligned with the exterior circular ring surface of the circular sideward protrusion 660. The exterior wall 656 also includes an interior circular cylindrical surface 662 which intercepts the exterior ascending surface 658 to thereby form a bottom circumference 663 that is aligned with the bottom ring surface 669 of the interior cylindrical wall.

The middle receiver 672 is comprised of a central opening 673 surrounded by exterior and interior cylindrical walls 674 and 686, wherein a bottom transverse ring 692 is connected to bottoms of the respective walls to form an upward interior circular recess 685 of air space and bottom ring surface 693. The interior cylindrical wall 686 includes a top ring surface 690 and exterior and interior circular cylindrical surfaces 689 and 688. The exterior cylindrical wall 674 includes exterior and interior circular cylindrical surfaces 675 and 676, and an inverted frustum shaped top surface 678. The top surface 678 is identical to the inverted frustum shaped exterior surface 658 of the top ring cover, which creates a recess of air space to lock the top ring cover in assembling the outer flame ring 651.

A plurality of identical upward narrow slots 680 of air space are circumferentially and radially spaced apart to the exterior cylindrical wall 674, which cut off the top surface 678. Each identical slot 680 is an outwardly expanding section, which is similar to the slot of the first embodiment 528 of the outer flame ring. The slot 680 includes two identical upward sides 687, an inner transverse bottom surface 683, rectangular smaller inward and larger outward openings 682 and 681 positioned on the respective interior and exterior surfaces 676 and 675. As illustrated, a height of the opening 681 is longer than that of the opening 682, so that the identical slot 680 further includes an ascending opened top surface 684 that is aligned with the top surface 678, which is towards upwardly and outwardly. In this setting, each identical side 687 has the shape of a right angled trapezoid, which is consistent with the cross sectional view of the slot 680 in FIG. 15B.

As further illustrated in FIGS. 15A and 15B when the top ring cover 652 is positioned to mate with the middle receiver 672, the inverted frustum shaped exterior circular surface 656 of the cover matches the inverted frustum shaped top surface 678 of the receiver, and the top ring cover is positioned to the recess of the air space which is defined by the top surface 678 of the receiver, so that the top ring cover 652 is locked. Therefore, the mated exterior surface 656 and top surface 678 of the respective top ring cover and middle receiver are served as interlocking means of the outer flame ring 651. The mated ring cover 652 and middle receiver 672 are defined as the upper section of the outer flame ring.

In this setting the bottom circumference 663 of the cover is longitudinally aligned with and connected to the interior surface 676 of the receiver and tops of the respective rectangular inward openings 682 of the slots 680. Therefore, the upward slots 680 of air space are turned into the respective gas ports having the respective ascending interior top surfaces 684, wherein the inward and outward openings are the respective smaller inlets 682 and larger outlets 675. In addition, the interior transverse downward circular recess 670 of the top ring cover is connected to the interior transverse upward circular recess 685 of the middle receiver to form a chamber for circularly passing a mixture of the combustible gases and primary air from the bottom gas intakes 696 to each of the inlets 682.

Referring to FIGS. 15A and 15B, the inner flame ring 714 includes a top round cover 716 and bottom structural member comprising a middle hollow cylinder 730 concentrically and downwardly connected to a bottom central gas intake 744, wherein the top round cover and middle hollow cylinder are matched to each other. As compared with the inner flame ring 552 of the first embodiment 526, the inner flame ring 714 of the second embodiment 650 is different only in its top round cover 716 and middle hollow cylinder 730, which differ from the respective top round cover 528 and middle hollow cylinder 614 of the first embodiment 526. This means the gas intake 744 and its inside positioned gas disperser 642 are identical to those of the first embodiment, so that they will not be repeated. In addition, a way of connecting the middle hollow cylinder 730 to the middle receiver 672 of the second embodiment 650 is identical to the way of connecting the middle hollow cylinder 614 to the middle receiver 574 of the first embodiment 526, so that the connection of the middle receiver 672 and hollow cylinder 730 will not be repeated including formation of an air gap 694 which is identical to the air gap 612 of the first embodiment.

The top round cover 716 has the shape of an inverted frustum of a cone, comprising a downward circular cylindrical wall 717 having an inverted frustum shaped exterior surface 718 which at its top is connected to a top round plate 721 having a top surface 722 to form a downward round recess 724 of air space and a circular sideward protrusion 723 with an exterior circular ring surface that is aligned with and connected to the exterior surface 718. In addition, an interior circular cylindrical surface 719 of the wall intercepts the exterior surface to form a bottom circumference 720 of the recess.

The middle hollow cylinder 730 is comprised of a circular cylindrical wall 731 having a central opening 736. The wall has a bottom ring surface 735, exterior and interior circular cylindrical surfaces 732 and 733, and an inverted frustum shaped top surface 734 that surrounds a recess of air space. A plurality of identical upward narrow slots 737 of air space are circumferentially and radially spaced apart on the cylindrical wall 731 to thereby cut off the top surface 734. Each identical slot 737 is similar to the slot 680 of the middle receiver 672, including two upward sides 728, a transverse interior bottom surface 740, and rectangular smaller inward and larger outward openings 739 and 738 positioned on the respective interior and exterior surfaces 733 and 732. The opening 738 has a height that is longer than that of the opening 739, so that the slot 737 further includes an ascending opened top side surface 741. The opened top surface is aligned with the top inverted frustum shaped top surface 734, which is towards upward and outward.

Therefore, as additionally illustrated in FIG. 15A, when the top round cover 716 is positioned to mate with the middle hollow cylinder 730, the inverted frustum shaped exterior surface 718 of the cover matches the top inverted frustum shaped top surface 734 of the cylinder. The top round coved 716 is positioned to the recess of the space of the cylinder 730 to thereby be locked, so that the mated surfaces 718 and 734 are served as the interlocking means. The connected round cover 716 and middle hollow cylinder 730 are defined as the upper section of the inner flame ring. In this setting, the bottom circumference 720 of the cover is connected to the interior surface 733 of the cylinder and tops of the respective rectangular openings 739 of the respective slots 737. The result is that the upward slots 737 of air space are turned into the respective gas ports having the respective ascending interior top surfaces 741, wherein the inward and outward openings are the respective smaller inlets 739 and larger outlets 738. In addition, the central downward round recess 724 of the cover is connected to the extended interior central opening 748 of the hollow cylinder to form a chamber for passing a mixture of the combustible gases and primary air from the bottom central gas intake 744 to the respective gas ports 737.

It would be appreciated that, as illustrated in FIG. 6C, the improved gas ports are also positioned onto the top 304 of the top cover 302 of the burner. Following this concept, the present invention includes a third embodiment of the burner, which can be modified according to one of the disclosed two embodiments 526 and 650.

Figure 16A:
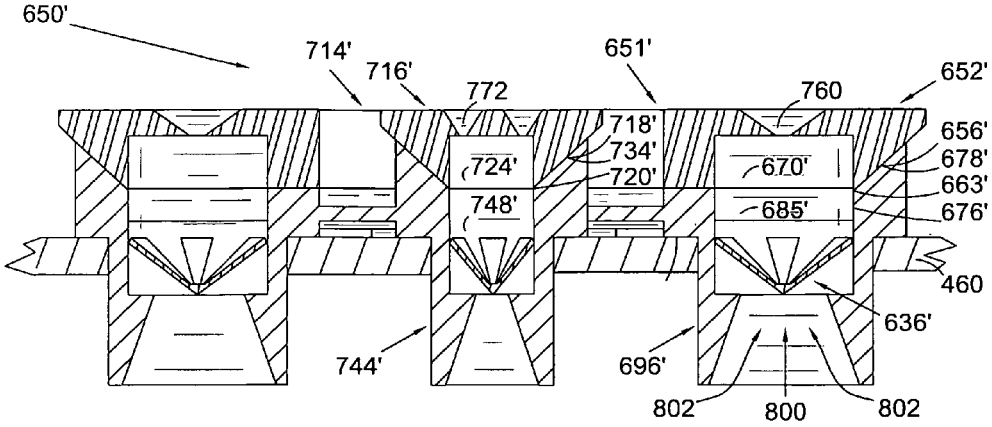
FIG. 16A is a cross sectional view of a third embodiment of the invented burner, wherein the cross section is taken along A-A line of FIG. 7A. The third embodiment is a variation of the second embodiment, wherein the improved gas ports are positioned to penetrate through tops of the respective top ring cover of the outer flame ring and top round cover of the inner flame ring.
Figure 16B:
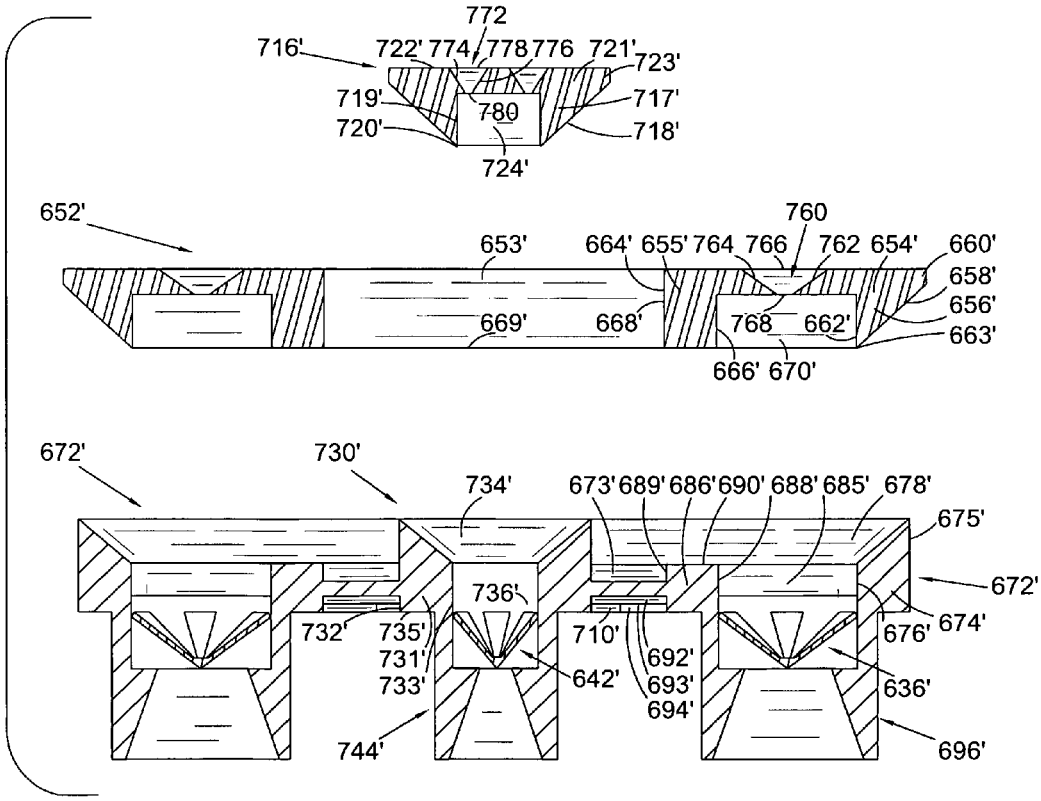
FIG. 16B is an exploded cross sectional view of the third embodiment of the invented burner shown in FIG. 16A.

Referring to FIGS. 16A and 16B, there is illustrated third embodiment 650' of the burner comprising a larger outer flame ring 652' and smaller inner flame ring 714'. The embodiment is modified according to the second embodiment 650 of the burner, so that it differs from the second embodiment 650 only in the improved gas ports and positions where they are located. For reducing the length of this disclosure, it will not repeat structural elements of the embodiment 650' identical to those of the embodiment 650. These elements are labeled in FIGS. 16A and 16B by the respective same numbers as those of the embodiment 650 but followed with an additional sign of apostrophe.

The top ring cover 652' of the outer flame ring 651' includes a plurality of openings 760 serving as the improved gas ports 760 in two embodiments that are the respective upwardly expanding sections. The openings are circumferentially and radially spaced apart to penetrate through the top ring 654'. As a first embodiment, each identical gas port 760 is a narrow slot of air space in the shape of an inverted isosceles trapezoid. It includes a first ascending surface 762 towards outside, second ascending surface 764 towards inside, transverse top opening 766 positioned to align with the top surface of the top ring cover 652', transverse bottom opening 768 connected to the downward circular recess 670' of air space, and two identical upward sides (not shown) having the same shape of the inverted isosceles trapezoid as that of the cross section shown in FIGS. 16A and 16B. As a second embodiment, the identical opening 760 has the shape of an inverted frustum of a cone, and includes a smaller transverse round bottom opening 768 connected to the downward circular recess 670' of air space, a larger transverse round top opening 766 positioned to align with the top surface of the top ring cover, and a circular ascending surface 762.

Similarly, the top round cover 716' of the inner flame ring 714' includes a plurality of openings serving as the improved gas ports 772 similar to those openings 760 of the outer flame ring, which are circumferentially and radially spaced apart to penetrate through the top round plate 721'. As a first embodiment, each identical gas port 772 is a narrow slot of air space, including a first ascending surface 774 towards outside, second ascending surface 776 towards inside, transverse top opening 778, transverse bottom opening 780 connected to the downward round recess 724' of air space, and two identical sides (not shown) having the same shape of the inverted isosceles trapezoid as that of the cross section shown in FIGS. 16A and 16B. As a second embodiment, the identical opening 772 has the shape of an inverted frustum of a cone and includes a smaller transverse round bottom opening 780 connected to the downward round recess 724' of air space, a larger transverse round top opening 778, and a circular ascending surface 774.

It would be appreciated that the above disclosed second and third embodiments 650 and 650' of the invented burner will have the same effect to disperse thus mix the combustible gases 800 with primary air 802 for achieving a homogeneity of the gaseous mixture, which has been discussed for the first embodiment 526. In addition, the disclosed three embodiments of the invented burners are incorporated with the optimum parameters that have been disclosed in the '940 Application, wherein the parameters including the optimum 19 cm diameter of the top periphery of the inner hollow shell, and maximumly optimum 8 cm diameter of a circle aligned with outlets of the respective gas ports of the outer flame ring, the optimum distance ranging from 2.5 cm to 3 cm between a top position of an outlet of a gas port and bottom surface of a cooking utensil that have the optimum diametrical size ranging from 15 to 20 cm.

Each above disclosed burner also includes one or two electronic lighters for igniting the combustible mixture, which structure can be found elsewhere. In addition, each burner could be a single flame ring configuration, including one of the respective central flame rings 552, 714 and 714'. It would be appreciated that, the top ring covers and top round covers of the respective three embodiments also include the respective circular recesses of air space. Each recess is similar to the circular recess 346 in FIG. 6D, but will not be repeated.

It would be additionally appreciated that the stove embodiment 400 (400*a*) disclosed above is a stand alone mode to thereby have the lower section 430 and complementary wall 450 of the housing. However, they can be eliminated if manufacturing an appliance which has a top gas stove of the present invention that is combined with a bottom oven.

It would be another appreciated that the present invention is also for a stove having multiple (three or more) burners although the above disclosure is based on the stove in the dual burner configuration. For example, a stove can have four burners. Each burner is surrounded by an individual removable apparatus. Accordingly, an extending top plate is positioned to conceal two side-by-side positioned apparatus. The extending top plate can be a combination of the first and second plates 412 and 420 illustrated in FIG. 7A that are combined together. Alternatively, the present invention is another for a stove of a single burner. In this embodiment, the stove will only have one set of including the burner 526 (or 650, or 650'), inner hollow shell 476, outer wall 506, a single gas switch and at least three utensil supports 514, which is incorporated with a housing that has all the same disclosed structural characteristics but a half of the length identical to the length of the front end 426 of the top rim including a single top plate 412. It would be appreciated that the embodiments of multiple or single burner of a stove are only related to the dimension expansion or reduction for those related structural components, which are obvious to one of ordinary skill in the art, so that the embodiments will not be illustrated.

It would be another additionally appreciated that, when the present invention stove is used in cooking, there may be a chance that the two top plates 412 and 420 could be heated due to the heat transfer of conduction. This is because a portion of the heat originally from one or two heated burners in cooking could be transferred first through the sheet structure 418 including the interior shelf 419 which is in contact with the two top plates positioned thereon. Therefore referring to FIG. 12, the present invention stove can additionally have a plurality of side openings 459 positioned onto the plate 458, if a temperature of the top plates 412 and 420 is a concern for a safe usage of the stove. The openings 459 are positioned adjacent to a closed rectangular joint where the upward section walls 440, 442, 444 and 448 are connected to the bottom transverse plate 458, so that they increase resistance of the heat conduction to thereby resolve the concerned problem. Meanwhile, the openings also are served as air passages for passing the secondary air to the upper sections of the respective burner embodiments 526, 650 and 650'.

This structural configuration also brings an embodiment of top plates without having optional side openings 416 and 417 illustrated in FIG. 7A. In this configuration, the surrounding air adjacent the bottom 432 of the housing passes through the openings 433 to enter the lower section 430, wherein a portion of the air is served as the primary air 802. The rest of the air continually and upwardly flows to pass through the openings 459, which is served as the secondary air to involve in combustion. In this situation, the air which does not involve in combustion upwardly flows away through the central openings 414 and 421, and the gaseous exhausts flow away through the top opening of the inner hollow shell 472. It would be appreciated that this structural configuration causes an air flow pattern, where the bottom cold surrounding air flows towards the burners and top hot air and gaseous exhaust flow upwardly, which is similar to the natural pattern of air flow in combustion of combustibles.

In addition, the present invention can apply the top plates having the downward supports disclosed in FIGS. 17A and 17B, which can additionally increase resistance of such heat transfer of conduction. A further solution is to change the mode of the surface contact into a mode of the point contact, when the round central burner receiving protrusion 460 is in contact with the bottom surfaces 610 of the supports, ring surfaces 589 of the side bottom gas intakes and ring surface 622 of the inner hollow cylinder. In this variation, a plurality of upward tips can be added onto the top surfaces of the respective protrusions 460 and 460*a*. Alternatively, downward tips can be added onto the respective surfaces 610, 589 and 622 of the burner 526. Similarly, this solution also can be applied to the second and third embodiments 650 and 650' of the burner.

Therefore, after implementing one or more of the above disclosed solutions if necessary, the top plate having the flat surface is not only ornamental to a kitchen but also useful for positioning various utensils when an user of the stove is in cooking.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A gas stove installed to a counter top of a kitchen, comprising:

a. a housing of said gas stove comprising a removable top flat plate that includes a top surface and a central opening in a large dimension;

b. a removable burner comprising a plurality of gas ports, wherein each of said gas ports being an expanding section of opening including an ascending interior top surface towards upward and outward, a smaller inlet and larger outlet;

c. a removable heat transfer regulating apparatus, comprising an inner hollow shell and cooking utensil supports which are identical, said inner hollow shell being a closed ascending wall having a larger top edge that surrounds a larger top opening and a smaller bottom edge that surrounds a smaller bottom opening, a plurality of openings serving as air passages penetrate through lower and upper parts of said inner hollow shell, wherein said air passages are more densely located to said lower part of said inner hollow shell as compared with said air passages which are less densely located to said upper part of said inner hollow shell, said inner hollow shell which is detachably affixed to said cooking utensil supports surrounds said gas ports of said burner wherein said top edge of said inner hollow shell is positioned to be higher than a top surface of said burner, each of said cooking utensil supports including a upward post having a bottom end and a top end, a transverse upward member having a top and a transverse descending member, said upward post at said top end is connected to said transverse upward member wherein said transverse upward member at said top is connected to said transverse descending member thereby forming a flat top of said cooking utensil support and said bottom end of said upward post is served as a bottom end of said cooking utensil support, said flat tops of the respective cooking utensil supports are positioned to be higher than said top edge of said inner hollow shell; and d. said top edge of said inner hollow shell is positioned inside of said central opening of said removable top flat plate to align with said top surface of said removable top flat plate, so that said removable top flat plate conceals said inner hollow shell thereby causing said stove to have a flat top surface wherein a visual effect of said flat top surface of said stove is consistent with a visual effect of a flat top surface of said counter top, and said cooking utensil supports are circumferentially and radially spaced apart to surround said inner hollow shell wherein said flat tops of the respective cooking utensil supports penetrate through said central opening of said removable top flat plate, said inner hollow shell focusing heat on a cooking utensil which is supported by said cooking utensil supports and positioned above said burner and one of said transverse upward members serving as a heat shield to prevent heating a handle of said cooking utensil.

2. The stove according to claim 1, further comprising:

a. said housing has a sheet structure that includes a burner receiving plate and a closed wall having a bottom side wherein said closed wall at said bottom side is connected to said burner receiving plate;

b. said burner receiving plate including a set of round structures having a round central burner receiving protrusion surrounded by an inner circular recess that is surrounded by a middle ring protrusion that is further surrounded by an outer circular recess;

c. said bottom edge of said inner hollow shell is positioned above and aligned with a middle circle of said inner circular recess of said burner receiving plate, and said bottom ends of the respective cooking utensil supports are positioned into said outer circular recess of said burner receiving plate; and d. said central burner receiving protrusion is for positioning said burner.

3. The stove according to claim 1, wherein each of said gas ports includes a larger expanding section of opening having an ascending interior top surface and a larger outlet which is connected to a smaller section of opening having a smaller inlet.

4. The stove according to claim 2, wherein said burner further comprising a dual flame ring which is composed of a larger outer flame ring and smaller inner flame ring, a. said outer flame ring including a top ring cover and bottom structural member, said top ring cover comprising a central opening surrounded by an exterior circular cylindrical wall having a top and an interior circular cylindrical wall having a top wherein said exterior and interior circular cylindrical walls at the respective tops are connected to a top transverse ring to thereby form a top circular sideward protrusion having an exterior ascending ring surface and a downward interior circular recess, said bottom structural member of said outer flame ring including a middle circular gas mixture receiver and identical left and right side bottom gas intakes, said middle circular gas mixture receiver is comprised of a central opening surrounded by an exterior circular cylindrical wall having a bottom and an interior circular cylindrical wall having a bottom wherein said exterior and interior circular cylindrical walls at the respective bottoms are connected to a bottom transverse ring thereby forming an upward interior circular recess and a bottom transverse ring surface, said top ring cover and middle circular gas mixture receiver are mated together to thereby be defined as an upper section of said outer flame ring wherein said gas ports are positioned, said identical left and right side bottom gas intakes are upwardly connected to said transverse bottom ring surface of said middle circular gas mixture receiver, and b. said inner flame ring comprising a top round cover and a bottom structural member, said top round cover includes a downward circular cylindrical wall having a top and a top round plate wherein said top round plate is connected to said top of said downward circular cylindrical wall to form a downward round recess, said bottom structural member includes a middle hollow cylinder and a lower hollow cylinder wherein said middle hollow cylinder which is composed of a circular cylindrical wall having a central opening is concentrically and downwardly connected to said lower hollow cylinder, said top round cover and middle hollow cylinder are mated together to thereby be defined as an upper section of said inner flame ring, wherein said gas ports are positioned.

5. The stove according to claim 4, further comprising a 19 cm diameter of said top edge of said inner hollow shell and a 8 cm diameter of a circle that is aligned with said outlets of the respective gas ports of said outer flame ring, wherein said diameters are correlated to a distance ranging from 2.5 cm to 3 cm between a top position of an outlet and a bottom surface of said cooking utensil having a diametrical size ranging from 15 cm to 20 cm.

6. The stove according to claim 4, wherein said outer flame ring comprising interlocking means which is composed of a bottom circular downward protrusion positioned to a bottom ring surface of said interior circular cylindrical wall of said top ring cover and a top circular shelf positioned to a top of said interior circular cylindrical wall of said middle circular gas mixture receiver, wherein said protrusion and shelf are matched each other, said inner flame ring comprising interlocking means which is composed of a bottom circular downward protrusion positioned to a bottom surface of said downward circular cylindrical wall of said top round cover and a top circular shelf positioned to a top of said circular cylindrical wall of said middle hollow cylinder, wherein said protrusion and shelf are matched each other.

7. The stove according to claim 4, wherein said outer flame ring comprising interlocking means which is composed of an inverted frustum shaped exterior surface of said exterior circular cylindrical wall of said top ring cover and an inverted frustum shaped top surface of said exterior circular cylindrical wall of said middle circular gas mixture receiver, wherein said inverted frustum shaped exterior and top surfaces are matched each other, said inner flame ring comprising interlocking means which is composed of an inverted frustum shaped exterior surface of said downward circular cylindrical wall of said top round cover and an inverted frustum shaped top surface of said circular cylindrical wall of said middle hollow cylinder, wherein said inverted frustum shaped exterior and top surfaces are matched each other.

8. The stove according to claim 1, wherein said stove having a dual burner configuration comprising two said burners, or a multiple burner configuration comprising three or more said burners.

9. The stove according to claim 1, further comprising said flat tops of the respective cooking utensil supports are positioned to align with said top surface of said top flat plate so that said top flat plate conceals said flat tops of the respective cooking utensil supports.

10. The stove according to claim 2, wherein said burner having a single flame ring comprising a top round cover and a bottom structural member, said top round cover includes a downward circular cylindrical wall having a top and a top round plate wherein said top round plate is connected to said top of said downward circular cylindrical wall to form a downward round recess and a top circular sideward protrusion having an exterior ascending ring surface, said bottom structural member includes a middle hollow cylinder and a lower hollow cylinder wherein said middle hollow cylinder which is composed of a circular cylindrical wall having a central opening is concentrically and downwardly connected to said lower hollow cylinder, said top round cover and middle hollow cylinder are mated together to thereby be defined as an upper section of said single flame ring, where said gas ports are positioned.

11. The stove according to claim 1, wherein said inner hollow shell is made of durable metals, or durable metal alloys, or ceramics.

12. The stove according to claim 1, wherein said burner further comprising combustible gas-primary air mixing means and combustible gas dispersing means, said combustible gas-primary air mixing means including a structure of an upper cylindrical opening concentrically and downwardly connected to a lower frustum shaped opening wherein a diameter of said upper cylindrical opening is larger than a diameter of a top of said frustum shaped opening, and said combustible gas dispersing means including a device having a shape of a cone including a bottom tip which is connected to at least two ascending members.

13. The stove according to claim 1, wherein said cooking utensil supports are integrated, which are circumferentially and radially spaced apart to affix to upper and lower rings, and are detachably attached to said inner hollow shell.

14. The stove according to claim 4, further comprising:

a. each of said identical left and right side bottom gas intakes is a hollow cylindrical member having a generally "T" shaped longitudinal cross section, comprising an upper transverse ring having a central opening which is concentrically and downwardly connected to a lower longitudinal hollow cylinder having an upper cylindrical opening concentrically and downwardly connected to a lower frustum shaped opening, wherein a diameter of said upper cylindrical opening is larger than a diameter of a top of said lower frustum shaped opening, so that said central opening of said upper transverse ring is upwardly connected to said upward interior circular recess of said middle circular gas mixture receiver and downwardly connected to said upper cylindrical opening of said lower longitudinal hollow cylinder for admitting combustible gases and air; and b. said lower hollow cylinder of said bottom structural member of said inner flame ring having an upper cylindrical opening concentrically and downwardly connected to a lower frustum shaped opening wherein a diameter of said upper cylindrical opening is larger than a diameter of a top of said lower frustum shaped opening, so that said upper cylindrical opening of said lower hollow cylinder is connected to said central opening of said middle hollow cylinder for admitting combustible gases and air.

15. The stove according to claim 14, further comprising:

a. said lower longitudinal hollow cylinder of each of said left and right side bottom gas intakes having a first gas disperser in a shape of a first cone including a bottom tip which is connected to at least two ascending members; and b. said lower hollow cylinder of said bottom structural member of said inner flame ring having a second gas disperser in a shape of a second cone including a bottom tip which is connected to at least two ascending members.

16. The stove according to claim 6, further comprising:

a. said gas ports of said outer flame ring are from the respective identical slots that are circumferentially and radially spaced apart to cut off a bottom ring surface of said exterior circular cylindrical wall of said top ring cover, each of said identical slots is an expanding opening of air space having a larger outward opening positioned onto an exterior surface of said exterior circular cylindrical wall, a smaller inward opening positioned onto an interior surface of said exterior circular cylindrical wall, and an ascending interior top surface which is towards outward and upward is aligned with and connected to said exterior ascending ring surface of said top circular sideward protrusion of said top ring cover, when said top ring cover is positioned to mate with said middle circular gas mixture receiver said identical slots are turned into the respective gas ports having the respective ascending interior top surfaces, wherein said smaller inward and larger outward openings are the respective smaller inlets and larger outlets; and b. said gas ports of said inner flame ring are from the respective identical slots that are circumferentially and radially spaced apart to cut off said bottom surface of said downward circular cylindrical wall of said top round cover, each of said identical slots is an expanding opening of air space having a larger outward opening positioned onto an exterior surface of said downward circular cylindrical wall, a smaller inward opening positioned onto an interior surface of said downward circular cylindrical wall and an ascending interior top surface which is towards outward and upward, when said top round cover is positioned to mate with said middle hollow cylinder said identical slots are turned into the respective gas ports having the respective ascending interior top surfaces, wherein said smaller inward and larger outward openings are the respective smaller inlets and larger outlets.

17. The stove according to claim 16, further comprising: said gas ports of said inner flame ring are the respective identical upward openings that are circumferentially spaced apart to penetrate through said top round plate of said top round cover, wherein:

a. each of said identical gas ports which are radially positioned is an expanding opening of air space in a narrow width having a larger outlet of opening positioned onto an exterior surface of said top round plate, a smaller inlet of opening positioned onto an interior surface of said top round plate, a first ascending interior top surface towards outside, and a second ascending interior top surface towards inside; or b. each of said identical gas ports is an expanding opening of air space in a shape of an inverted frustum of a cone, which has a larger round outlet of opening positioned onto an exterior surface of said top round plate, a smaller round inlet of opening positioned onto an interior surface of said top round plate, and an ascending interior top surface.

18. The stove according to claim 6, further comprising:

a. said gas ports of said outer flame ring are the respective identical upward openings that are circumferentially spaced apart to penetrate through said top transverse ring of said top ring cover, wherein:

a1. each of said identical gas ports which are radially positioned is an expanding opening of air space in a narrow width having a larger outlet of opening positioned onto an exterior surface of said top transverse ring, a smaller inlet of opening positioned onto an interior surface of said top transverse ring, a first ascending interior top surface towards outside, and a second ascending interior top surface towards inside; or a2. each of said identical gas ports is an expanding opening of air space in a shape of an inverted frustum of a cone, which has a larger round outlet of opening positioned onto an exterior surface of said top transverse ring, a smaller round inlet of opening positioned onto an interior surface of said top transverse ring, and an ascending interior top surface; and b. said gas ports of said inner flame ring are the respective identical upward openings that are circumferentially spaced apart to penetrate through said top round plate of said top round cover, wherein:

b1. each of said identical gas ports which are radially positioned is an expanding opening of air space in a narrow width having a larger outlet of opening positioned onto an exterior surface of said top round plate, a smaller inlet of opening positioned onto an interior surface of said top round plate, a first ascending interior top surface towards outside, and a second ascending interior top surface towards inside; or b2. each of said identical gas ports is an expanding opening of air space in a shape of an inverted frustum of a cone, which has a larger round outlet of opening positioned onto an exterior surface of said top round plate, a smaller round inlet of opening positioned onto an interior surface of said top round plate, and an ascending interior top surface.

19. The stove according to claim 7, further comprising:

a. said gas ports of said outer flame ring are from the respective identical slots that are circumferentially and radially spaced apart to cut off said inverted frustum shaped top surface of said exterior circular cylindrical wall of said middle circular gas mixture receiver, each of said identical slots is an expanding opening of air space having a larger outward opening positioned onto an exterior surface of said exterior circular cylindrical wall, a smaller inward opening positioned onto an interior surface of said exterior circular cylindrical wall, and an opened ascending interior top surface, when said top ring cover is positioned to mate with said middle circular gas mixture receiver said identical slots are turned into the respective gas ports having the respective ascending interior top surfaces which are towards outward and upward, aligned with and connected to said exterior ascending ring surface of said top circular sideward protrusion of said top ring cover, wherein said smaller inward and larger outward openings are the respective smaller inlets and larger outlets; and b. said gas ports of said inner flame ring are from the respective identical slots that are circumferentially and radially spaced apart to cut off said inverted frustum shaped top surface of said circular cylindrical wall of said middle hollow cylinder, each of said identical slots is an expanding opening of air space having a larger outward opening positioned onto an exterior surface of said circular cylindrical wall, a smaller inward opening positioned onto an interior surface of said circular cylindrical wall and an opened ascending interior top surface, when said top round cover is positioned to mate with said middle hollow cylinder said identical slots are turned into the respective gas ports having the respective ascending interior top surfaces which are towards outward and upward, wherein said smaller inward and larger outward openings are the respective smaller inlets and larger outlets.

20. The stove according to claim 19, further comprising: said gas ports of said inner flame ring are the respective identical upward openings that are circumferentially spaced apart to penetrate through said top round plate of said top round cover, wherein:

a. each of said identical gas ports which are radially positioned is an expanding opening of air space in a narrow width having a larger outlet of opening positioned onto an exterior surface of said top round plate, a smaller inlet of opening positioned onto an interior surface of said top round plate, a first ascending interior top surface towards outside, and a second ascending interior top surface towards inside; or b. each of said identical gas ports is an expanding opening of air space in a shape of an inverted frustum of a cone, which has a larger round outlet of opening positioned onto an exterior surface of said top round plate, a smaller round inlet of opening positioned onto an interior surface of said top round plate, and an ascending interior top surface.

21. The stove according to claim 7, further comprising:

a. said gas ports of said outer flame ring are the respective identical upward openings that are circumferentially spaced apart to penetrate through said top transverse ring of said top ring cover, wherein:

a1. each of said identical gas ports which are radially positioned is an expanding opening of air space in a narrow width having a larger outlet of opening positioned onto an exterior surface of said top transverse ring, a smaller inlet of opening positioned onto an interior surface of said top transverse ring, a first ascending interior top surface towards outside, and a second ascending interior top surface towards inside; or a2. each of said identical gas ports is an expanding opening of air space in a shape of an inverted frustum of a cone, which has a larger round outlet of opening positioned onto an exterior surface of said top transverse ring, a smaller round inlet of opening positioned onto an interior surface of said top transverse ring, and an ascending interior top surface; and b. said gas ports of said inner flame ring are the respective identical upward openings that are circumferentially spaced apart to penetrate through said top round plate of said top round cover, wherein:

b1. each of said identical gas ports which are radially positioned is an expanding opening of air space in a narrow width having a larger outlet of opening positioned onto an exterior surface of said top round plate, a smaller inlet of opening positioned onto an interior surface of said top round plate, a first ascending interior top surface towards outside, and a second ascending interior top surface towards inside; or b2. each of said identical gas ports is an expanding opening of air space in a shape of an inverted frustum of a cone, which has a larger round outlet of opening positioned onto an exterior surface of said top round plate, a smaller round inlet of opening positioned onto an interior surface of said top round plate, and an ascending interior top surface.

22. The stove according to claim 10, further comprising: said lower hollow cylinder having an upper cylindrical opening concentrically and downwardly connected to a frustum shaped opening wherein a diameter of said upper cylindrical opening is larger than a diameter of a top of said frustum shaped opening.

23. The stove according to claim 22, further comprising: said lower hollow cylinder having a gas disperser in a shape of a cone which includes a bottom tip connected to at least two ascending members.

24. The stove according to claim 10, further comprising: said single flame ring including interlocking means which is composed of a bottom circular downward protrusion positioned to a bottom surface of said downward circular cylindrical wall of said top round cover and a top circular shelf positioned to a top of said circular cylindrical wall of said middle hollow cylinder, wherein said protrusion and shelf are matched each other.

25. The stove according to claim 24, further comprising: said gas ports are from the respective identical slots that are circumferentially and radially spaced apart to cut off said bottom surface of said downward circular cylindrical wall of said top round cover, each of said identical slots is an expanding opening of air space having a larger outward opening positioned onto an exterior surface of said downward circular cylindrical wall, a smaller inward opening positioned onto an interior surface of said downward circular cylindrical wall and an ascending interior top surface which is aligned with and connected to said exterior ascending ring surface of said top circular sideward protrusion of said top round cover, when said top round cover is positioned to mate with said middle hollow cylinder said identical slots are turned into the respective gas ports having the respective ascending interior top surfaces which are towards upward and outward, wherein said smaller inward and larger outward openings are the respective smaller inlets and larger outlets.

26. The stove according to claim 24, further comprising: said gas ports of said single flame ring are the respective identical upward openings that are circumferentially spaced apart to penetrate through said top round plate of said top round cover, wherein:

a. each of said identical gas ports which are radially positioned is an expanding opening of air space in a narrow width having a larger outlet of opening positioned onto an exterior surface of said top round plate, a smaller inlet of opening positioned onto an interior surface of said top round plate, a first ascending interior top surface towards outside, and a second ascending interior top surface towards inside; or b. each of said identical gas ports is an expanding opening of air space in a shape of an inverted frustum of a cone, which has a larger round outlet of opening positioned onto an exterior surface of said top round plate, a smaller round inlet of opening positioned onto an interior surface of said top round plate, and an ascending interior top surface.

27. The stove according to claim 10, wherein said single flame ring further comprising interlocking means which is composed of an inverted frustum shaped exterior surface of said downward circular cylindrical wall of said top round cover and an inverted frustum shaped top surface of said circular cylindrical wall of said middle hollow cylinder, wherein said inverted frustum shaped exterior and top surfaces are matched each other.

28. The stove according to claim 27, wherein said gas ports of said single flame ring are from the respective identical slots that are circumferentially and radially spaced apart to cut off said inverted frustum shaped top surface of said circular cylindrical wall of said middle hollow cylinder, each of said identical slots is an expanding opening of air space having a larger outward opening positioned onto an exterior surface of said circular cylindrical wall, a smaller inward opening positioned onto an interior surface of said circular cylindrical wall and an opened ascending interior top surface, when said top round cover is positioned to mate with said middle hollow cylinder said identical slots are turned into the respective gas ports having the respective ascending interior top surfaces which are towards outward and upward, aligned with and connected to said exterior ascending ring surface of said top circular sideward protrusion of said top round cover, wherein said smaller inward and larger outward openings are the respective smaller inlets and larger outlets.

29. The stove according to claim 27, wherein said gas ports of said single flame ring are the respective identical upward openings that are circumferentially spaced apart to penetrate through said top round plate of said top round cover, wherein:

a. each of said identical gas ports which are radially positioned is an expanding opening of air space in a narrow width having a larger outlet of opening positioned onto an exterior surface of said top round plate, a smaller inlet of opening positioned onto an interior surface of said top round plate, a first ascending interior top surface towards outside, and a second ascending interior top surface towards inside; or b. each of said identical gas ports is an expanding opening of air space in a shape of an inverted frustum of a cone, which has a larger round outlet of opening positioned onto an exterior surface of said top round plate, a smaller round inlet of opening positioned onto an interior surface of said top round plate, and an ascending interior top surface.

30. The stove according to claim 2, further comprising said burner is brought into contact with said central burner receiving protrusion in a surface contact mode or a point contact mode.

31. The stove according to claim 2, further comprising: said top flat plate has front, rear, proximal and distal ends, and said sheet structure includes a top closed transverse rim that is inwardly connected to an interior closed shelf that is downwardly connected to a top side of said closed wall.

32. The stove according to claim 31, further comprising each of at least three of said four ends of said top flat plate is connected to a downward rim that includes a plurality of openings serving as air passages, wherein said rim is supported by said interior closed shelf.

33. The stove according to claim 31, further comprising a plurality of downward posts which are connected to each of at least three of said four ends of said top flat plate, wherein said downward posts are supported by said interior closed shelf.

34. The stove according to claim 2, wherein said removable heat transfer regulating apparatus further comprising an outer wall which is composed of top and bottom edges, an exterior surface and a plurality of openings serving as air passages penetrating therethrough, said cooking utensil supports are circumferentially and radially spaced apart to detachably affix to said exterior surface of said outer wall that is further brought into contact with said inner hollow shell, wherein said top edge of said outer wall is detachably connected to said top edge of said inner hollow shell, and said bottom edge of said outer wall is positioned into said outer circular recess of said burner receiving plate.

35. A gas stove installed to a counter top of a kitchen, comprising:

a. a housing of said gas stove comprising a removable top flat plate that includes a top surface and a central opening in a large dimension;

b. a removable burner comprising a plurality of gas ports, wherein each of said gas ports being an expanding section of opening including an ascending interior top surface towards upward and outward, a smaller inlet and larger outlet;

c. a removable heat transfer regulating apparatus comprising an inner hollow shell and cooking utensil supports which are identical, said inner hollow shell being a circularly arcuate wall having a larger top edge that surrounds a larger top opening and a smaller bottom edge that surrounds a smaller bottom opening, a plurality of openings serving as air passages penetrate through lower and upper parts of said inner hollow shell, wherein said air passages are more densely located to said lower part of said inner hollow shell as compared with said air passages which are less densely located to said upper part of said inner hollow shell, said inner hollow shell which is detachably affixed to said cooking utensil supports surrounds said gas ports of said burner wherein said top edge of said inner hollow shell is positioned to be higher than a top surface of said burner, each of said cooking utensil supports including a upward post having a bottom end and a top end, a transverse upward member having a top and a descending member, said upward post at said top end is connected to said transverse upward member wherein said transverse upward member at said top is connected to said descending member thereby forming a flat top of said cooking utensil support wherein said flat tops of the respective cooking utensil supports are positioned to be higher than said top edge of said inner hollow shell; and d. said top edge of said inner hollow shell is positioned inside of said central opening of said removable top flat plate to align with said top surface of said removable top flat plate, so that said removable top flat plate conceals said inner hollow shell thereby causing said stove to have a flat top surface wherein a visual effect of said flat top surface of said stove is consistent with a visual effect of a flat top surface of said counter top, said cooking utensil supports are circumferentially and radially spaced apart to surround said inner hollow shell wherein said flat tops of the respective cooking utensil supports penetrate through said central opening of said removable top flat plate, said inner hollow shell focusing heat on a cooking utensil which is supported by said cooking utensil supports and positioned above said burner and one of said transverse upward members serving as a heat shield to prevent heating a handle of said cooking utensil.

36. A gas stove installed to a counter top of a kitchen, comprising:

a. a housing of said gas stove comprising removable first and second top flat plates that are symmetrical to each other, wherein said removable first top flat plate includes a first central opening in a large dimension and a first top surface, and said removable second top flat plate includes a second top surface and a second central opening in a large dimension;

b. identical first and second removable burners, each burner comprising a plurality of gas ports, wherein each of said gas ports being an expanding section of opening including an ascending interior top surface towards upward and outward, a smaller inlet and larger outlet;

c. identical first and second removable heat transfer regulating apparatus, said first apparatus comprising a first inner hollow shell and identical cooking utensil supports in a first set, said second apparatus comprising a second inner hollow shell which is identical to said first inner hollow shell and identical cooking utensil supports in a second set, wherein each of said identical cooking utensil supports in said second set is identical to each of said identical cooking utensil supports in said first set, said first inner hollow shell being a closed ascending wall having a larger top edge that surrounds a larger top opening and a smaller bottom edge that surrounds a smaller bottom opening, a plurality of openings serving as air passages penetrate through lower and upper parts of said first inner hollow shell, wherein said air passages are more densely located to said lower part of said first inner hollow shell as compared with said air passages which are less densely located to said upper part of said first inner hollow shell, said first inner hollow shell which is detachably affixed to said identical cooking utensil supports in said first set surrounds said gas ports of said first burner wherein said top edge of said first inner hollow shell is positioned to be higher than a top surface of said first burner, each of said identical cooking utensil supports in said first set including a first upward post having a bottom end and a top end, a first transverse upward member having a top and a first transverse descending member, said first upward post at said top end is connected to said first transverse upward member wherein said first transverse upward member at said top is connected to said first transverse descending member thereby forming a flat top of each of said identical cooking utensil supports wherein said flat tops of the respective identical cooking utensil supports in said first set are positioned to be higher than said top edge of said first inner hollow shell, said second inner hollow shell having a top edge which is detachably affixed to said identical cooking utensil supports in said second set surrounds said gas ports of said second burner wherein each of said identical cooking utensil supports in said second set includes a flat top, and said top edge of said second inner hollow shell is positioned to be higher than a top surface of said second burner, and lower than said flat tops of the respective identical cooking utensil supports in said second set; and d. said top edge of said first inner hollow shell is positioned inside of said first central opening of said removable first top flat plate to align with said first top surface, so that said removable first top flat plate conceals said first inner hollow shell, and said identical cooking utensil supports in said first set are circumferentially and radially spaced apart to surround said first inner hollow shell wherein said flat tops of the respective identical cooking utensil supports penetrate through said first central opening of said removable first top flat plate, said top edge of said second inner hollow shell is positioned inside of said second central opening of said removable second top flat plate to align with said second top surface so that said removable second top flat plate conceals said second inner hollow shell, and said identical cooking utensil supports in said second set are circumferentially and radially spaced apart to surround said second inner hollow shell wherein said flat tops of the respective identical cooking utensil supports penetrate through said second central opening of said removable second top flat plate, said removable first top flat plate is positioned to align with said removable second top flat plate thereby causing said stove to have a flat top surface wherein a visual effect of said flat top surface of said stove is consistent with a visual effect of a flat top surface of said counter top.

* * * * *